US012091852B2

(12) United States Patent
Zemrau

(10) Patent No.: US 12,091,852 B2
(45) Date of Patent: Sep. 17, 2024

(54) STEEL AND CONCRETE BUILDING MODULE AND CONNECTIONS

(71) Applicant: Emerge Modular Ltd, Vancouver (CA)

(72) Inventor: Gregory Zemrau, Vancouver (CA)

( * ) Notice: Subject to any disclaimer, the term of this patent is extended or adjusted under 35 U.S.C. 154(b) by 116 days.

(21) Appl. No.: 17/585,095

(22) Filed: Jan. 26, 2022

(65) Prior Publication Data

US 2022/0235547 A1 Jul. 28, 2022

(30) Foreign Application Priority Data

Jan. 26, 2021 (CA) ..... CA 3107029

(51) Int. Cl.

| | |
|---|---|
| ***E04B 5/04*** | (2006.01) |
| ***E04B 1/04*** | (2006.01) |
| ***E04B 1/348*** | (2006.01) |
| ***E04H 1/00*** | (2006.01) |

(52) U.S. Cl.
CPC ..... *E04B 5/04* (2013.01); *E04B 1/04* (2013.01); *E04B 1/3483* (2013.01); *E04H 1/005* (2013.01)

(58) Field of Classification Search
None
See application file for complete search history.

(56) References Cited

U.S. PATENT DOCUMENTS 2,215,975 A * 9/1940 Rackle ..... E04B 5/06 52/440
3,775,928 A * 12/1973 Dawson ..... E04B 1/043 52/432
3,979,863 A * 9/1976 Hurley ..... E04C 2/044 52/584.1
4,100,705 A * 7/1978 Diana ..... E04B 1/04 52/236.1
4,442,648 A * 4/1984 Reece ..... E04B 5/04 52/471
4,669,240 A * 6/1987 Amormino ..... E04B 1/04 52/745.1
6,058,672 A * 5/2000 McClellan ..... E04B 1/04 52/592.1
7,124,545 B1 * 10/2006 Poma ..... E04B 1/355 52/293.3
9,458,619 B2 * 10/2016 Bowron ..... E04B 1/2403
10,196,808 B1 * 2/2019 Gibbs ..... E04C 3/40
10,870,980 B2 * 12/2020 Bowron ..... F16B 12/44

(Continued)

FOREIGN PATENT DOCUMENTS

CN 1745222 A * 3/2006 ..... E04B 1/3483
KR 20120003177 A * 1/2012
WO WO-9635022 A1 * 11/1996 ..... E04B 1/24

*Primary Examiner* — Joshua K Ihezie
(74) *Attorney, Agent, or Firm* — Damien G Loveland; Valuetech Patent Agency Inc.

(57) ABSTRACT

The construction of buildings can be time consuming and error prone. Building modules constructed off-site and pre-furnished can be made more efficiently than building everything on-site. Building modules are disclosed with a reinforced, precast concrete floor with thickened edges, and a structural frame that defines the shape of the module. The frame is made from hollow structural section bars that are attached to the thickened edges of the floor. The module is made with a roof to protect the furnishings and fittings inside the module during storage, transportation and installation.

18 Claims, 52 Drawing Sheets

(56) References Cited

U.S. PATENT DOCUMENTS

| | | | | |
|---|---|---|---|---|
| 2003/0056460 | A1* | 3/2003 | Rivington | E02D 27/02 52/745.1 |
| 2004/0098934 | A1* | 5/2004 | Lawson | E04C 2/06 52/270 |
| 2006/0096202 | A1* | 5/2006 | DelZotto | E04B 1/04 52/274 |
| 2009/0100793 | A1* | 4/2009 | Lamphere | E04H 17/168 52/800.1 |
| 2011/0214361 | A1* | 9/2011 | Ingjaldsdottir | E04B 1/34321 52/745.13 |
| 2016/0002909 | A1* | 1/2016 | Bowron | E04B 1/3483 52/745.03 |
| 2016/0369499 | A1* | 12/2016 | Crumley | E04B 2/20 |
| 2020/0354946 | A1* | 11/2020 | Wilson | E04B 1/04 |
| 2022/0034520 | A1* | 2/2022 | Mohle | F24D 3/142 |

* cited by examiner

STEEL AND CONCRETE BUILDING MODULE AND CONNECTIONS

TECHNICAL FIELD

This application relates to modular building units. In particular it relates to a building module with a precast concrete floor, a roof and walls, and the connections between adjacent modules.

BACKGROUND

Prefabricated modular homes, individual building units of a multi-unit complex, or portions of such can provide benefits to the housing industry as they are pre-manufactured in a controlled factory setting. This reduces production time and cost while increasing quality and efficiency compared with the labour-intensive one-specialty-at-a-time, on-site build which is often error prone and wasteful. Prebuilt units are prepared with walls and floors already housing the connections for utilities, attachments, and furnishings and they are assembled using equipment designed to cope with the particular characteristics of substantially complete structures.

Existing U.S. Ser. No. 10/947,716 to Bowron describes differing aspects of a prefabricated multi-unit project such as a specialized connector assembly. This has a corner block, gusset plate, hallway, and pre-determined grid, which provides a compact, load-bearing, moment-connected complete system for assembling module frames so as to quickly rig and hoist entire modules, connect the modules, and form buildings.

In another case, U.S. Ser. No. 10/584,484 to Cohen has structurally supportive steel wall trusses stacked vertically with their mated tube steel frames interconnected in three dimensions. It also has concrete floors, which are supported and continuous throughout the level, dropped in place and additionally poured. Both contain utilities, a prefabricated kitchen, and other elements within their structure.

A third system disclosed in U.S. Ser. No. 10/145,103 by Collins describes the assembly of multiple prefabricated parts such as non-weight-bearing walls containing interior components and exterior fixtures, structural steel perimeter framing, vertical slabs, cast-in-place concrete, stairs, and elevator using unskilled labour, additionally incorporating recycled materials, solar panels, and water collection.

This background is not intended, nor should be construed, to constitute prior art against the present invention.

SUMMARY OF INVENTION

The presently disclosed modular building systems are modular units constructed using precast concrete to build residential, commercial and multi-use buildings. The focus is on simplifying the construction of the modules and the connections between the modules and other elements.

Using the modular system may reduce the construction budget and the construction schedule and improve the final product quality. It reduces the exposure of the building during construction to severe weather conditions, and will reduce on-site human error. Finally, it will help to reduce the errors and omissions between professional design drawings and contractors' shop drawings, and conflicts, as the modular unit drawings are a combination of both, and have relatively more detail and coordination.

While some construction materials and methods are known in the art, translating common on-site engineering techniques to their particular usage when dealing with prefabricated modular buildings requires several unique and specific considerations Disclosed is a building module comprising a precast concrete floor with opposing edges thickened below the floor, a frame comprising hollow structural section bars attached to a top surface of the precast concrete floor over the thickened edges, and a roof attached to the frame.

Also disclosed is a building comprising a building module that comprises a precast concrete floor with opposing edges thickened below the floor a frame comprising hollow structural section bars attached to a top surface of the precast concrete floor over the thickened edges, and a roof attached to the frame.

DESCRIPTION

A. Glossary

Figure 1:
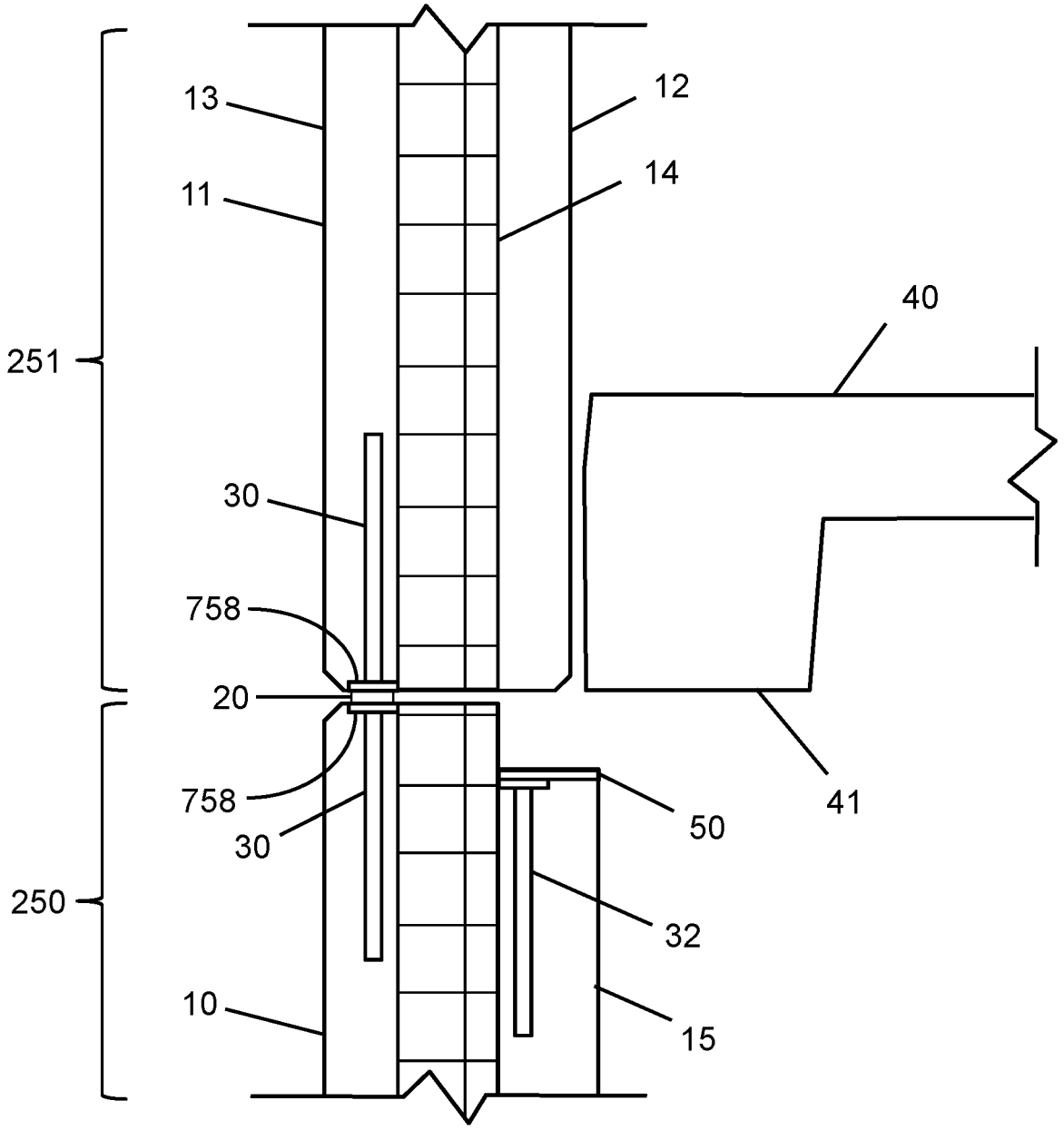
FIG. 1 shows an exterior wall at the mid-span of a module, according to an embodiment of the present invention.

HSS—Hollow Structural Section
PSA—Pipe Sleeve Anchor
ID—Internal diameter

B. Item List

6, 7, 8, 9, 10, 11, 16, 17. Precast wall panel for the building exterior.
12, 15, 18. Precast inner layer of exterior wall panel.
13. Precast outer layer of exterior wall panel.
14. Insulation layer of exterior wall panel.
20. Rolled rod to fit gap complete with foam backer rod and sealant.
21. Rolled rod.
30, 31, 32, 33, 34, 35, 36, 37. Embedded components.
40. Precast floor panel.
41. Thickened edges of precast floor panel.
42. Inner portion of floor panel.
43. End surface of the floor panel.
44. End surface of thickened floor edge.
45. Roof.
46. Roof support fitting.
47. End of floor.
50. ¼"×4" wide steel plate.
60. Elastomeric bearing pad typical over column caps.
61, 62, 63. Columns.
64. Column cap.
65, 66, 67. Party wall.
68. Beam.
69. Column.
70. Precast module end floor region.
80, 81, 82, 83, 84. Precast module end wall.
90. Module end wall.
92. Side wall of module.
100. Pin void cast into wall panel.
110. 1" dia. cold rolled steel pin.
120. Foam backer rod and sealant to suit.
130. 16"×16"×½" steel plate complete with 3½" long A325 bolts.
140. Embed plates cast into the floor.
141. Embedded plate.
150. Grout fill ⅜"×6" recess typical at all accessible floor joint locations.
160. HSS beam.
170. L6"×4"×5/16"×14" long steel angle complete with ⅝" dia.×3½" long A325 bolts to align with outermost holes.
180, 181. Module columns, beyond.
190. 12"×4"×½" steel plate complete with ⅝" dia. HUS™ bolts.
200. 8"×4"×½" steel plate to end of floor beam.
210. End of floor beam.
220. 5½"×4"×½" steel plate complete with ⅝" dia. HILTI HUS™ anchor.
225. Insulation.
230. 8"×16"×½" steel plate complete with ⅝" dia.×3½" long A325 bolts.
235. T-section plate.
240. Module to module embed plates cast into module floors connection across corridor modules.
250, 251, 252, 253, 254, 255, 256, 257, 258. Module.
260. 8½"×3"×⅜" steel plate.
270. Elevator shaft wall.

280. Precast elevator wall.
290. 1⅛" I/D sleeves through precast floor beam complete with 1" dia. steel rod and adhesive.
300. Cast in place concrete pilaster.
310. Cast in place elevator foundation wall.
320. Line of pilaster below.
330. Line of pier below.
340. PSA embeds.
350. Precast header panel.
360. L6"×4"×⅜" continuous steel angle.
370. Precast column cap.
380. Precast elevator lobby floor.
390. Cast in place concrete wall.
391. Rebar.
392. Dowel.
400. Standard grout can through panels complete with 10M dowels. Drill into foundation wall 6" embedment complete with adhesive.
410. Infill precast concrete wall.
420. Embed in foundation wall to match embeds in precast wall.
430. 2" rigs insulation.
440. Grade beam.
441. Rebar.
450. 4" void from typical between piles.
460. 10M dowels at 48" drill 6" into the foundation wall complete with adhesive.
470. All exterior concrete to slope min 2% away from building.
480. Horizontal bent down through thickening.
490. Edge thickening.
500. Pier.
510. Pile complete with pile cap.
511. Pile cap.
520. Grout fill ⅜"×6" recess.
530. 16"×16"×½" steel plate complete with ¾" dia. bolts.
531, 532. Rebar.
540. Embeds at 48", ⅝" dia. shear studs, 5" embedment.
550. Precast to precast connection.
560. ¼"×4" steel plate at 48".
570. 12"×6"×½" steel plate complete with 5'8" dia. HUS™ bolts.
575. Beam.
580. Floor slab.
590. 8"×16"×½" steel plate complete with ⅝" dia.×3½" long A325 bolts.
600. Module to module embedded plates cast into module floors, connection across corridor modules.
610. L6"×4"×5/16"×14" long steel angle complete with ⅝" dia.×3½" long A325 bolts to align with outermost holes.
620. Precast panel to panel connection at 48".
720. HSS frame.
721. Horizontal HSS frame members.
722. Vertical HSS frame members.
723. Footings for columns.
724. Studding.
734. End of embed.
736. Embed opening for bolt.
738. Embed loop.
758. Embed plate.
774. Extension of floor.
800, 801, 802, 803. Modules.
804, 805, 806, 807. Floor extensions.

C. Module

Individual modules, stacked vertically and horizontally, form a building. There are apartment, elevator, stairs, lobby, restaurant, fitness and spa, laundry facility, roof, and port cochere modules, to name a few. Apartment modules can be simply lined up like a parking lot and stacked or adapted to other more interesting configurations or designs, and the modules can be joined to form multiple room living units as well as extended spaces such as in a lobby, event room, or indoor parking. The modules may have appendages for balconies and hallways.

The modules are prefabricated to include the walls, floor, concrete slabs (wall and floor), insulation, utilities (electrical wiring, water pipes, ducts, heating and air conditioning units), wall and floor finishings (surface treatments and features including plaster, paint, carpet, tile, switches), and furnishings for the different rooms including built-in bathroom faucets, toilets, shower/bath, kitchen counters, cabinets, appliances, light fixtures, and moveable chairs, tables, and beds.

The modules are pre-manufactured for their own structural integrity and are built to fit together, laterally and vertically stacked, to support the structural integrity of the entire multi-module building through their load-bearing points. The concrete slab floors and three-dimensional frame formed from bolted columns and roof beams (HSS columns and beams) are load-bearing across the module structure, and the thickened slab edges align with the beams to bear the vertical structural load through the building, cushioned by elastomeric bearing pads.

Furthermore, each module is assembled in a factory and has a roof for weather protection.

Figure 6:
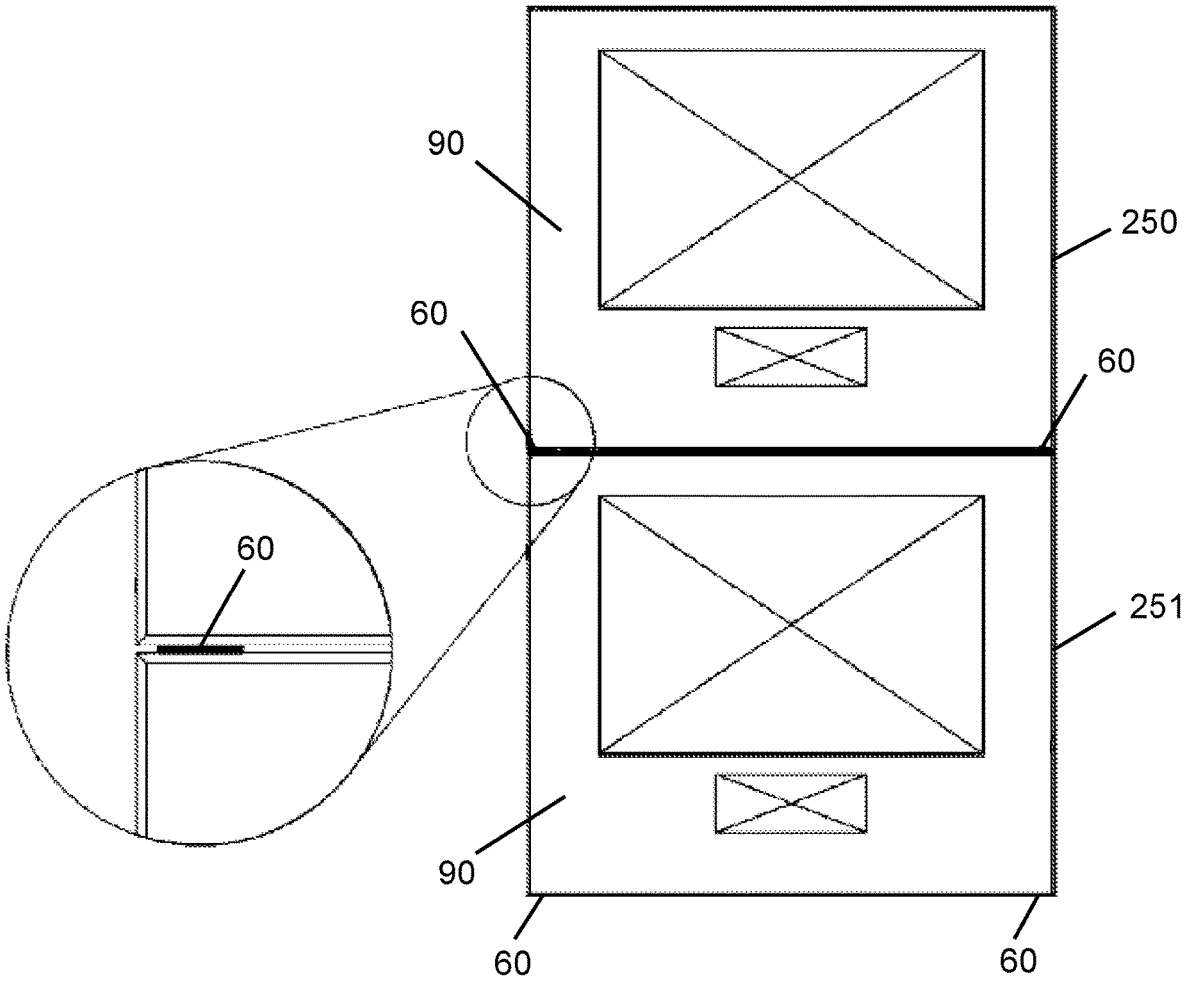
FIG. 6 shows a module to module end wall bearing, according to an embodiment of the present invention.

The building modules 250, 251 are shown in FIG. 6. Each module 250, 251 has a module end wall 90. The end wall 90 may be an exterior end wall or an interior end wall. One module 250 is placed above another module 251. The upper module 250 rests on elastomeric bearing pads 60 on the lower module 251. Likewise, the lower module 251 is supported by elastomeric bearing pads 60. These lower bearing pads may in turn be supported by foundations, beams or other modules.

Figure 47:
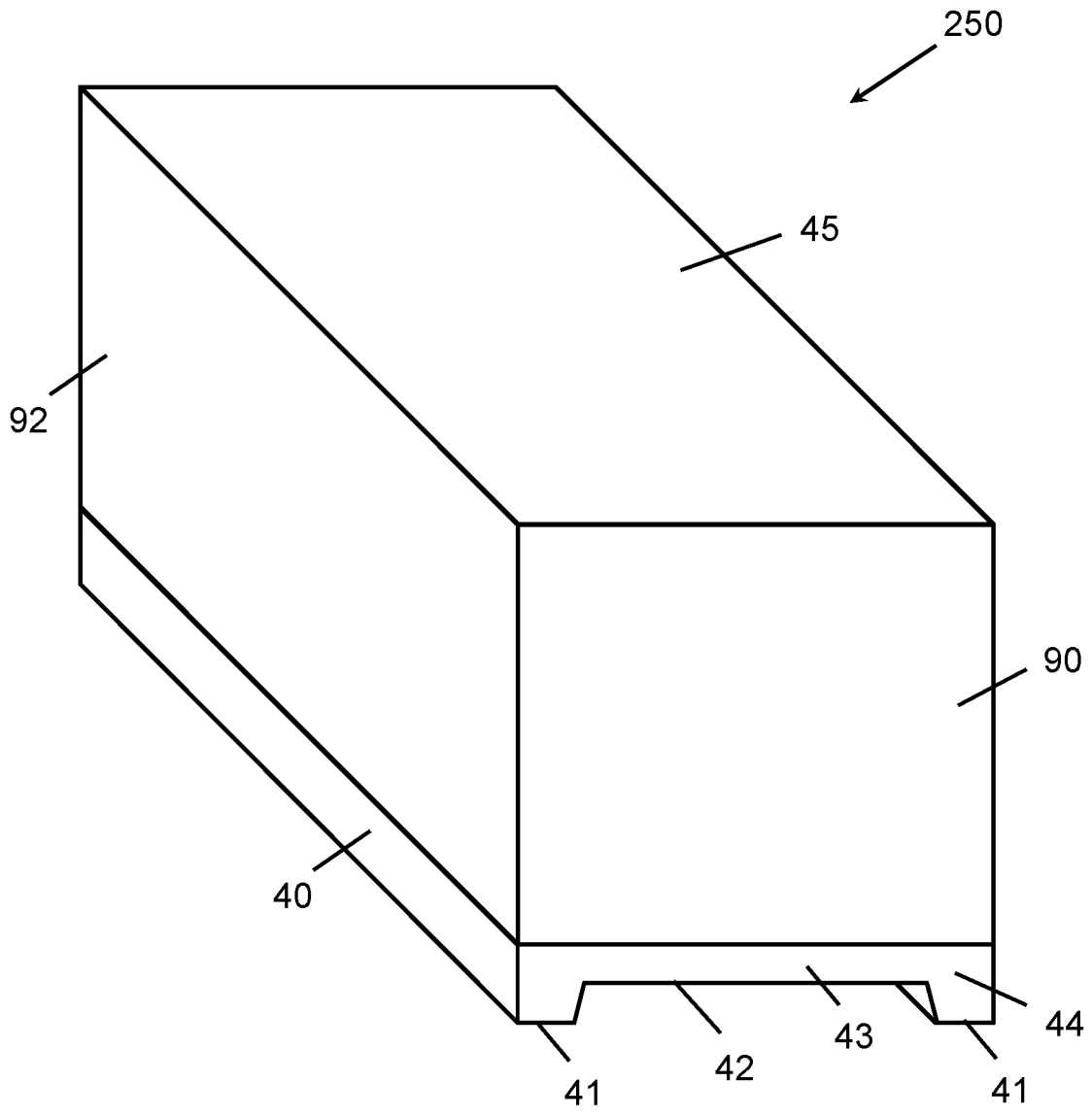
FIG. 47 is a schematic perspective view of a module, according to an embodiment of the present invention.

Another view of a module 250 is shown schematically in FIG. 47, showing the module to have a generally cuboid shape or envelope. The module 250 has a precast concrete floor 40, with thickened edges 41 running the whole of the length (i.e. span) of the module. The inner portion 42 of the floor is thinner than the edges 41. The ends 43 of the floor are not thickened, at least in the middle, but may be thickened at their extremities 44 as a result of the thickening of the edges of the floor. The module 250 has end walls 90 at opposite ends of the module, and side walls 92 on opposite sides of the module. One of the side walls 92 may be an exterior wall, or both side walls may be interior, or party walls. A roof 45 is present on the top of the module, the roof being corrugated, for example. The roof 45 is welded to the top perimeter of the frame, which is made of steel. The attached roof provides additional structural strength and rigidity to the module.

Figure 48:
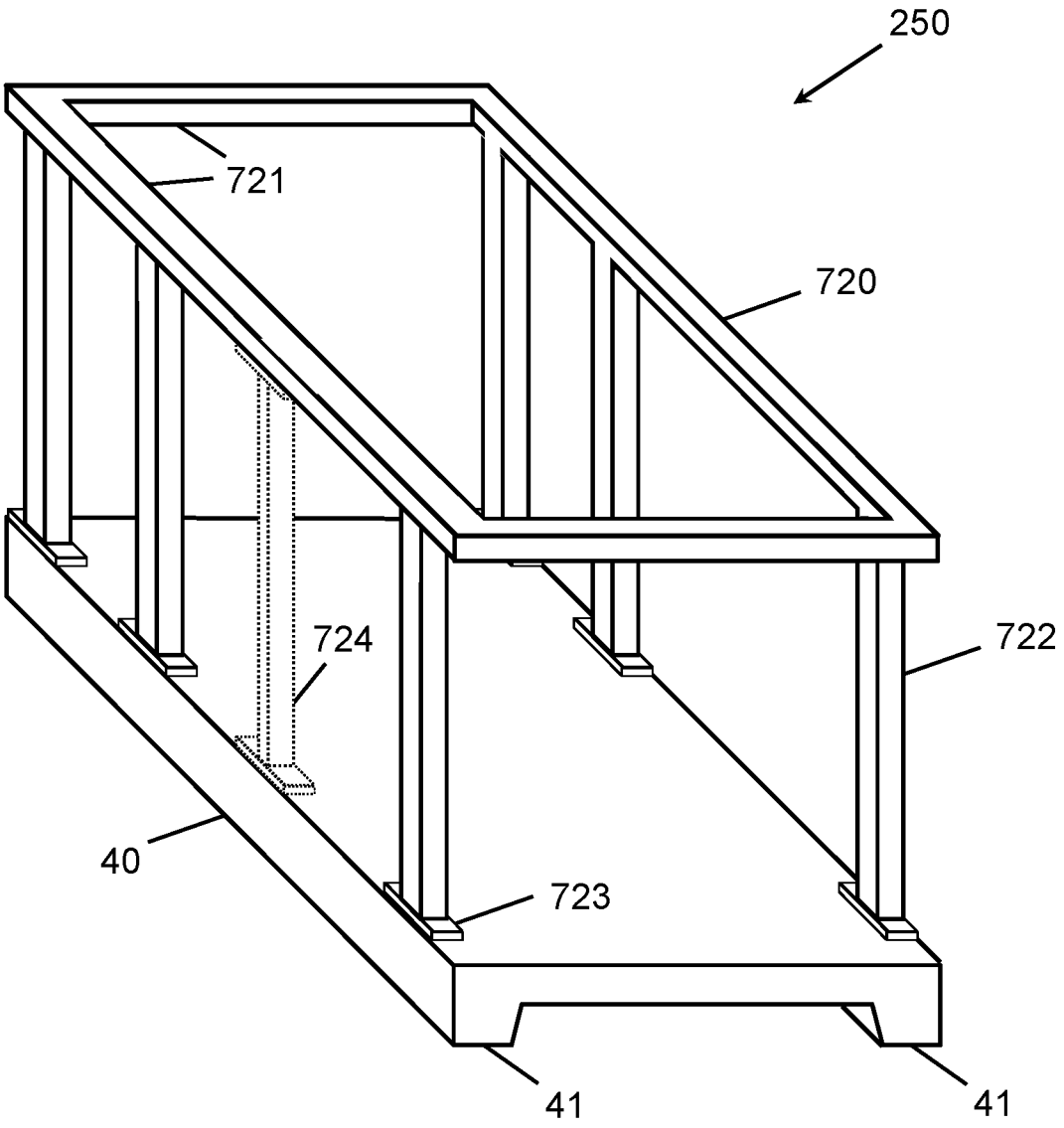
FIG. 48 is a perspective view of the frame and floor of a module, according to an embodiment of the present invention.
Figure 49:
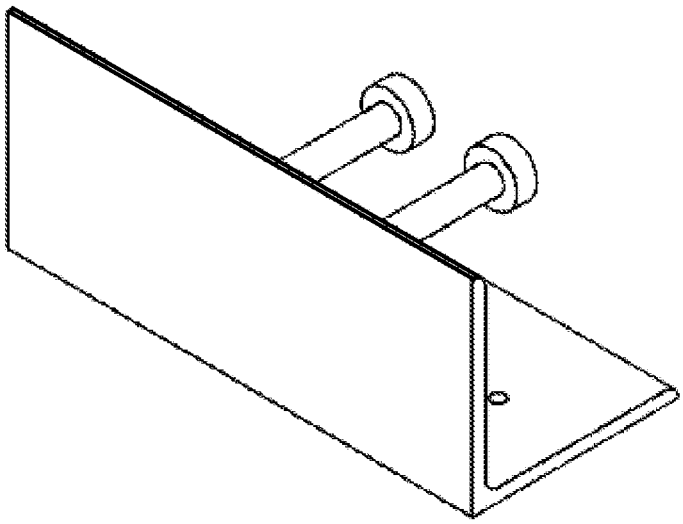
FIGS. 49-56 are examples of embedded components, according to an embodiment of the present invention.

FIG. 48 shows the HSS frame 720 of a module 250. The frame has horizontal members 721 that provide rigidity to the tops of the module walls and support for the module above, if any. Additional horizontal members may connect the longer horizontal members across the width of the module. The frame 720 also has vertical members 722 that form columns to support the upper portions of the frame and transmit the load from a module above to the floor 40. The columns are welded to footings 723 that are screwed or bolted into the floor 40. The footings are attached to the thickened edges 41 of the floor. Studding 724, such as aluminum studding, is installed between the upper, horizontal members 721 of the frame and the concrete floor 40, and may be present in multiple walls of the module. Interior room walls, e.g. drywalls, are attached to the studding on the inside of the module, and finished. Exterior walls, which may be building exterior walls or walls on the outside of the module that are interior to the building, are attached to the frame 720, the edges or ends of the floor 40, or both the frame and the floor. Gaps in the studding may be left for windows and doors.

Figure 2:
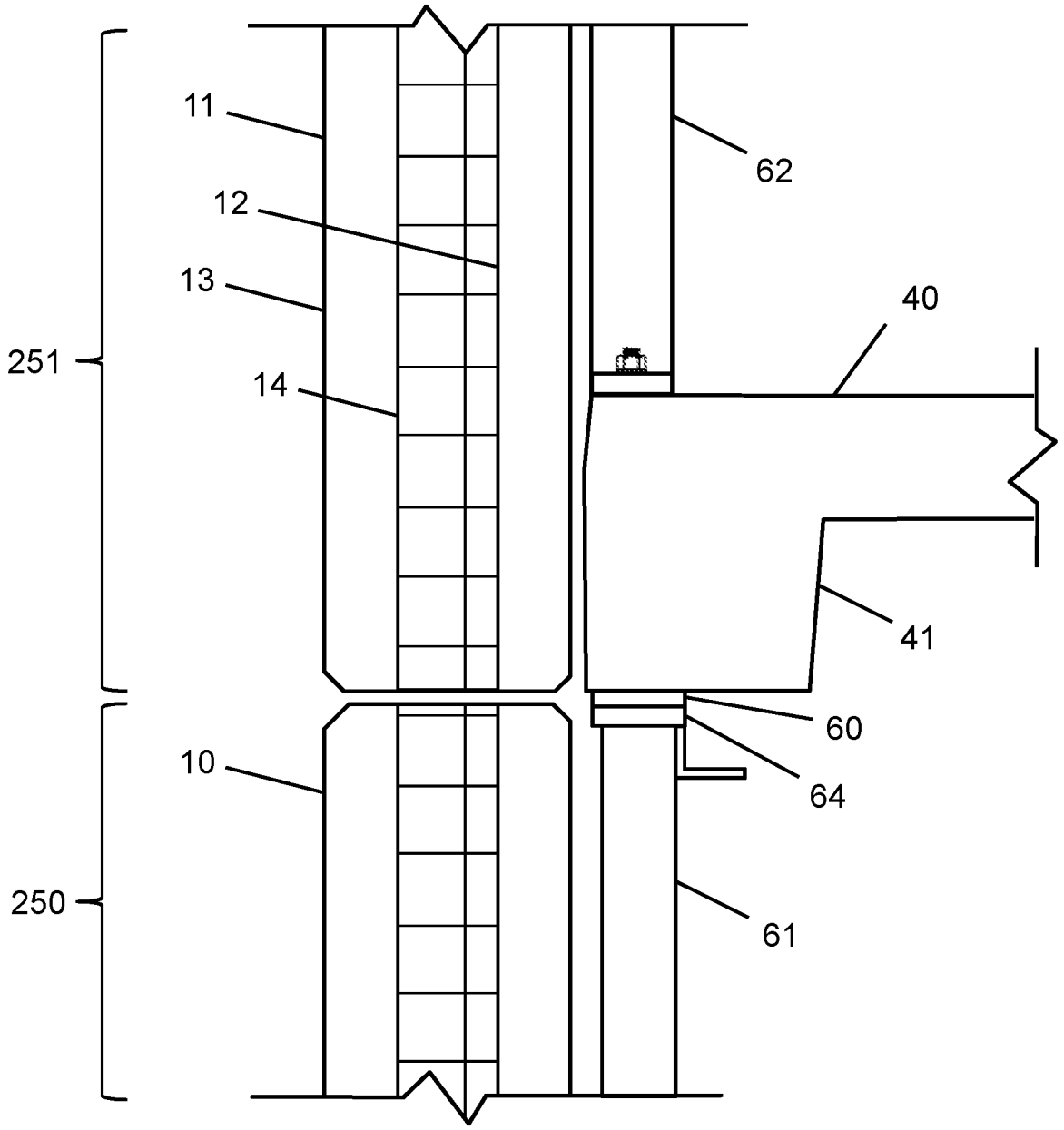
FIG. 2 shows an exterior wall parallel to span columns, according to an embodiment of the present invention.

FIG. 2 shows an upper module 251, with precast concrete floor 40 and precast exterior wall panel 11, located over a lower module 250 with precast exterior wall 10. The upper module 251 is supported by an elastomeric bearing pad 60 located between a column 61 of the lower module and the bottom of the floor panel 40 of the upper module. The bearing pad 60 is mounted on top of a column cap 64 on top of the column 61. Column 62 of the upper module 251 is screwed to the floor 40 of the upper module. Columns 61, 62 are made from HSS and form part of the frame 720 that provides structural strength to the module. Columns 61, 62 may be referred to as span columns, as they support the span of the modules with other span columns.

Still referring to FIG. 2, the precast exterior wall panels 10, 11 are building exterior walls. They have a layered structure, with precast concrete inner layer 12 and precast concrete outer layer 13, with an insulation layer 14 sandwiched between them. It will be clear that other building exterior wall structures may be employed in other embodiments.

Figure 3:
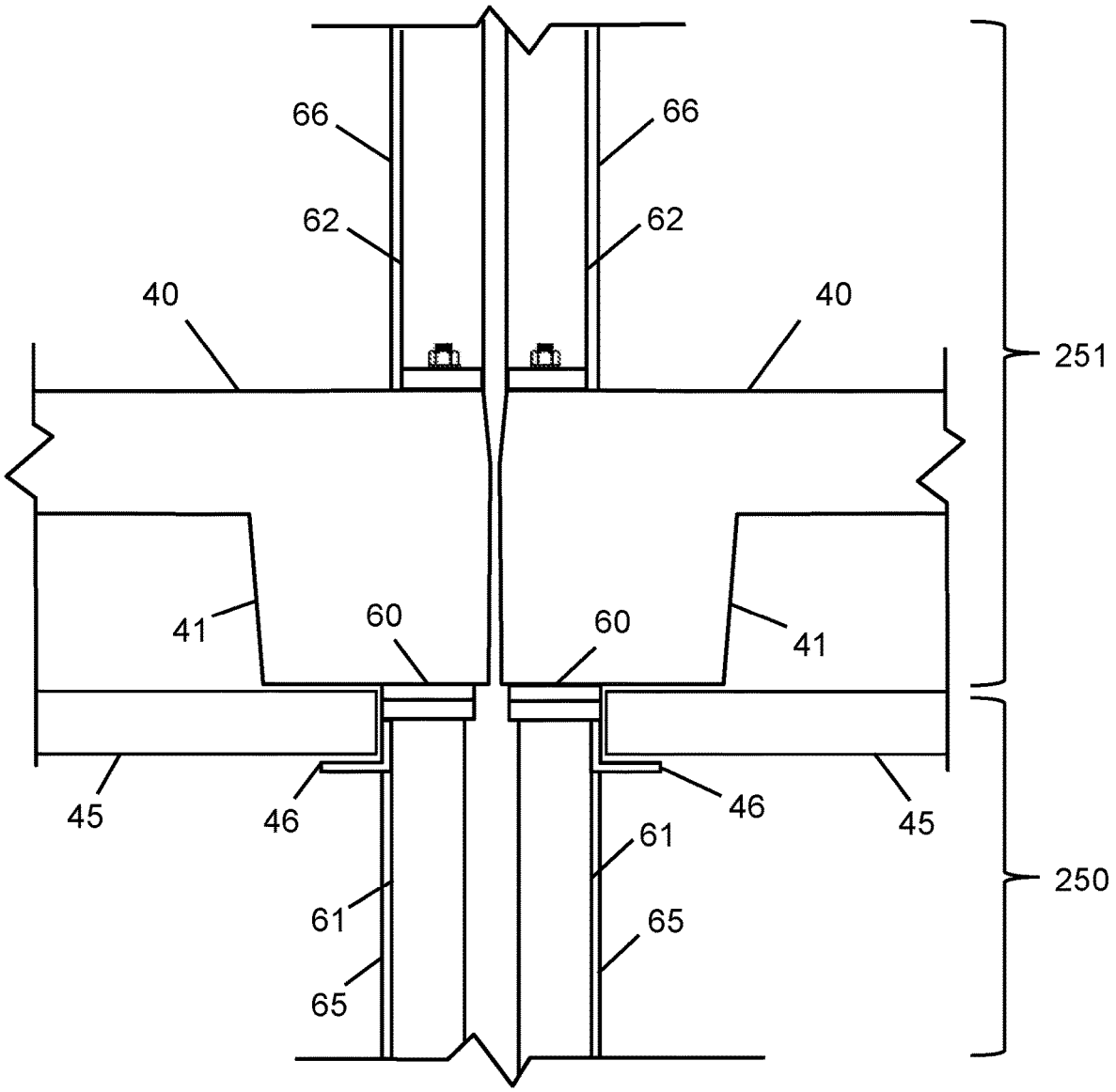
FIG. 3 shows an interior party wall connection seen parallel, according to an embodiment of the present invention.
Figure 33:
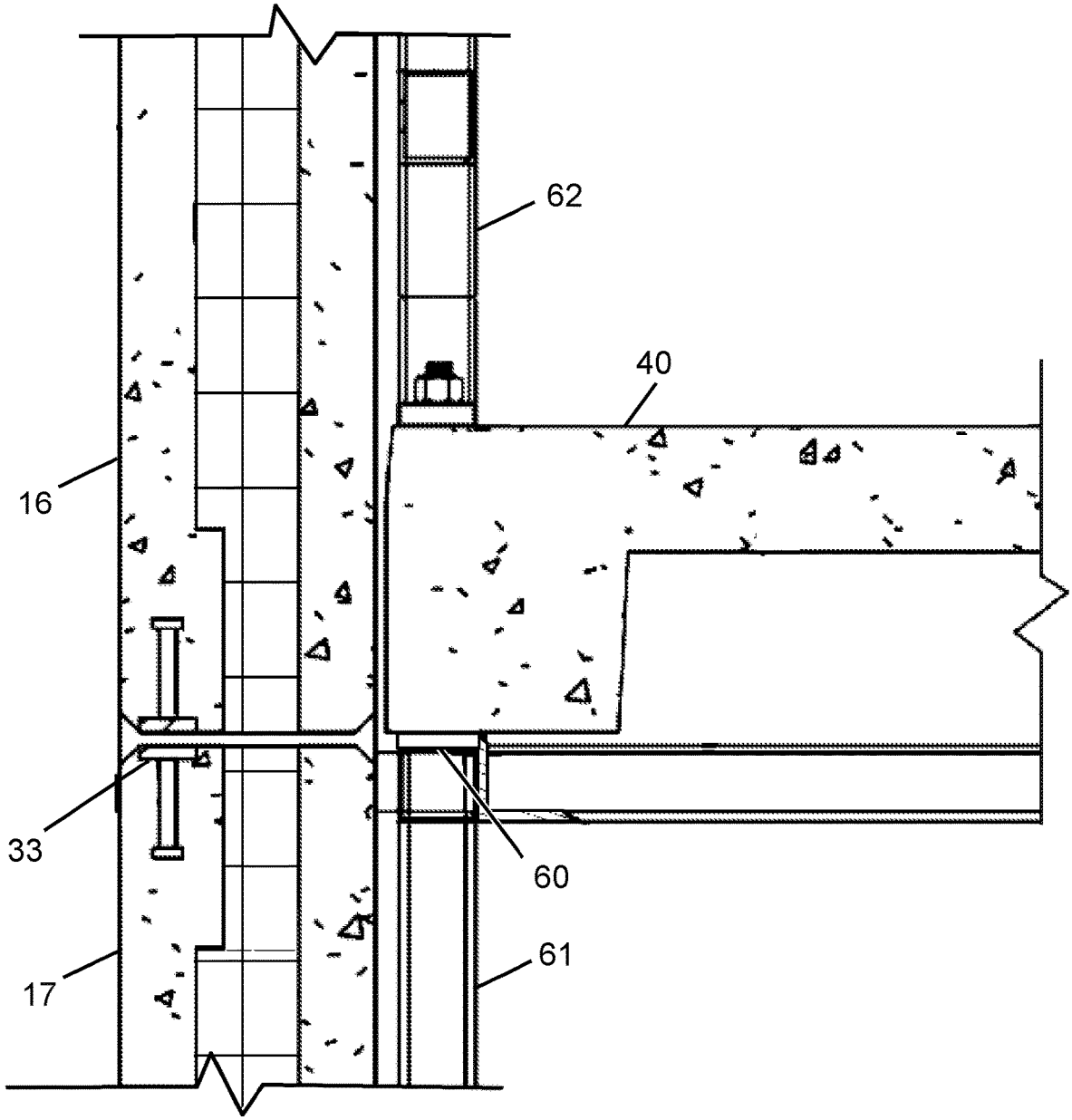
FIG. 33 shows an exterior wall viewed parallel to span at a column, according to an embodiment of the present invention.

FIGS. 3 and 33 also show the elastomeric bearing pads 60 between modules that are located one above the other.

Figure 20:
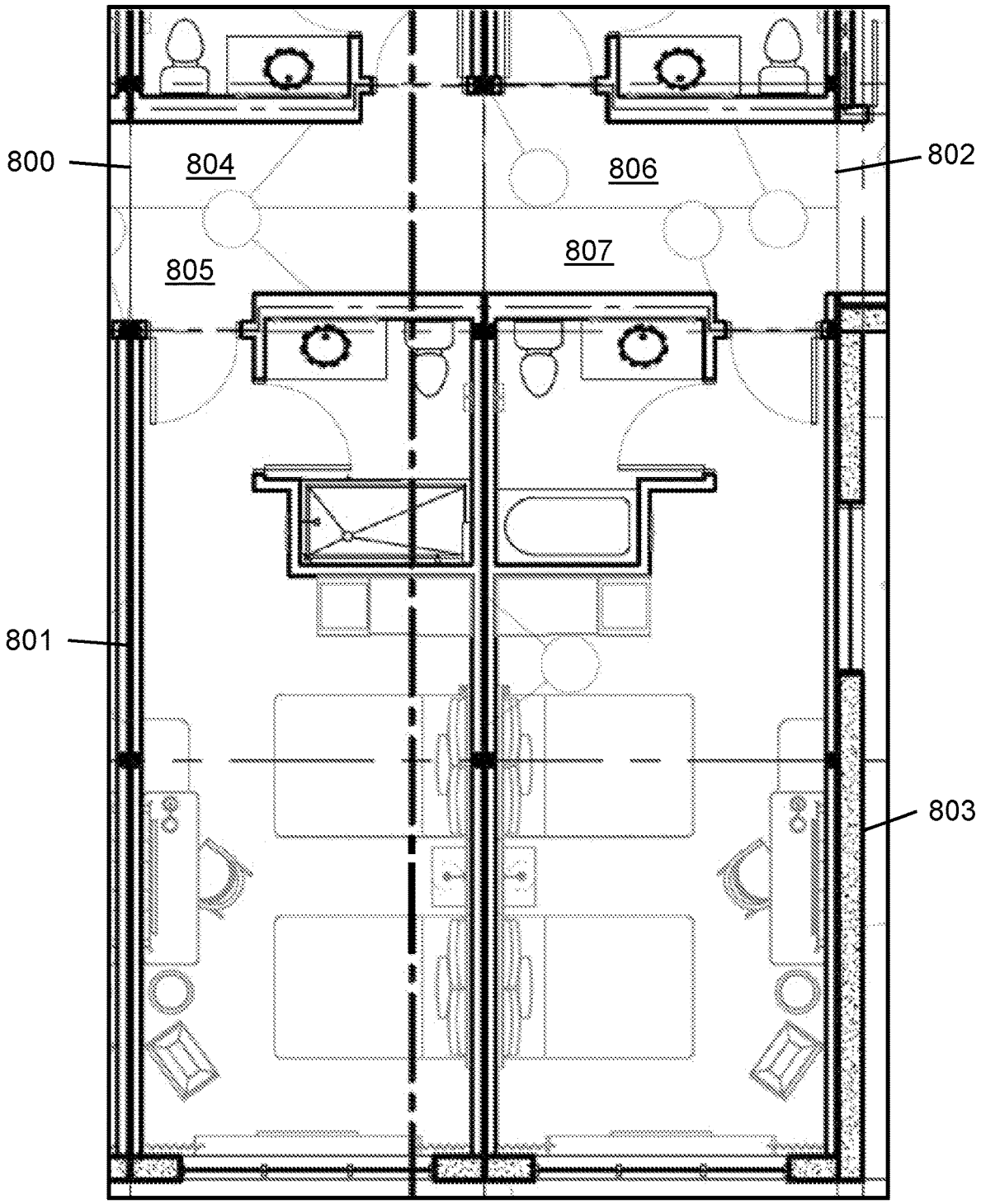
FIG. 20 shows a section of an architectural plan showing four modules, according to an embodiment of the present invention.

Referring to FIG. 20, four modules 800, 801, 802, 803 are shown connected to each other on a floor of the building. A corridor is formed by extensions 804, 805, 806, 807 to the module floors.

D. Floor

Referring to FIG. 47, the floor 40 of a module is precast concrete. The floor is typically rectangular, with the long sides referred to as edges and the shorter sides referred to as ends. The floor is thicker at the edges 41 compared to the inner portion of the floor. The thickened edges may extend the full length of the edge, or partially along the edge.

Figure 57:
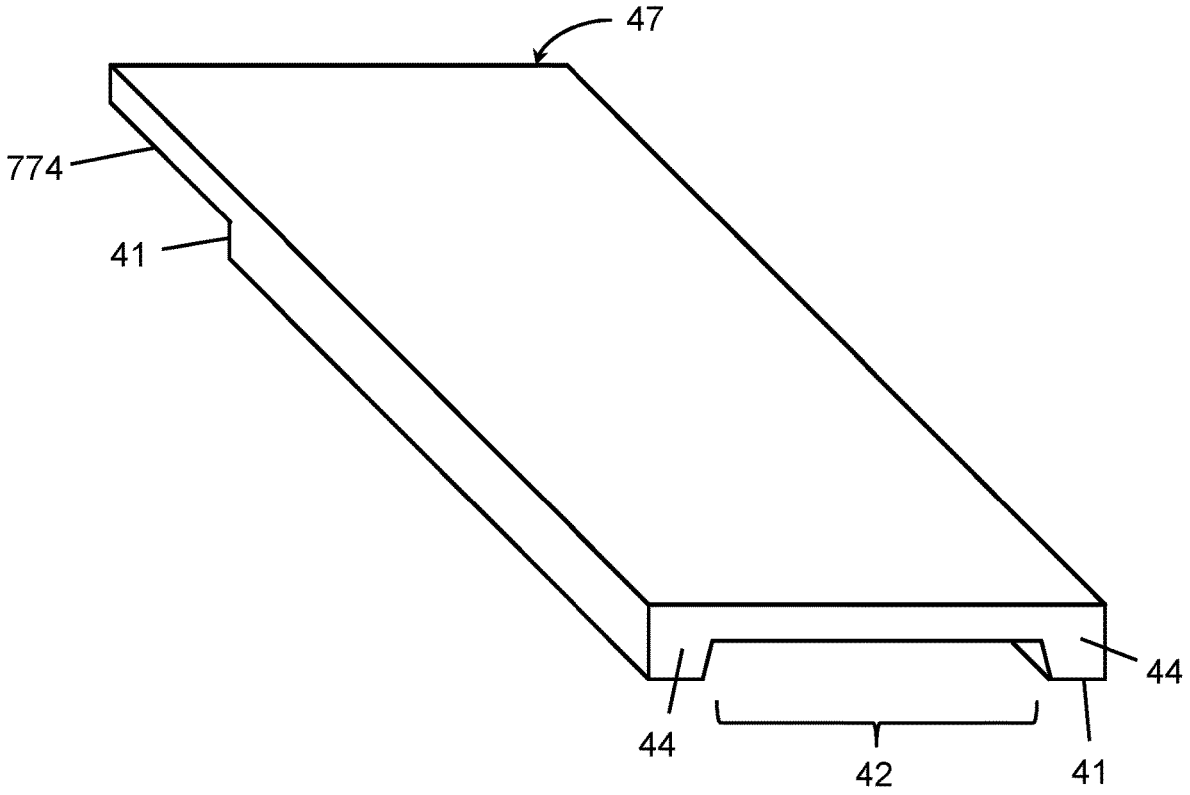
FIG. 57 is a perspective view of a module floor that is extended at one end, according to an embodiment of the present invention.

Referring to FIG. 57, the thinner, inner portion 42 of the floor may in some cases extend in length beyond the end faces 44 of the thickened edges 41, or the thickened edges terminate before reaching a given end 47 of the floor. This results in an extension 774 of the inner floor area, which is of lower thickness than the edges, to form the floor or partial floor of a corridor that is outside the room defined by the walls of the module. In other embodiments, the extended floor area 774 beyond the thickened edges 41 may serve as a balcony. Note that in some embodiments, the shape of the floor may be square. Two such modules positioned as mirror images may be connected with their extensions 774 abutting each other, to form the floor of a corridor, as in FIG. 20.

Adjacent modules 251 may be aligned with their thickened floor edges 41 alongside each other, as in FIG. 3. The thickened edges 41 of the floors 40 rest on elastomeric bearing pads 60, which are located on columns 61 of the modules 250 below. Other columns 62 are bolted to the top surface of the floors 40. Also shown in this figure are the roofs 45 of the lower modules 250, which are supported by fittings 46 attached to the upper region of the columns 61.

Figure 5:
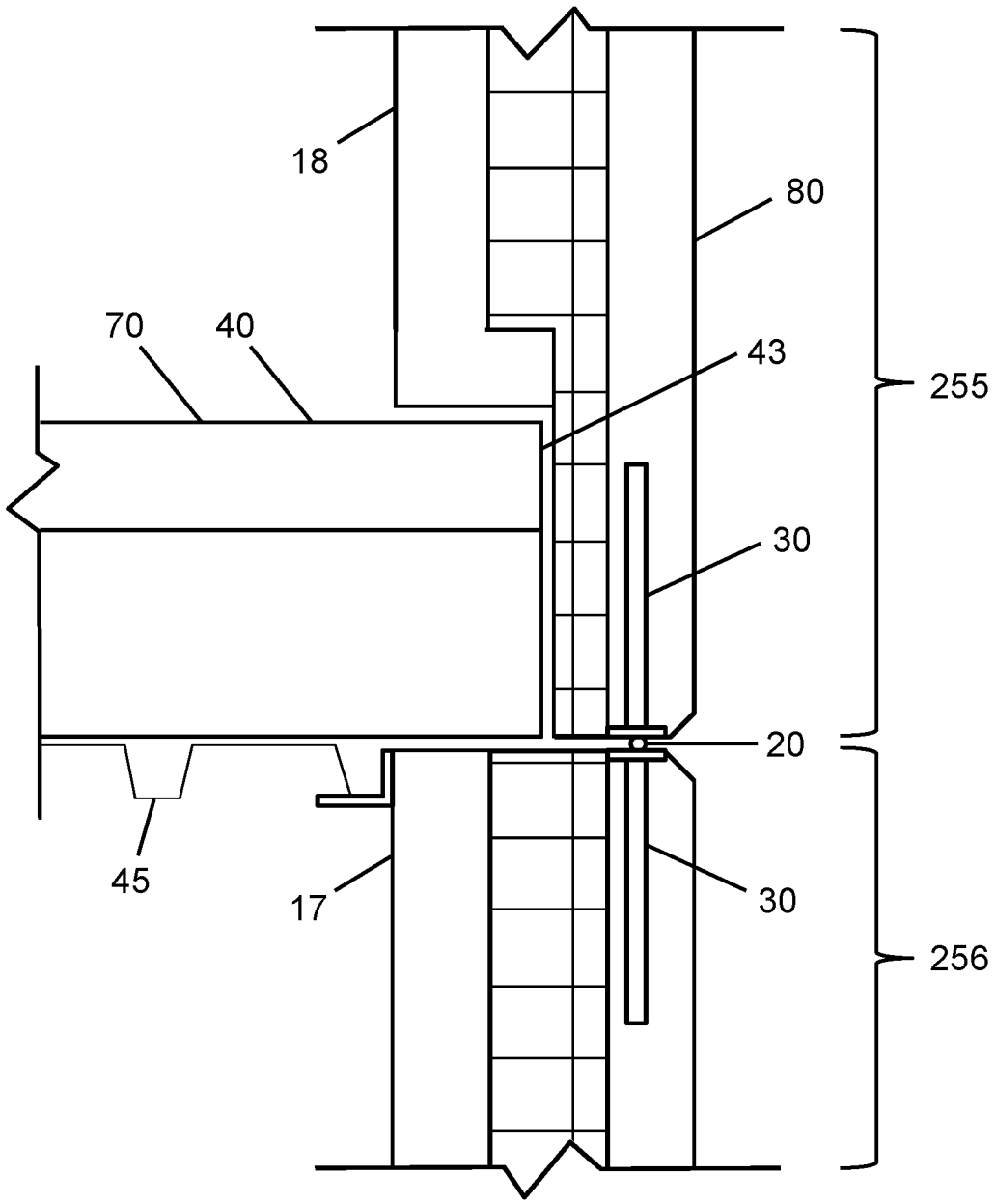
FIG. 5 shows a module to module connection, according to an embodiment of the present invention.
Figure 39:
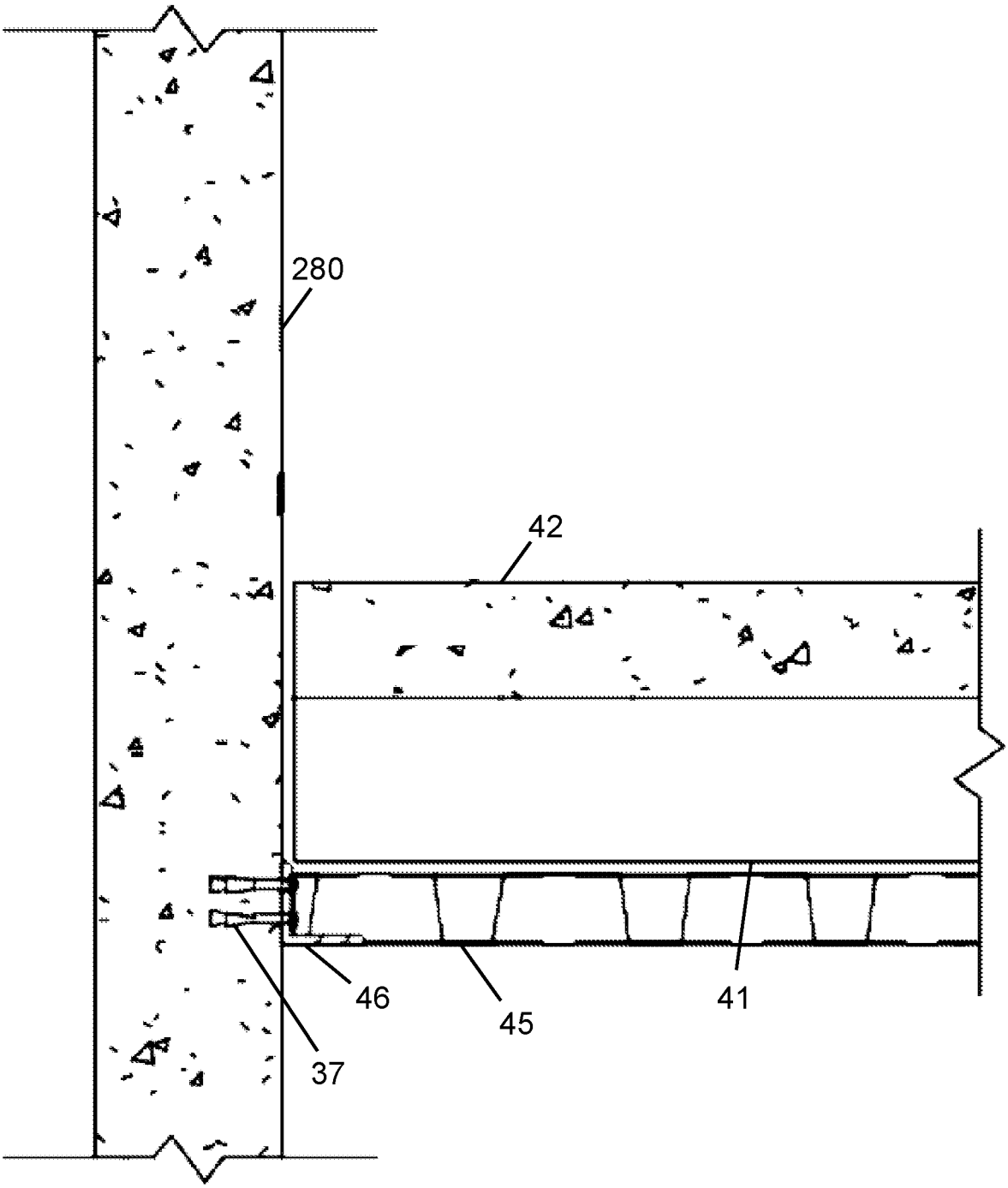
FIG. 39 shows a module to elevator panel, according to an embodiment of the present invention.

FIG. 5 shows the end portion 70 of the floor 40, i.e. the precast module end floor 70, which extends to the end 43 of the floor. FIG. 39 also shows a sectional view taken through the thinner, inner portion 42 of the floor away from the edges, showing the inner portion of the floor being thinner than the edge 41 of the floor.

E. Exterior Wall Connection

The exterior wall connections are shown in FIGS. 1, 2, 28, 33 and 38. These walls are those that are on the exterior of the building.

Figure 53:
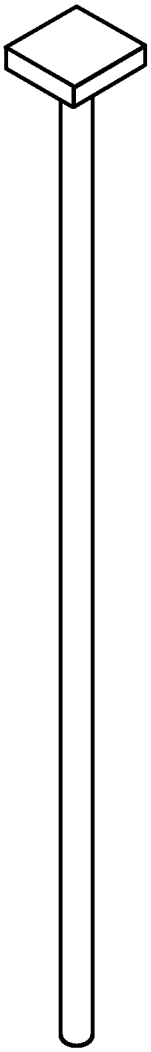
Figure 54:
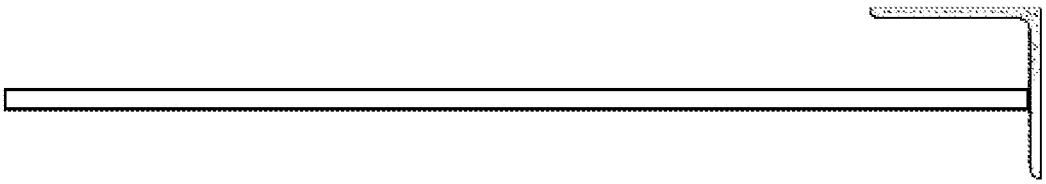

Referring to FIG. 1, which is at mid-span of the modules, each exterior wall 10, 11 is a precast concrete wall panel. The panel 10, 11 has two outer precast concrete layers 12, 13 and an inner layer 14. The outer portion of the exterior precast wall panel 10, 11 may have an embed 30 located at the mid-span of the module. Both upper and lower exterior precast wall panels 11, 10 respectively have an embed 30 at the mid-span. An example of such an embed may be seen in FIG. 53. The outer portions 13 of the exterior precast wall panels 10, 11 are connected to each other via a combination 20 of a rolled rod, backer rod and sealant.

FIG. 1 shows one building module 251 located above another building module 250, at a position mid-span along a longer side of the modules. Each module 250, 251 has a non-load-bearing precast exterior wall panel 10, 11 that is a sandwich of concrete panels 12, 13 filled with insulating material 14. Each exterior wall panel 10, 11 is strengthened with an embedded rod 30. The embeds 30 have a steel plate 758 that is present on the lower edge of the outer concrete portion 13 of the upper exterior wall 11, and the upper edge of the outer concrete portion of the lower exterior wall 10. Sealing connections between the exterior walls of the vertically placed modules at mid-span are made with a rolled rod 20 dimensioned to fit the gap between the steel plates 758 in the outer concrete panels of the upper and lower exterior walls. Sealing continues between the lower edge of the outer concrete portion 13 of the upper exterior wall 11, and the upper edge of the outer concrete portion of the lower exterior wall 10 where plates 758 are not present. A ¼"×4" wide steel plate 50 is present on the top edge of the inner precast concrete layer 15 of the lower exterior wall panel 10. The inner precast concrete layer 15 is lower in height than the insulation and outer concrete layers. This allows for sealant to be added from the inside of the module and for fireproofing to be installed. Embedded component 32 is cast into the inner concrete layer 15 of the lower panel 10. A precast floor 40 is thickened at its edge 41 where the floor and the inner surface of the exterior wall panel 11 meet.

Rigid load-bearing prefabricated frames of primarily concrete and steel generally conduct vibration throughout the structure including that of seismic activity, incurring stress, and even more so for the stronger precast slabs made off-site. Referring to FIG. 2, to absorb and dampen unwanted vibration, elastomeric bearing pads 60 typically are placed over column caps 64 between the supporting column 61 and the thickened edge 41 of the precast floor 40 adjacent to the exterior wall 11.

Figure 28:
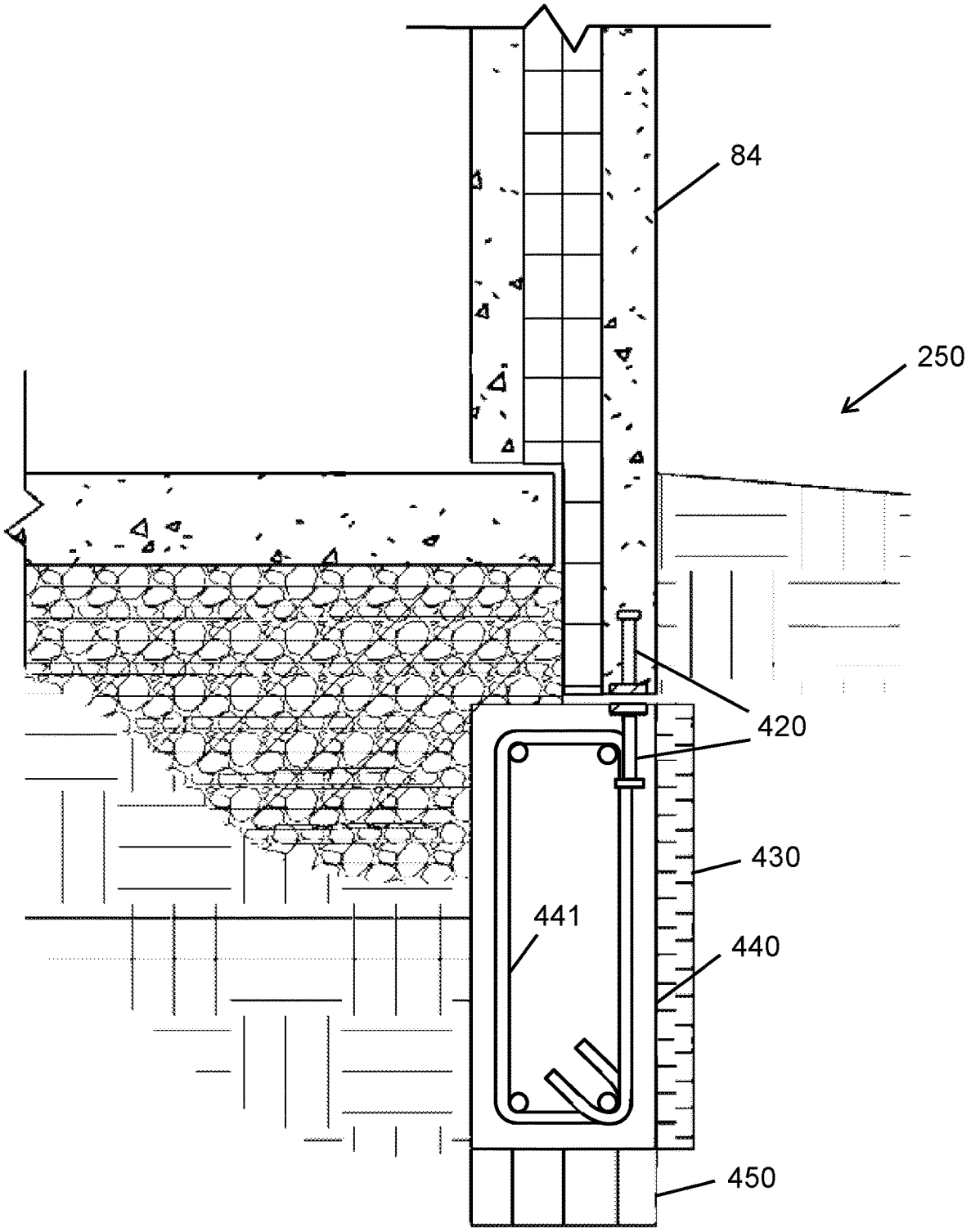
FIG. 28 shows a module exterior end wall, according to an embodiment of the present invention.

FIG. 2 shows the upper and lower precast exterior wall panels 11, 10 respectively alongside the columns 62, 61. In contrast to the view of FIG. 1, the upper and lower precast exterior wall panels 11, 10 may not have embeds 30 at this location. FIG. 28 shows a precast exterior wall panel 84 on a grade beam 440 that forms a foundation wall. The grade beam is reinforced with rebar 441. Embeds 420 are present in the foundation wall to match the embeds in the precast exterior wall panel 84.

FIG. 28 is a diagram at the exterior end wall 84 of the module 250 where the precast module wall extends down to the foundation wall 440 and is secured across the gap with embedded components 420 in both. The foundation wall includes a grade beam 440 and is insulated to its side by 2" rigs insulation 430 and protected from below by a 4" void typical between piles 450.

FIG. 33 shows the precast exterior wall panel 17, 16 at the columns. Both upper and lower exterior precast wall panels 16, 17 respectively have an embed 33 by the columns. FIG. 33 displays the connection of exterior walls 17, 16 adjacent to the span at the location of the columns 61, 62. The precast module floor 40 sits on an elastomeric bearing pad 60 over the column cap of the module beneath, directly below and in line with the upper column which is bolted into the module floor slab. The weight-bearing columns of the upper and lower modules align vertically and parallel to the exterior wall. Inside the precast exterior wall panel 17, 16 the connection of upper and lower modules uses embedded metal rods 33 at top and bottom of the panels and sealant across the gap.

Figure 38:
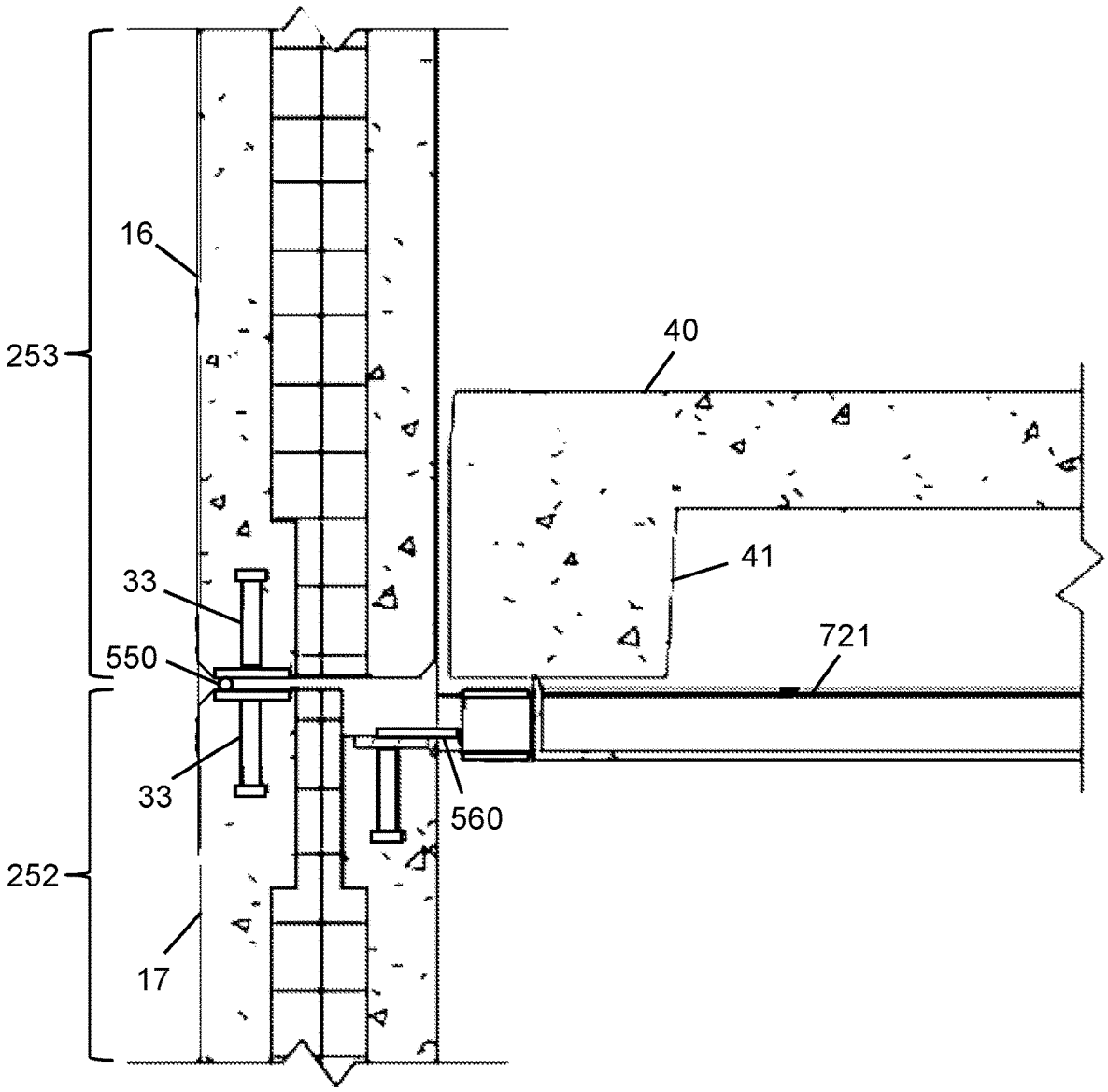
FIG. 38 shows an exterior wall at mid-span, according to an embodiment of the present invention.
Figure 55:
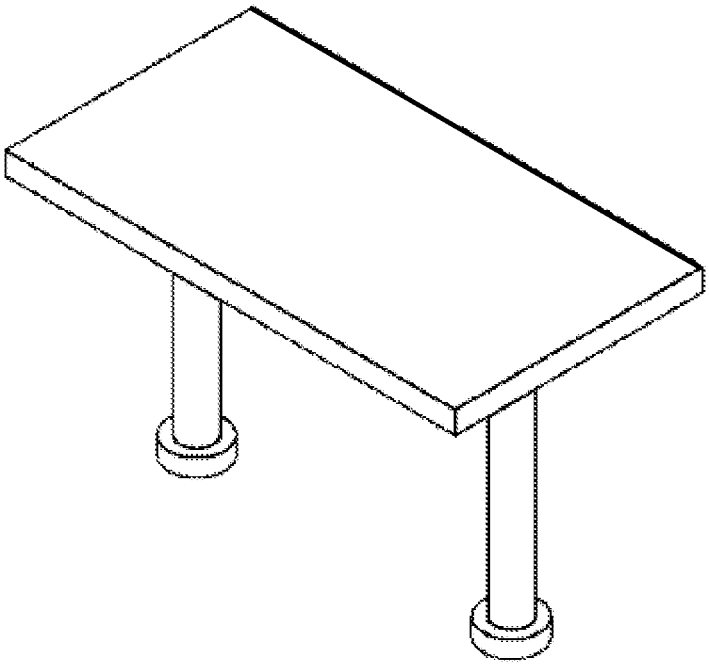
Figure 56:
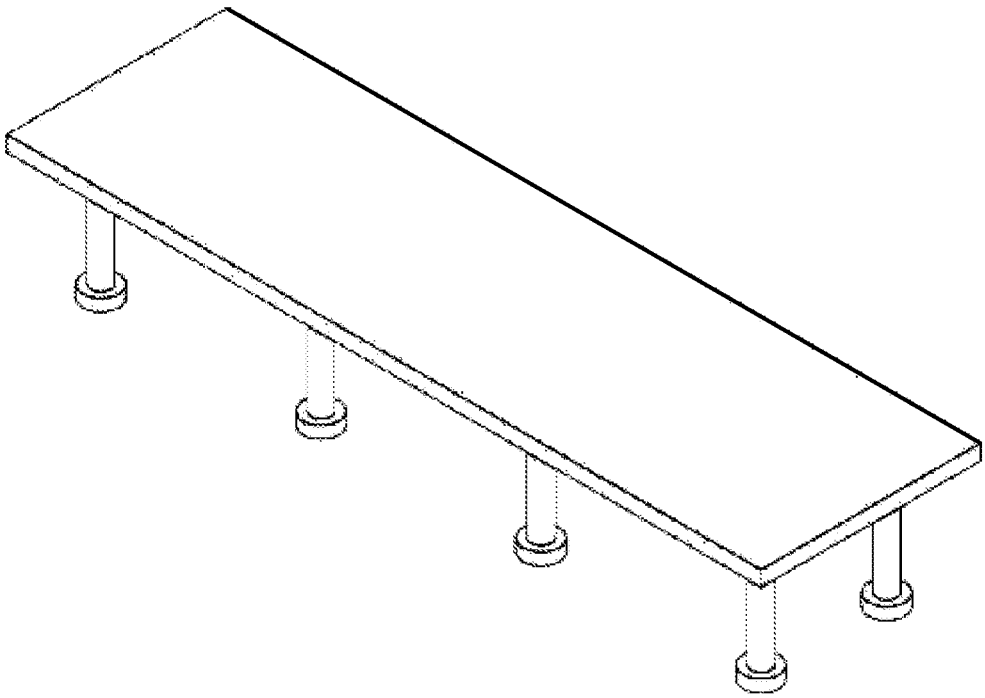

FIG. 38 shows the exterior precast wall panels 17, 16 at the mid-span, of modules 252, 253 respectively. There is a precast to precast connection 550 between the upper and lower precast exterior wall panels 16, 17 respectively. Embeds 33 are present in the outer layers of the precast wall panels 17, 16. Such embeds may be seen in FIG. 55, for example.

FIG. 38 shows the exterior wall adjacent to mid-span of the modules 252, 253, where a precast to precast connection 550 joins upper and lower modules 253, 252 by way of opposing embedded metal rod and plate assemblies 33 where the precast wall panels 252, 253 meet at the exterior facade. At the interior layer of the lower wall panel, ¼"×4" steel plates 560 at 48" (1.2 m) spacing connect to the lower module beam 721. As modules 252, 253 are stacked, the lower module beam will support the upper module floor at its thickened outer edge 41.

F. Interior Wall Connection

The interior wall connections are shown in FIGS. 3, 4, 34 and 36.

Figure 4:
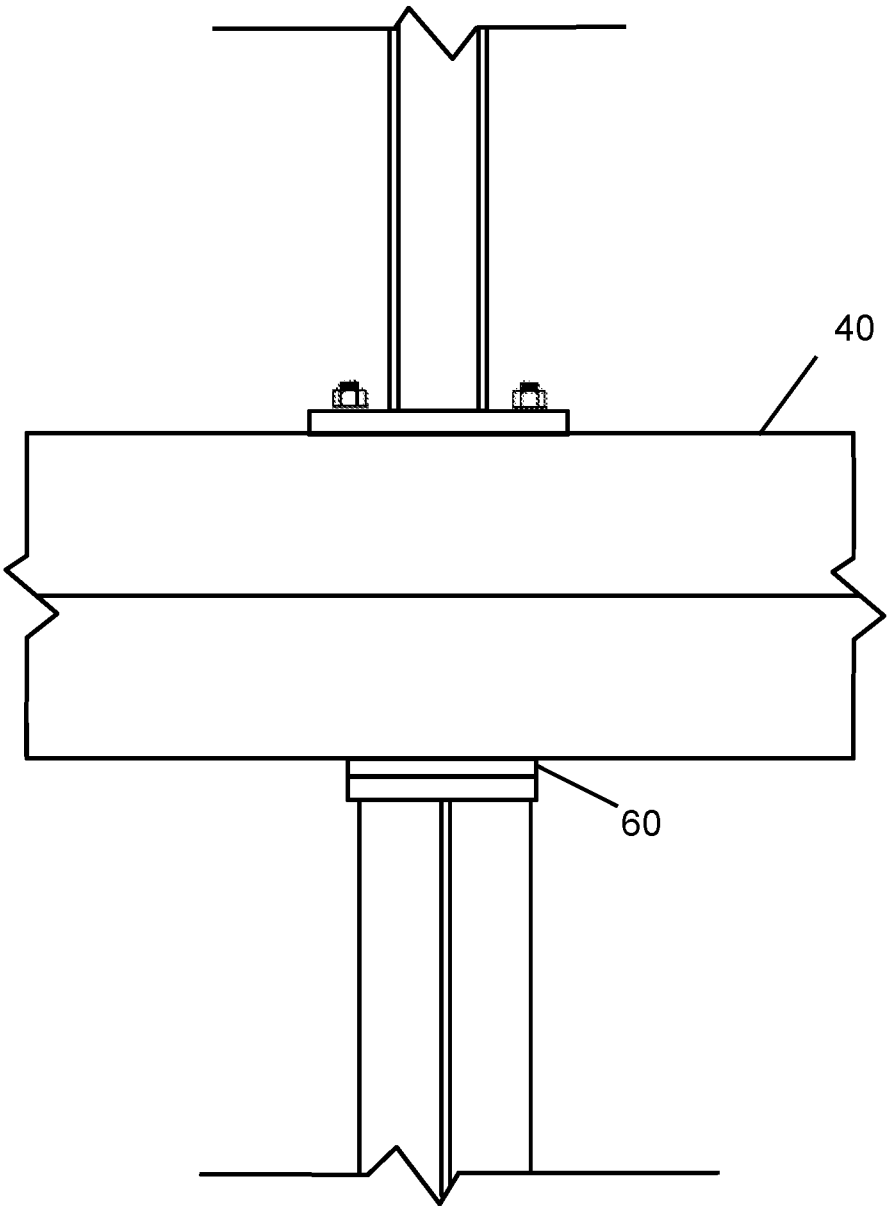
FIG. 4 shows an interior party wall connection seen perpendicular, according to an embodiment of the present invention.

FIGS. 3 and 4 display the interior walls between modules with the columns 62 of the HSS load-bearing steel frame bolted into the slabs 40.

Figure 34:
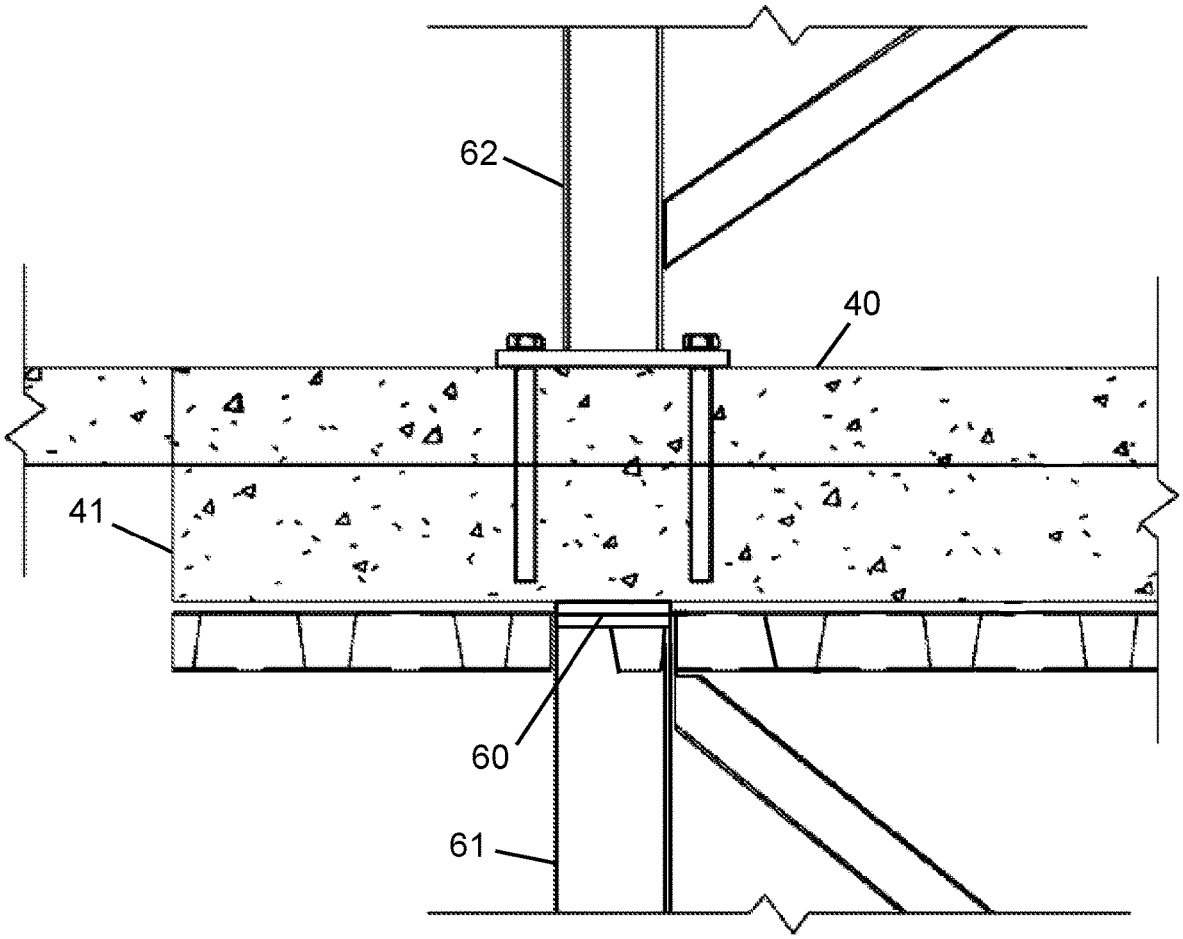
FIG. 34 shows an interior party wall connection viewed perpendicular, according to an embodiment of the present invention.
Figure 36:
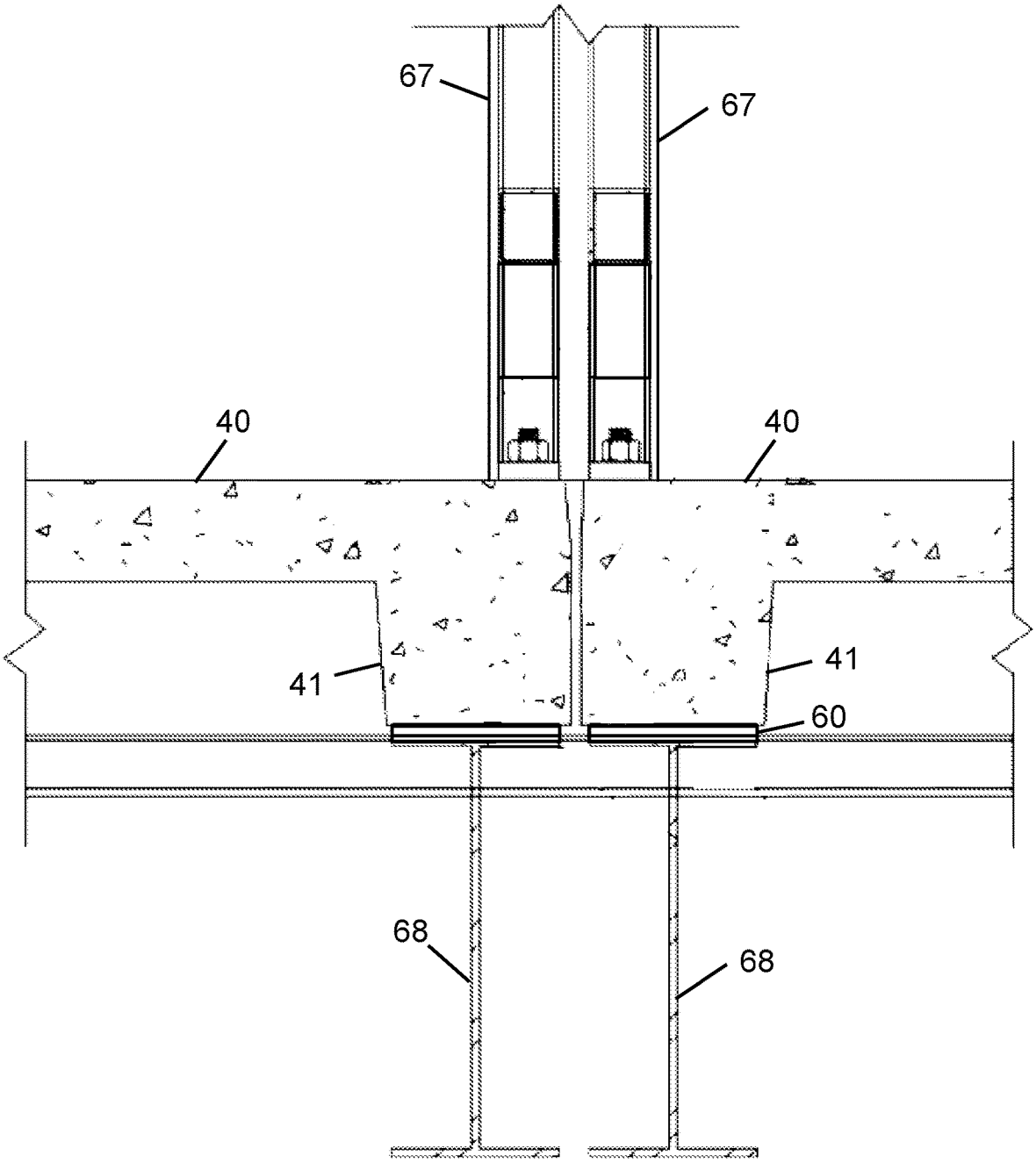
FIG. 36 shows an interior party wall connection over beams, according to an embodiment of the present invention.

FIG. 3 shows an interior party wall connection, in which the thickened edges of the floor panels 40 are positioned alongside each other. The columns 62 above the floors are alongside each other, and the columns 61 supporting the floors are alongside each other. The columns 61, 62 are embedded in the party walls 65, 66 between the adjacent modules. FIG. 4 is a view in a direction perpendicular to that seen in FIG. 3. FIG. 34 shows another view of a connection in an interior party wall. FIG. 36 shows another view of a an interior party wall 67 over adjacent floors 40, where the thickened edges 41 of the adjacent modules are supported by beams 68.

FIG. 34 is a view of interior party wall face-on. Where the in-line vertical load-bearing columns 62 of the upper module meet the floor 40, the upper module column is bolted through the thickened edge 41 of its precast slab floor. The lower module column 61 is capped with an elastomeric bearing pad 60 beneath the upper floor slab edge 41.

FIG. 36 is a view of the interior party wall connection to supporting horizontal beams 68. The modules meet each other at their thickened ends 41 with the load of the stacked building modules supported vertically through each module column 61 bolted into its concrete floor slab 40. The load continues downward through the concrete ends onto underlying supports 68.

Figure 37:
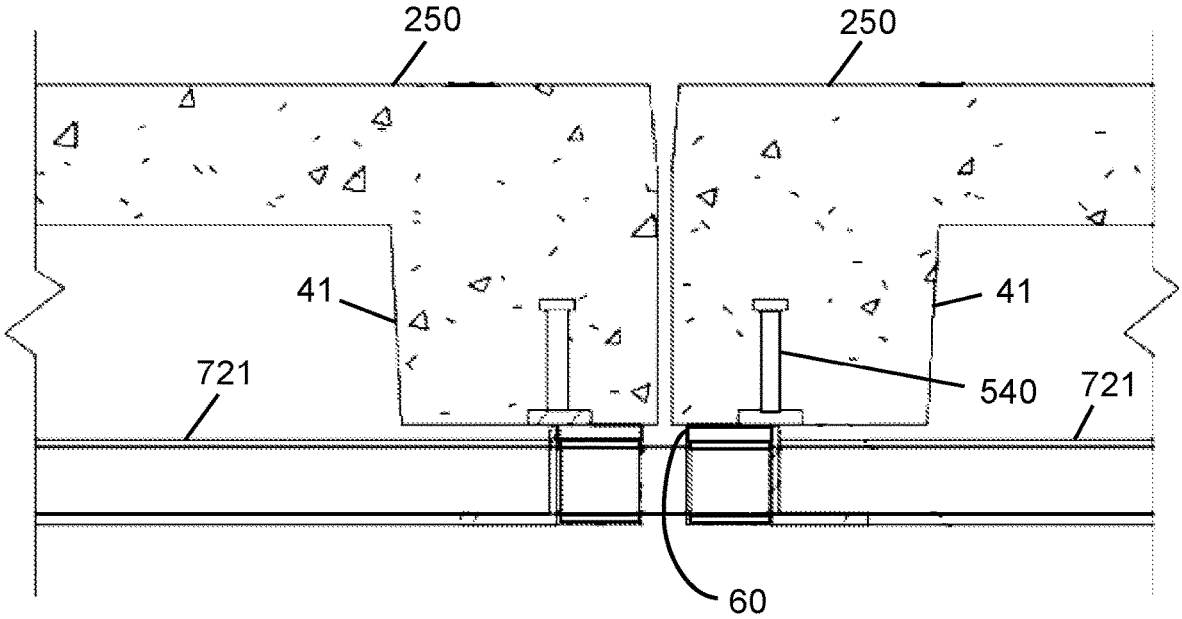
FIG. 37 shows an interior party wall connection viewed parallel, according to an embodiment of the present invention.

FIG. 37 shows where two modules 250 meet at the precast module floor slab edges 41. The edges 41 rest on elastomeric bearing pads 60 found typically over horizontal supporting beams 721 beneath. The horizontal supporting beams 721 are reinforced at the module meeting point by embeds at 48" spacing, which are ⅝" diameter shear studs 540 cast in the concrete, and a 5" depth.

G. Module Connection

Modules are connected to each other as shown in FIGS. 5, 6, 7 and 32.

FIG. 5 shows an upper module 255, with precast exterior end wall 80 and precast end region 70 of the floor 40. The upper module 255 is placed over a lower module 256 that has a precast exterior wall panel 17. The connection between the bottom of the precast end wall 80 and the top surface of the outer panel of the precast exterior wall 17 is made with a combination 20 of a rolled rod, backer rod and sealant. Embeds 30 are present in the outer layers of the exterior end wall 80 and exterior end wall 17. FIG. 5 also shows the precast floor end region 70 at the end of the module 255 inserted into a cut-out of the inner concrete layer 18 of the precast wall 80. In this view the corrugated roof 45 is more readily visible.

FIG. 6 shows one module 250 placed above another module 251. The upper module rests on elastomeric bearing pads 60 on the lower module. The modules are aligned vertically, not staggered, so the supportive steel frames of the modules line up vertically.

Figure 7:
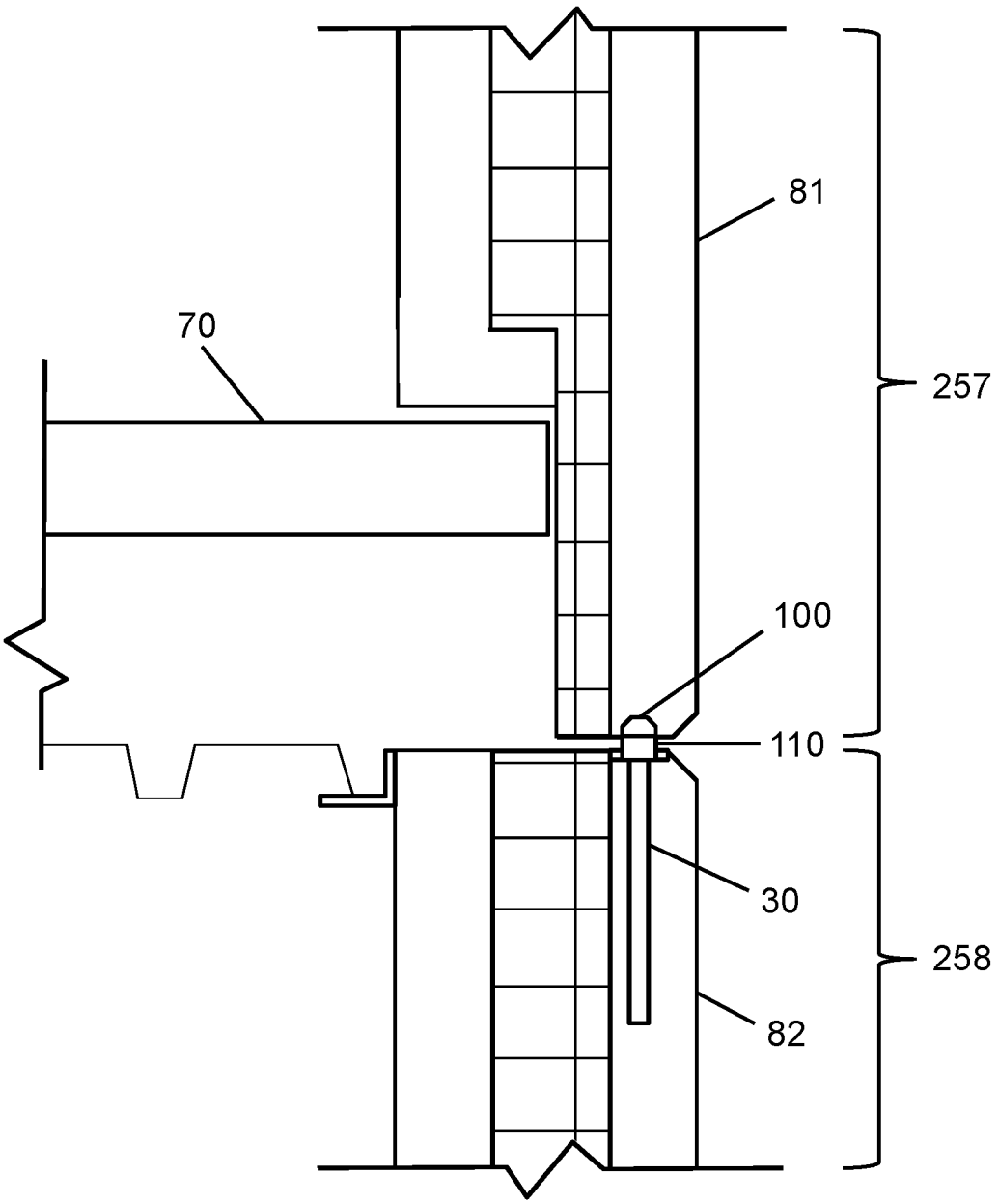
FIG. 7 shows a module to module alignment pin, according to an embodiment of the present invention.

FIG. 7 shows an upper module 257, with precast end floor 70 and precast end wall 81, located over a lower module 258 that has a precast end wall 82 and embed 30. There is a pin void 100 cast into the lower surface of the outer portion of the precast end wall 81 of the upper module 257. A cold rolled steel alignment pin 110 is present in the top surface of the outer portion of the precast end wall 82 of the lower module 258. The pin void 100 receives the alignment pin 110. In other embodiments, other locating techniques may be used. For example, the void may be in the top surface of the lower end wall, and a pin may project down from the bottom surface of the upper end wall.

Figure 32:
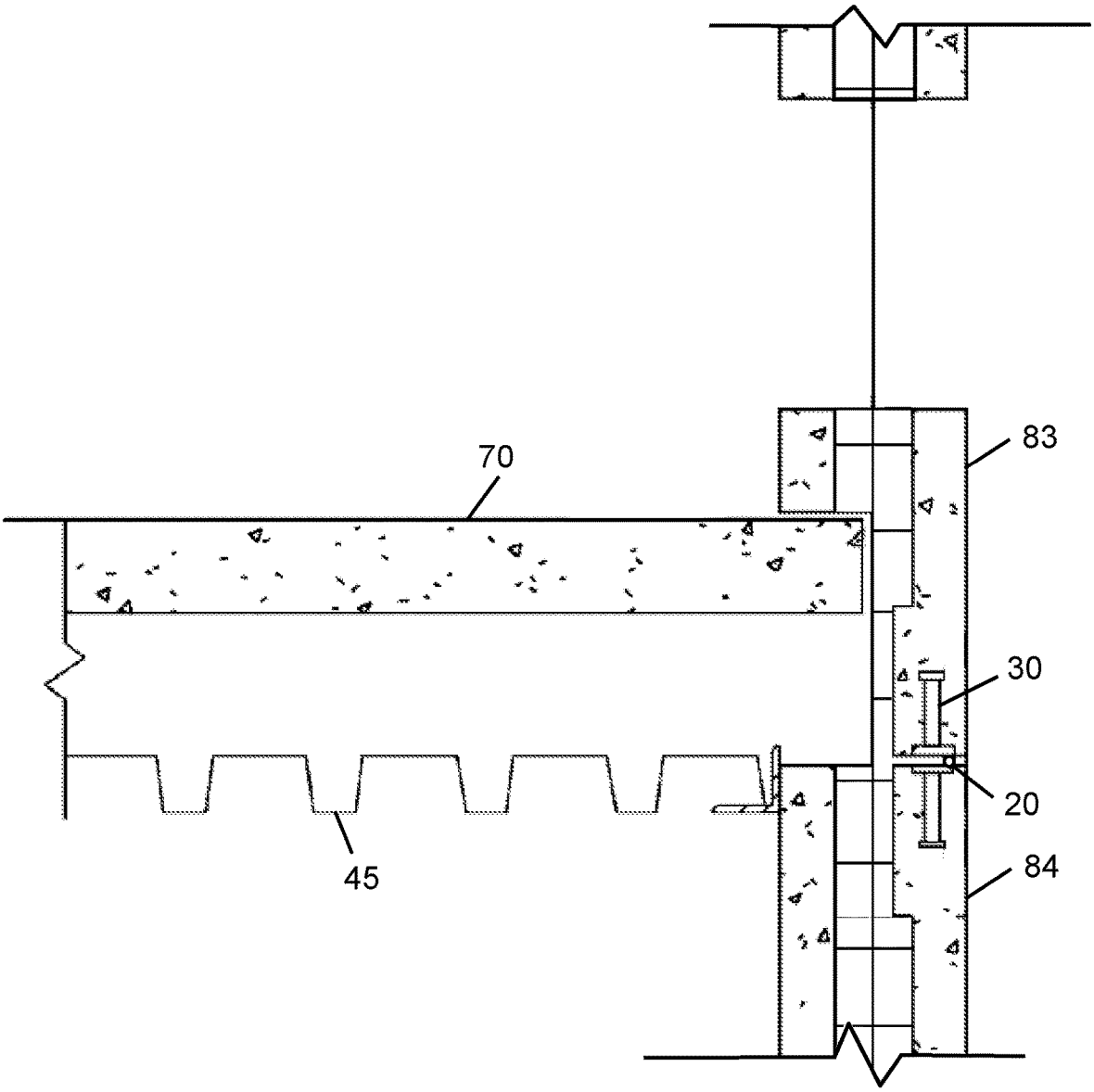
FIG. 32 shows a module to module connection, according to an embodiment of the present invention.

FIG. 32 shows an upper module, with precast end floor 70 and precast end wall 83, located over a lower module that has a precast end wall 84. Both precast end walls 83, 84 have embeds 30. The connection between the bottom of the outer portion of the precast end wall 83 and the top surface of the outer portion of the precast end wall 84 is made with a combination 20 of a rolled rod, backer rod and sealant. Attached to the lower end wall is a metal angle which supports the lower module ceiling 45.

H. Panel Connections

Figure 8:
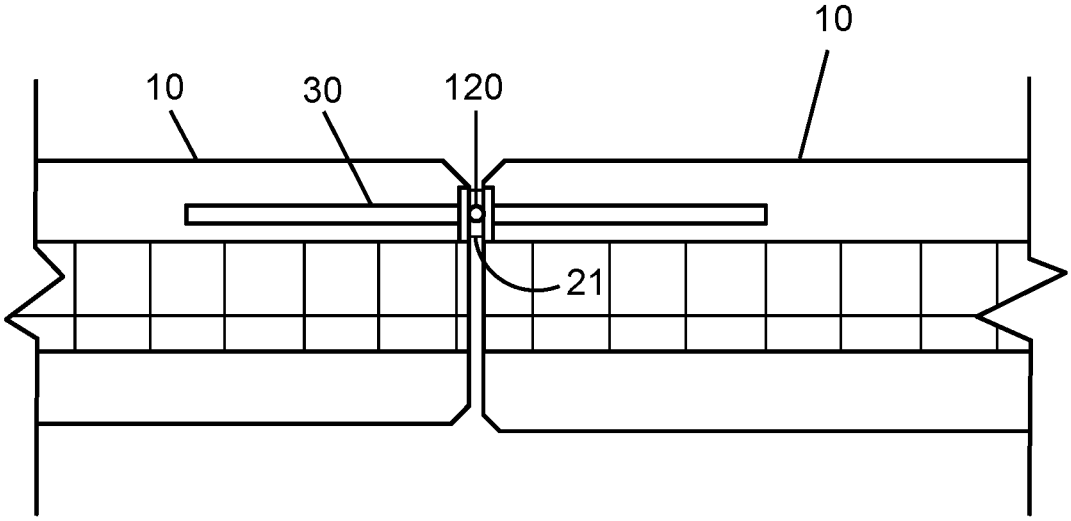
FIG. 8 shows a typical panel to panel connection, according to an embodiment of the present invention.

The panel connections are shown in FIG. 8. These connections are similar to the ones shown in FIG. 1. Two exterior precast wall panels 10 are shown side by side. They are connected with a rolled rod 21 to fit the gap. A foam backer rod and sealant to suit 120 are also placed in the gap. Reinforcing embeds 30 are included in the outer layers of the wall panels.

I. Floor Connections

Floor connections are shown in FIGS. 9, 10, 11, 14, 35, 44 and 45.

Figure 9:
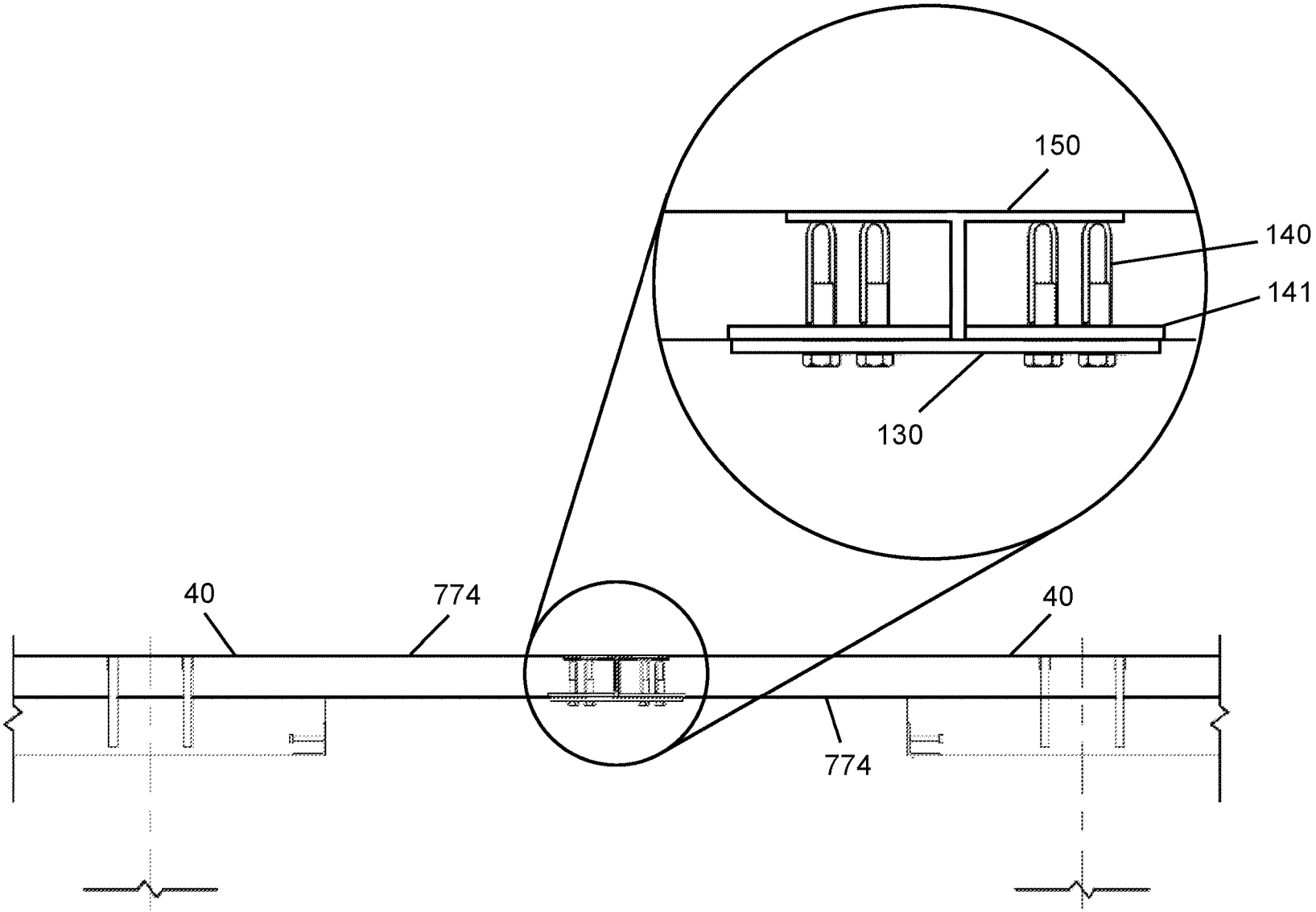
FIG. 9 shows a typical corridor floor connection, according to an embodiment of the present invention.
Figure 50:
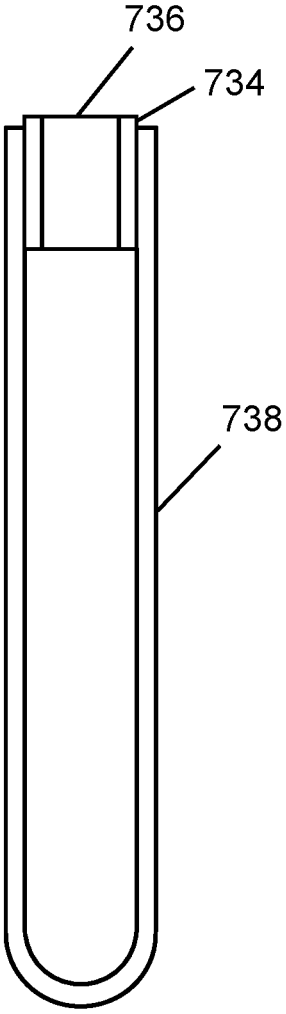
Figure 51:
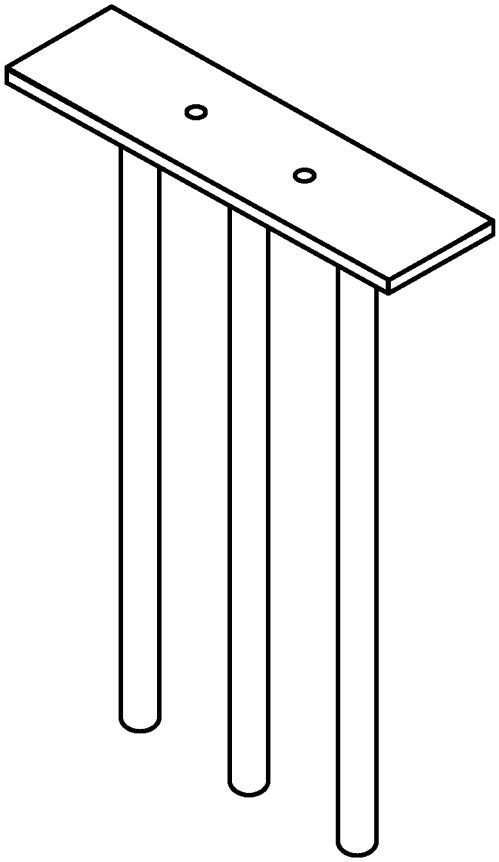
Figure 52:
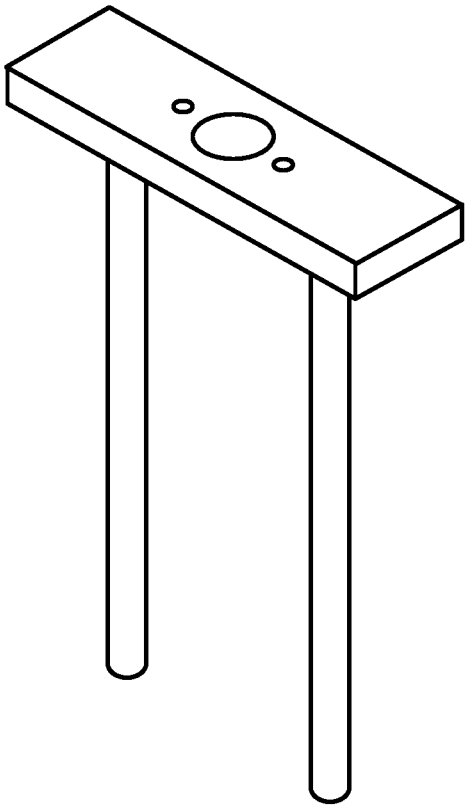

FIG. 9 shows a corridor floor connection. A steel plate 130 connects two adjacent, extension portions 774 of the floors 40 of the modules to either side of the corridor. The extension portions 774 form the corridor floor. Each portion of the corridor floor has plates 140 cast in place, to which the steel plate 130 is connected using bolts. In a typical concrete slab corridor connection, 3½" long A325 bolts from an attached 16"×16"×½" steel plate 130 bolt into the bolt voids of embedded components 140 cast into the slab floor. The embedded components 140 may similar to those in FIG. 50, where the end 734 is welded to plate 141. Opening 736 is exposed for the insertion of a bolt. Loop 738 extends into the thickness of the floor to hold the embed in place. Grout 150 fills the gap between the floor extensions 774 and helps to smooth out any step that may be present due to the different heights of the upper surfaces of the floor extensions.

Figure 10:
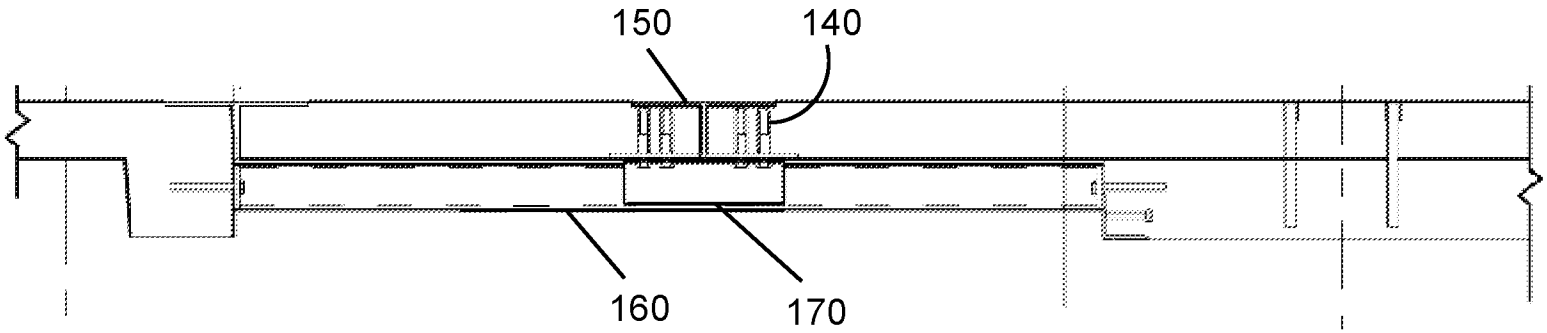
FIG. 10 shows a corridor floor connection at lobby, according to an embodiment of the present invention.

FIG. 10 shows a corridor floor connection at the lobby. A steel angle plate 170 connects two adjacent portions of the corridor floor. Each portion of the corridor floor has plates cast in place, as in FIG. 9, to which the steel angle plate 170 is connected. Grout 150 fills the gap and levels the floor. Beam 160 connects the floor panels of the two modules that are on opposing sides of the corridor floor connection. At the lobby, for example, the corridor floor connection is supported with an underlying HSS beam 160 spanning the length between modules and bolted into the concrete floor slabs on either side. A 6" length×4"×5/16"×14" long steel angle plate 170 complete with ⅝" diameter×3½" long A325 bolts which align with the outermost holes of the embedded components 140 attaches to the HSS beam. Grout 150 fills the 3/16"×6" recess typical at all accessible floor joint locations.

Figure 11:
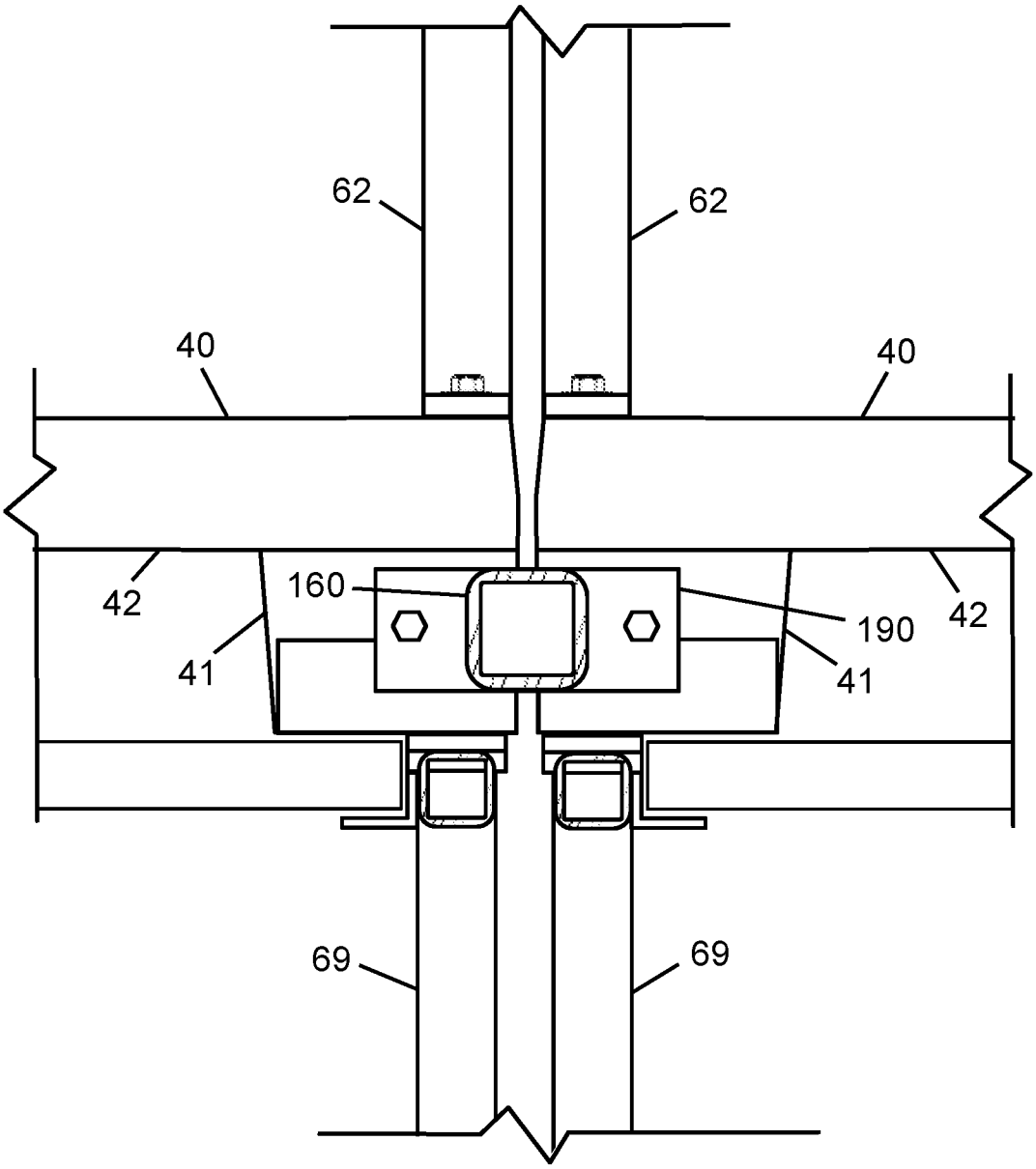
FIG. 11 shows a typical corridor HSS end plate, according to an embodiment of the present invention.

FIG. 11 shows a typical corridor HSS end plate. The floors 40 of two adjacent modules are connected with plate 190 at the ends of the thickened edges 41 of the floor, below the upper, thinner portion 42 of the floor. An HSS beam 160 is welded to and projects outwards from the plate 190. Columns 62 of the modules are shown connected to the floors 40 of the modules. Under a typical corridor floor, the HSS beam terminates with a 12"×4"×½" steel plate 190 complete with ⅝" diameter bolts that are bolted into the concrete floor. The module columns 62, 69 in the figure are located beyond the corridor, belonging to the modules from which the corridor floor portions extend.

Figure 14:
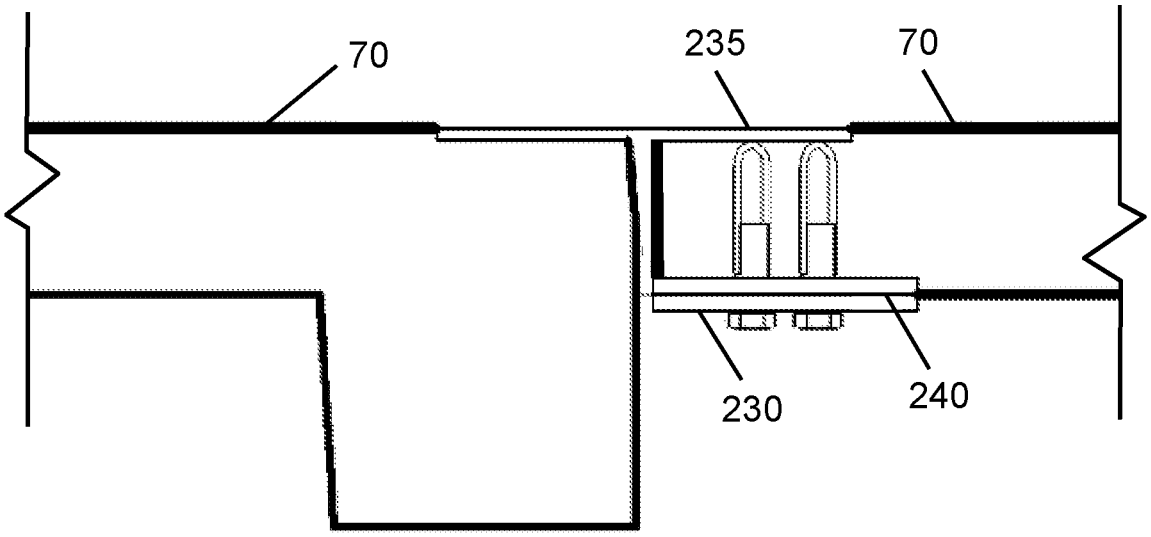
FIG. 14 shows a slab transition, according to an embodiment of the present invention.

FIG. 14 shows a slab transition with a T-section plate 235 between the end floors 70 of two adjacent modules. A steel plate 230 is connected with bolts to module-to-module embed plate 240 cast into the floor. Where the slabs transition one to another an 8"×16"×½" steel plate 230 complete with ⅝" diameter×3½" length A325 bolts is connected to the slab end into module to module embed plates 240 with bolt voids cast into the module floors for connection across the corridor modules.

Figure 35:
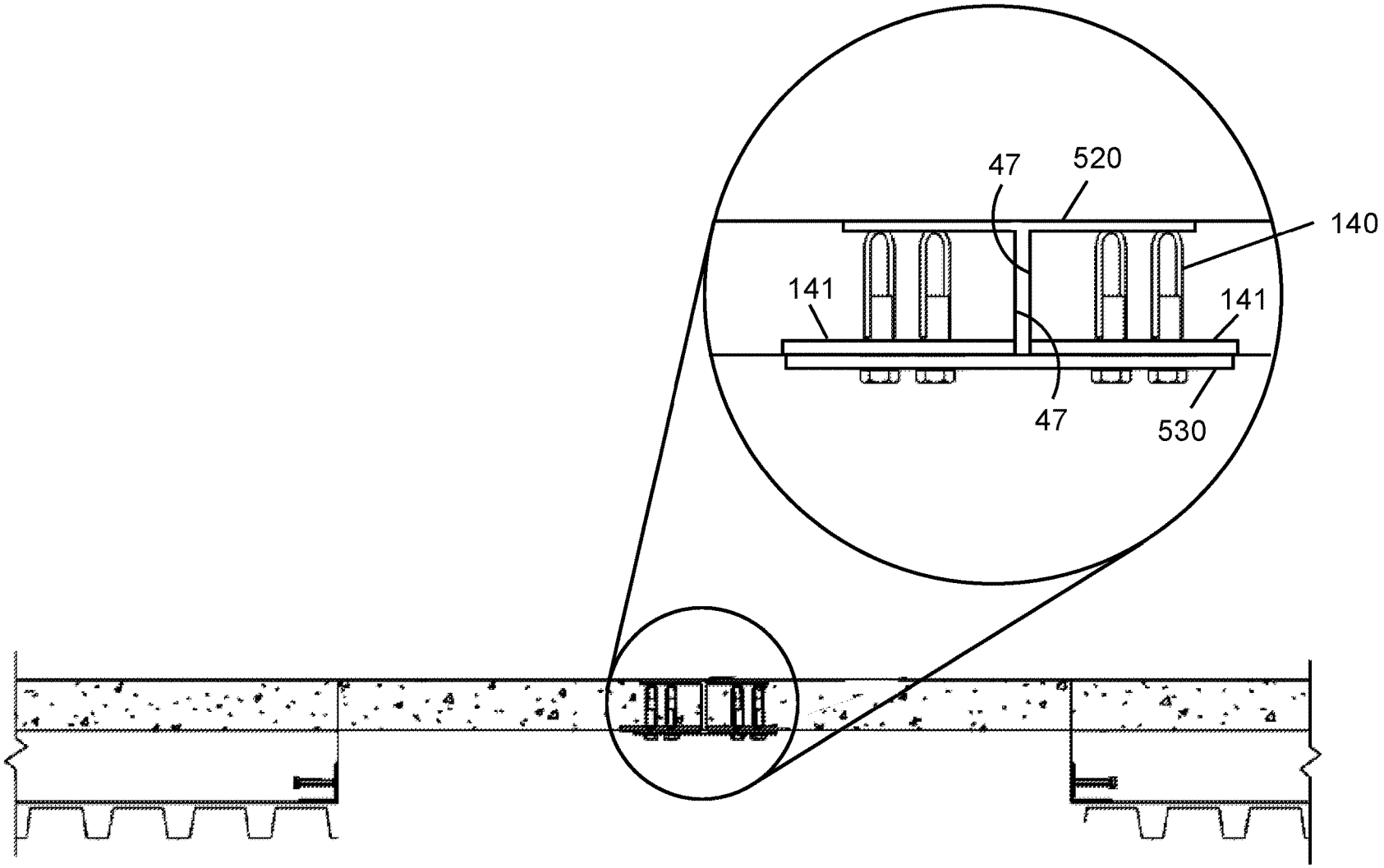
FIG. 35 shows a typical corridor connection, according to an embodiment of the present invention.

FIG. 35 shows another typical corridor connection. A steel plate 530 is connected with bolts to embeds 140 in the adjacent floors either side of the connection. Grout 520 fills the recesses on each side of the join and the gap between the join. The two floor slabs are joined at their unthickened, extended ends 47 with embedded plates 141 and connector plate 530. The embedded components have shafts which accept ¾" diameter bolts that pass through an attached 16"×16"×½" steel plate 530.

Figure 44:
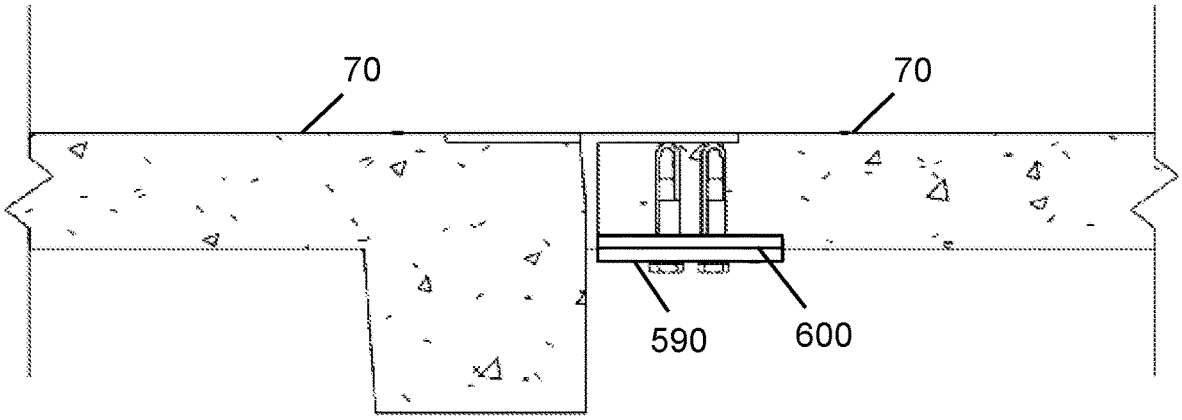
FIG. 44 shows a slab transition, according to an embodiment of the present invention.

FIG. 44 shows a slab transition between the end floors 70 of two adjacent modules. A steel plate 590 is connected with bolts to module-to-module embed plate 600 cast into the floor. FIG. 44 details the transition between two precast module floor slab ends 70, one thickened at its edge and the other unthickened at its edge. Module to module embedded plates are cast into both, connecting across the corridor module floors 600 from atop and between both slabs, and beneath only the unthickened slab where embedded bolt shafts in the embedded component receive ⅝" diameter× 3½" length A325 bolts attached to an 8"×16"×½" steel plate 590.

Figure 45:
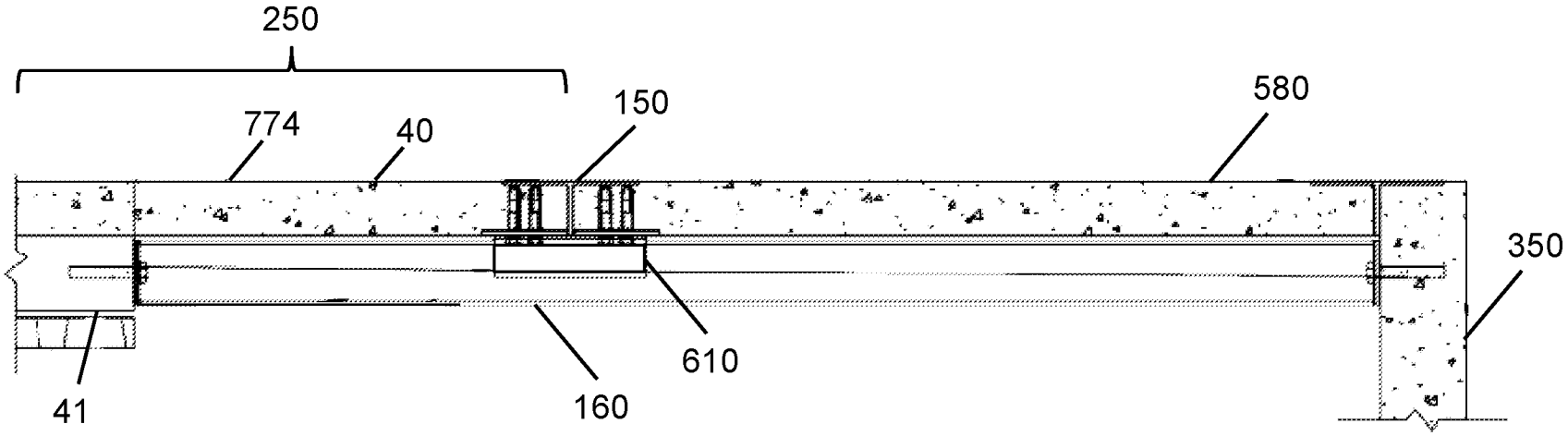
FIG. 45 shows a floor steel corridor span, according to an embodiment of the present invention.

FIG. 45 shows a steel span beneath a corridor floor. HSS beam 160 extends underneath the floor slab 580. The beam 160 is connected to a precast header panel 350 to the right of the floor slab 580. The two adjacent portions of the corridor floor are connected with a steel angle plate 610. The recesses typical at the floor joint location are filled with grout 150. FIG. 45 displays a corridor connection of a floor slab 580 and an extension 774 of a floor 40 of a module 250, both of which are supported by a horizontal HSS beam 160 along the entire width of the corridor. At each end, the HSS beam 160 is bolted into concrete slabs, on one end being the precast header panel 350, and on the other end being the thickened edge 41 of the floor 40 of the module 250. The corridor slabs join by a 6" length×4"×5/16"×14" long steel angle plate complete with two ⅝" diameter×3½" long A325 bolts passing through angle plate holes. The accessible floor joint ⅜"×6" recesses are filled with grout 150.

J. HSS Connections

Figure 12:
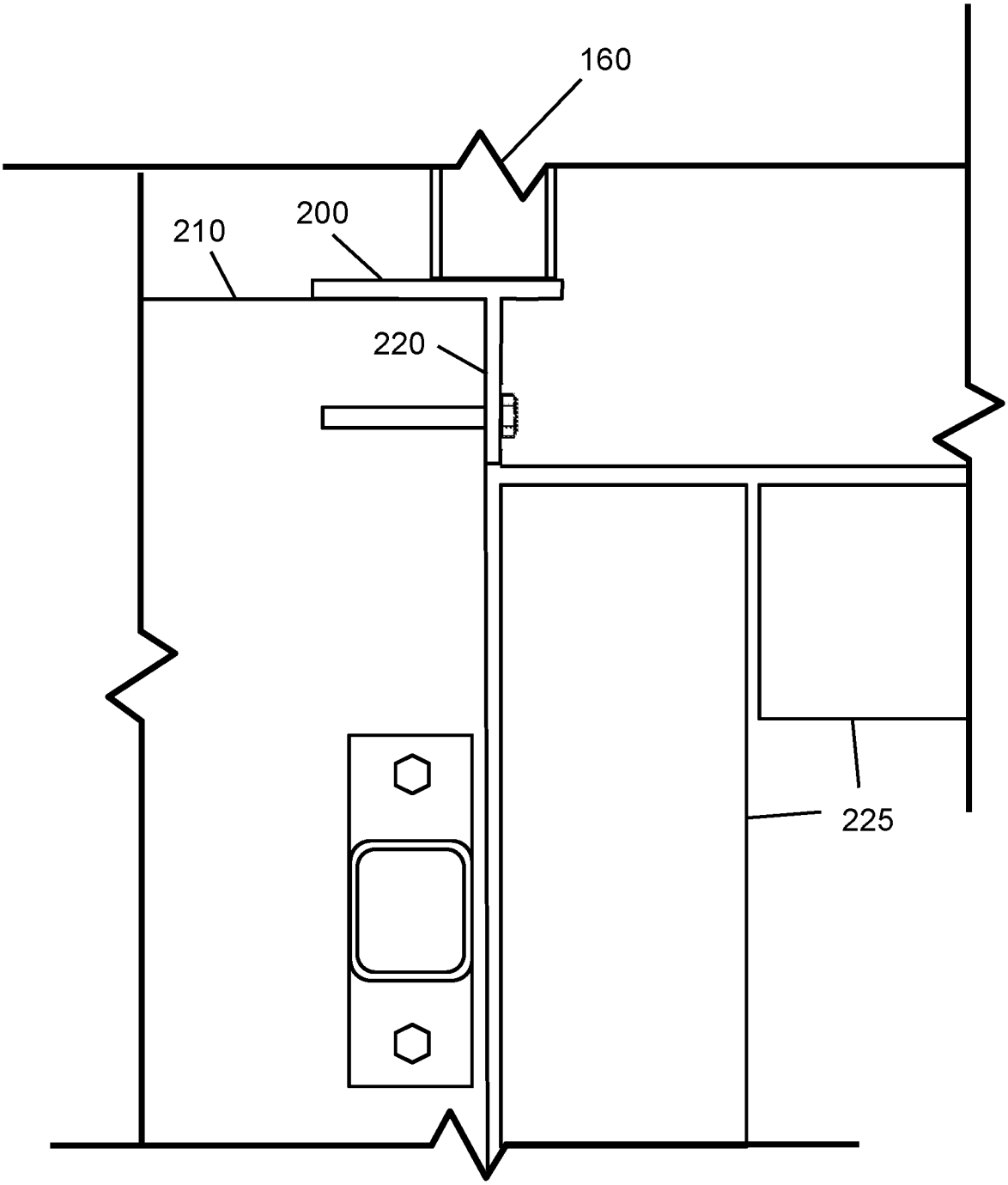
FIG. 12 shows a plan view of an alternate HSS end plate at a corner, according to an embodiment of the present invention.
Figure 13:
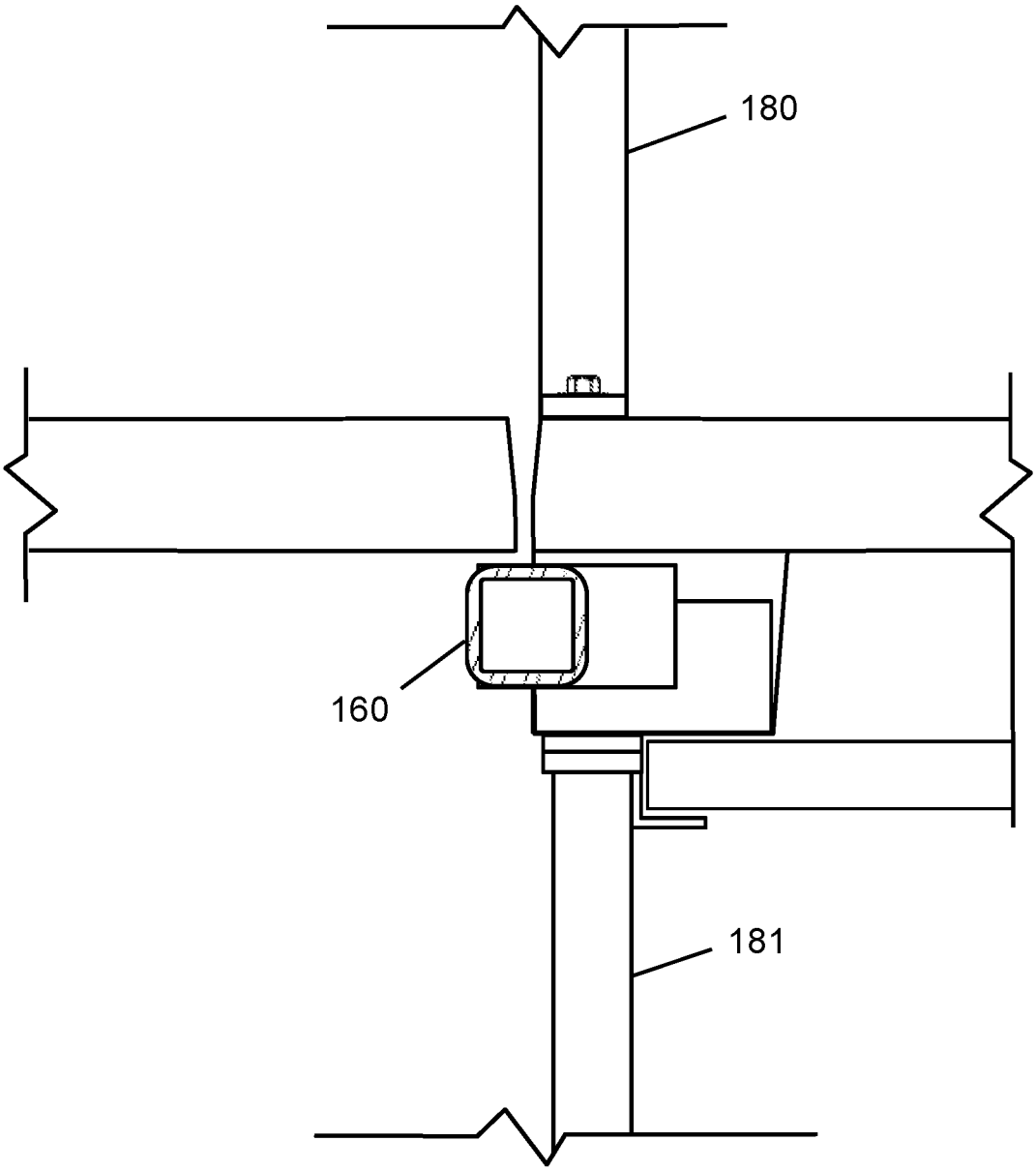
FIG. 13 shows the elevation of the alternate HSS end plate at the corner, according to an embodiment of the present invention.
Figure 41:
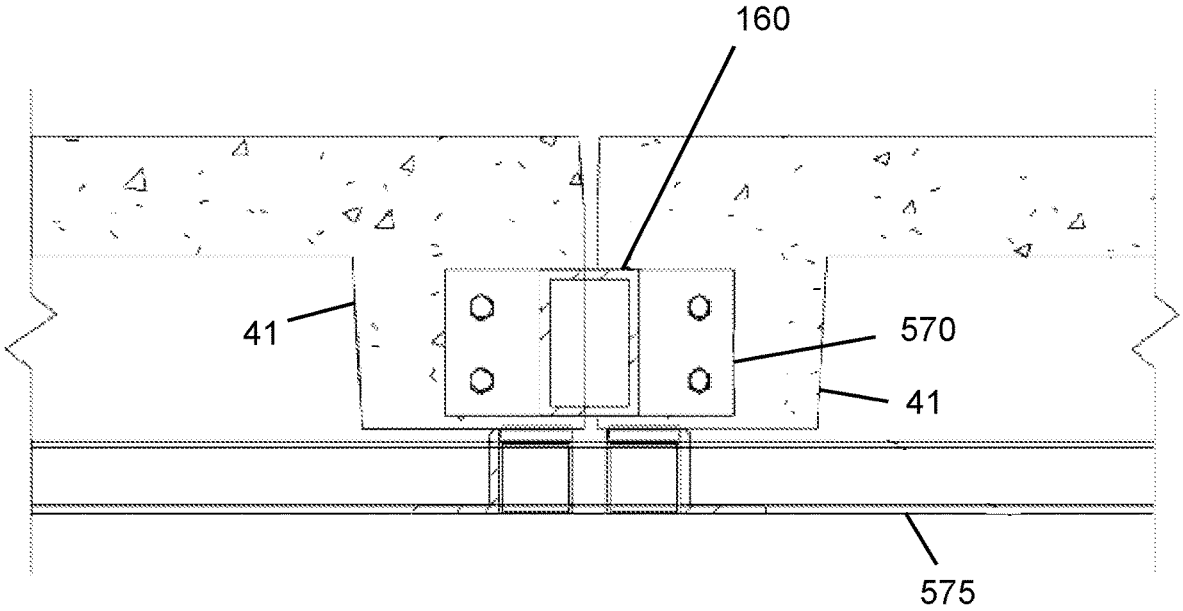
FIG. 41 shows a typical corridor HSS plate, according to an embodiment of the present invention.

HSS connections are shown in FIGS. 12, 13 and 41.

FIG. 12 shows an HSS at a corner, in plan. Steel plate 200 is connected to the end of the floor beam 210. Steel plate 220 is connected to steel plate 200. In this alternate HSS end plate corner plan the HSS beam 160 ends at the corner in an 8"×4"×½" steel end plate 200 attached to the beam at the end of the floor 210. Insulation blocks 225 are shown on the inside of the corner. In line with the HSS beam 160 another 5½"×4"×½" steel plate 220 complete with a ⅝" diameter HILTI HUS™ anchor is fixed to the concrete slab.

FIG. 13 shows the alternate HSS corner end plate assembly of FIG. 12, from the side. The HSS beam 160 is centred under the gap between the concrete floor slabs on either side and its steel end plates are in line with the module columns 180, 181 beyond, belonging to the right-hand modules.

FIG. 41 shows a typical corridor HSS connected to a plate. The steel plate 570, from which HSS beam 160 extends, connects the floors of two adjacent modules. The adjacent thickened edges 41 of the connected floors are supported by a beam 575 and elastomeric bearing pads. The thickened ends 41 of two concrete floor slabs are joined by a 12"×6"×½" steel plate 570 complete with ⅝" diameter HUS™ bolts. The module slabs are supported by horizontal beams running along both planar axes under the floor.

K. Elevator Core Connections

Elevator core connections are shown in FIGS. 15, 16, 17, 24, 26, 27, 31, 39, 40, 42 and 43.

Figure 15:
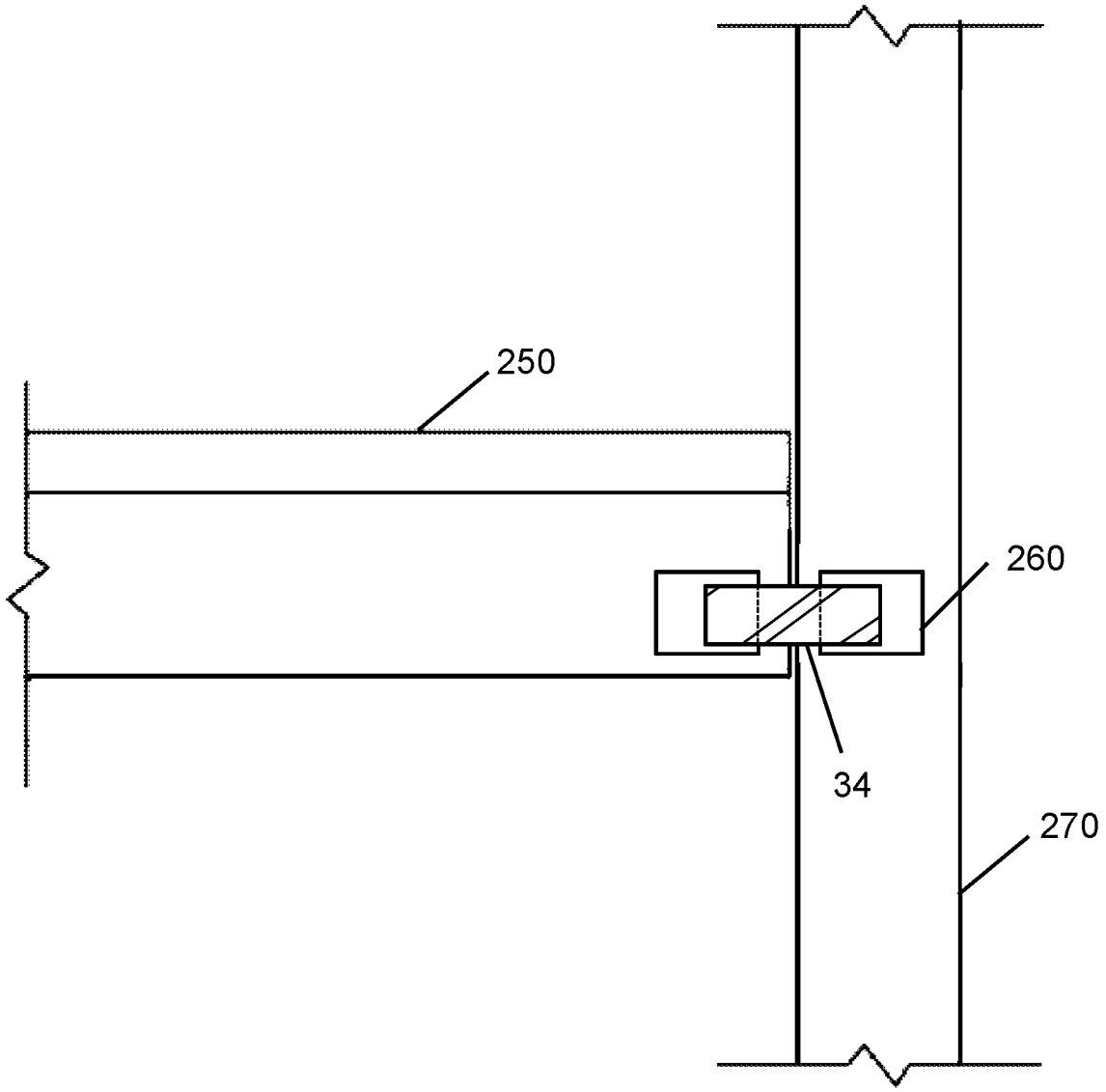
FIG. 15 shows a module beam at an elevator corner, according to an embodiment of the present invention.

FIG. 15 shows a module beam at an elevator corner. The floor of a module 250 is connected to an elevator shaft wall 270 with a steel plate 260 that is connected to embeds 34 in the floor and the shaft wall.

Figure 16:
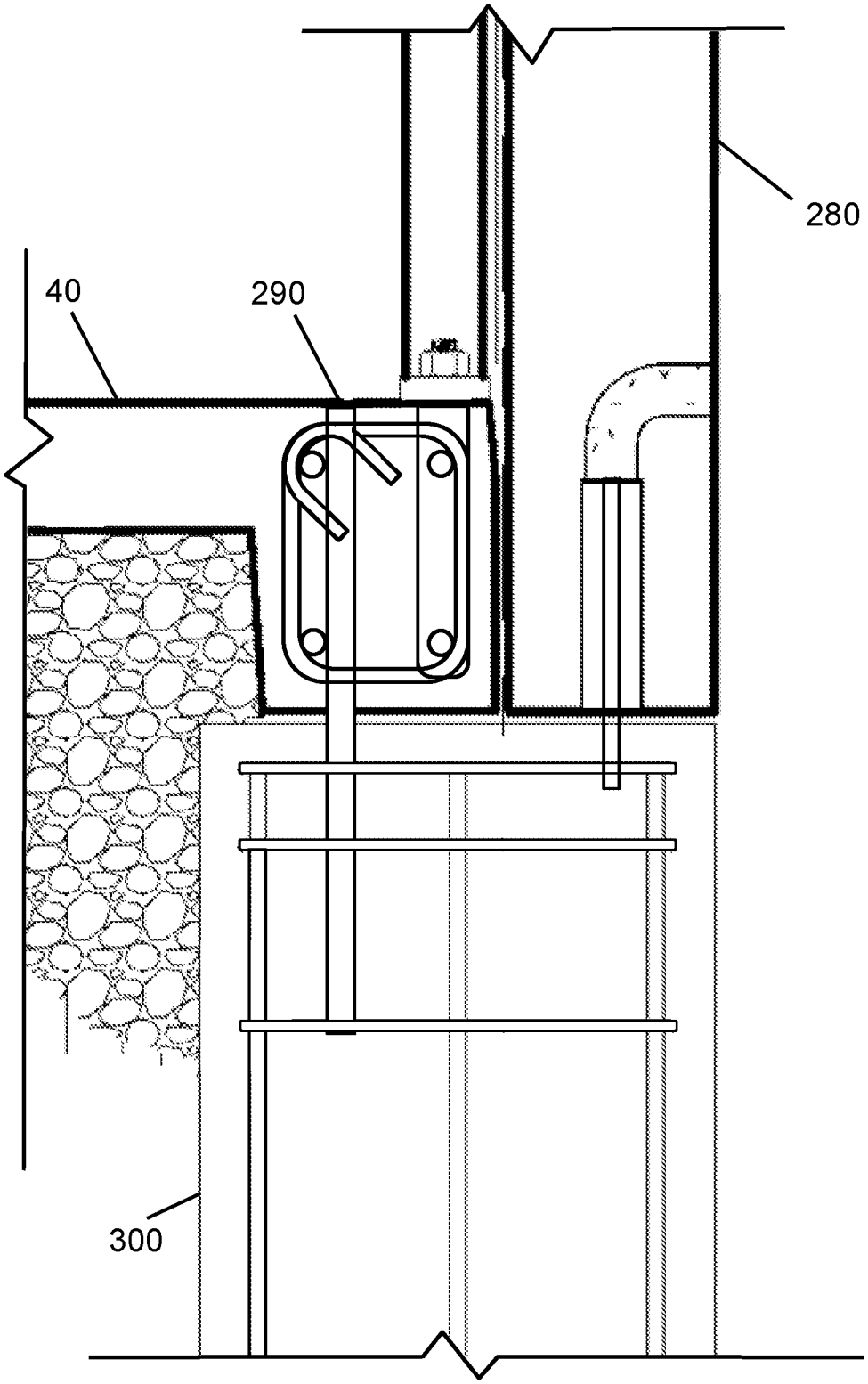
FIG. 16 shows a column beside an elevator shaft, according to an embodiment of the present invention.

FIG. 16 is a view of a column beside an elevator shaft. A concrete cast-in-place pilaster 300 supports the precast floor panel 40 of a module and a precast elevator wall 280. A sleeve 290 passes through the precast floor beam, complete with a steel rod and adhesive.

Figure 17:
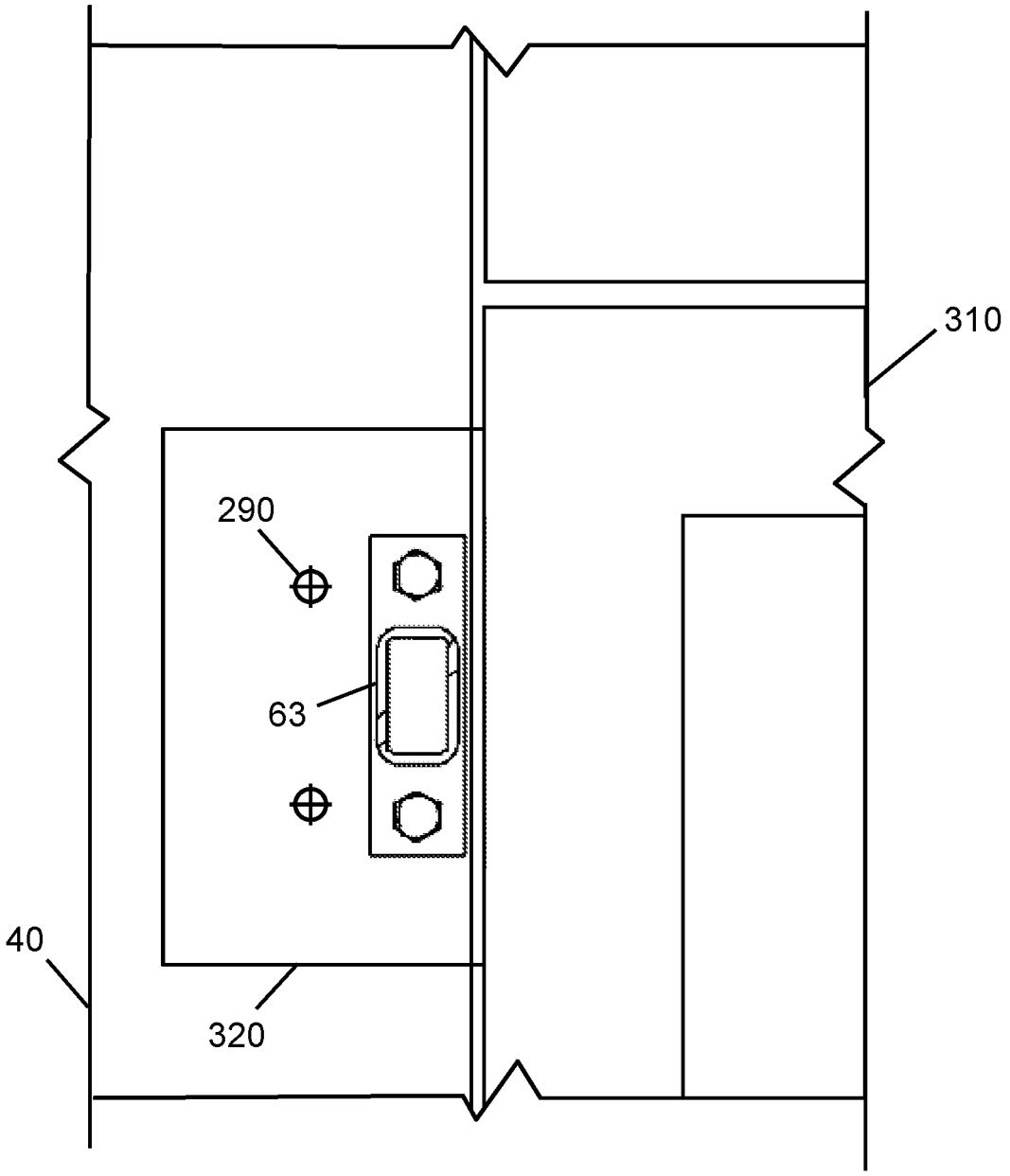
FIG. 17 shows a second view of the column beside the elevator shaft, according to an embodiment of the present invention.

FIG. 17 is a plan view of the column 63 beside the elevator shaft. The outline 320 of the pilaster 300 below the precast floor panel 40 is shown. Two sleeves 290 pass through the precast floor panel, complete with a steel rod and adhesive. The cast-in-place elevator foundation wall 310 is also shown. The pilaster column 300 has 1⅛" ID sleeves 290 which penetrate through the precast floor beam of the floor panel with a 1" diameter steel rod and adhesive. The elevator foundation wall 310 is cast in place.

Figure 24:
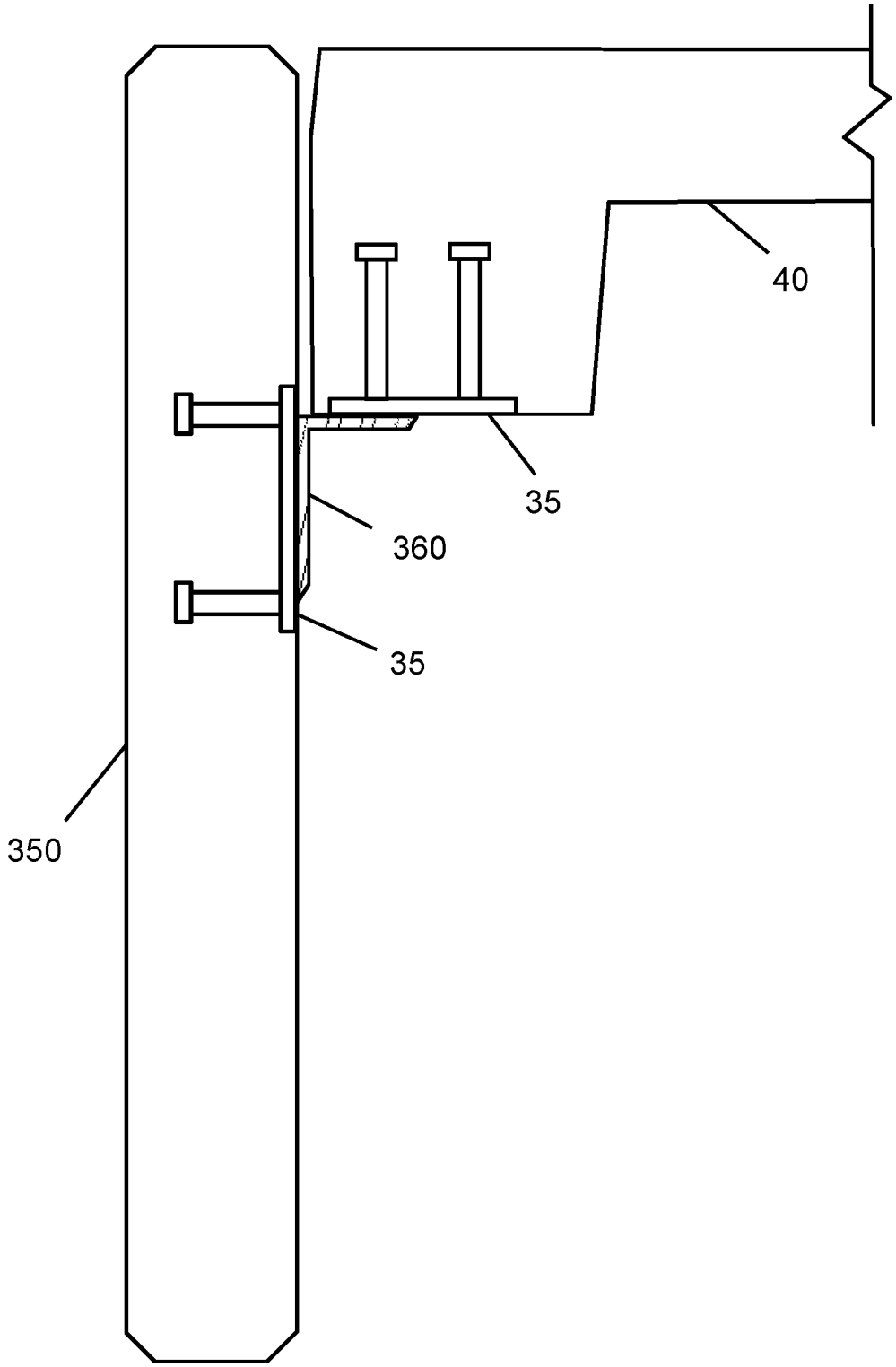
FIG. 24 shows an elevator header panel at a lobby, according to an embodiment of the present invention.

FIG. 24 shows the precast elevator header panel 350 at the lobby. The elevator panel 350 is connected to the precast floor panel 40 of a module using a continuous steel angle plate 360. The continuous steel angle plate 360 is connected to embeds 35 in the header panel and the floor panel of module. Where the elevator meets each floor the module attaches to the precast elevator lobby header panel 350 via a 6" length×4"×⅜" continuous steel angle 360 bolted into the precast slabs with steel bolts.

Figure 26:
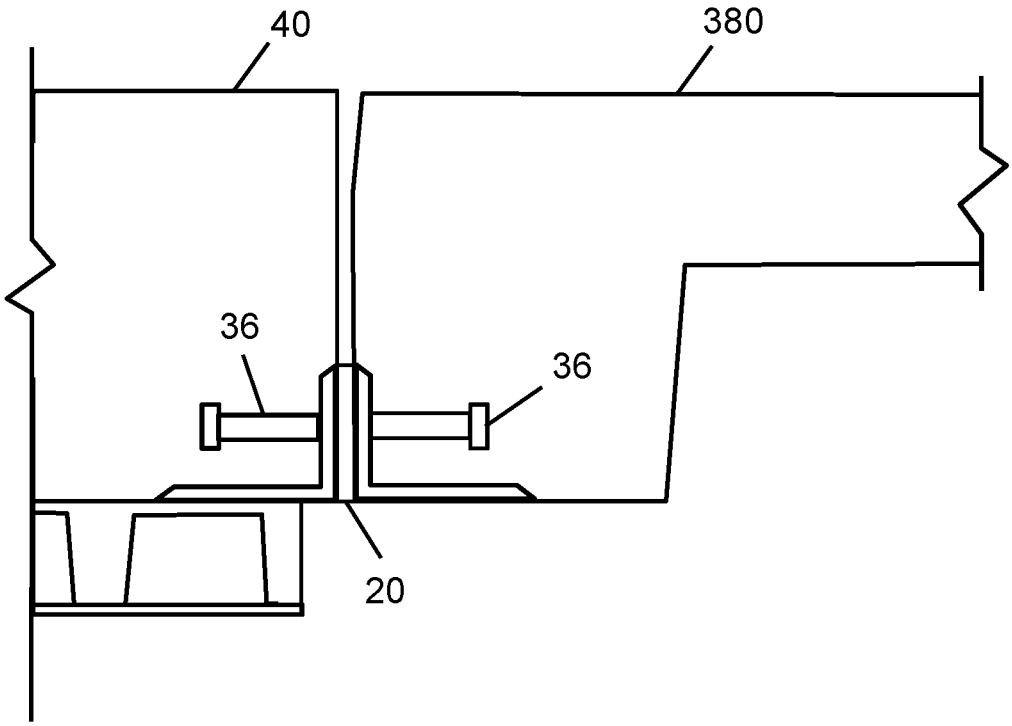
FIG. 26 shows a concrete module beam at an elevator lobby, according to an embodiment of the present invention.

FIG. 26 is a module beam at the elevator lobby. The precast floor panel 40 is shown adjacent to a precast elevator lobby floor 380, the two being connected with a rolled rod 20 to fit the gap, complete with foam backer rod and sealant. Embeds 36 are shown in the precast floor panel 40 and the elevator lobby floor 380.

Figure 27:
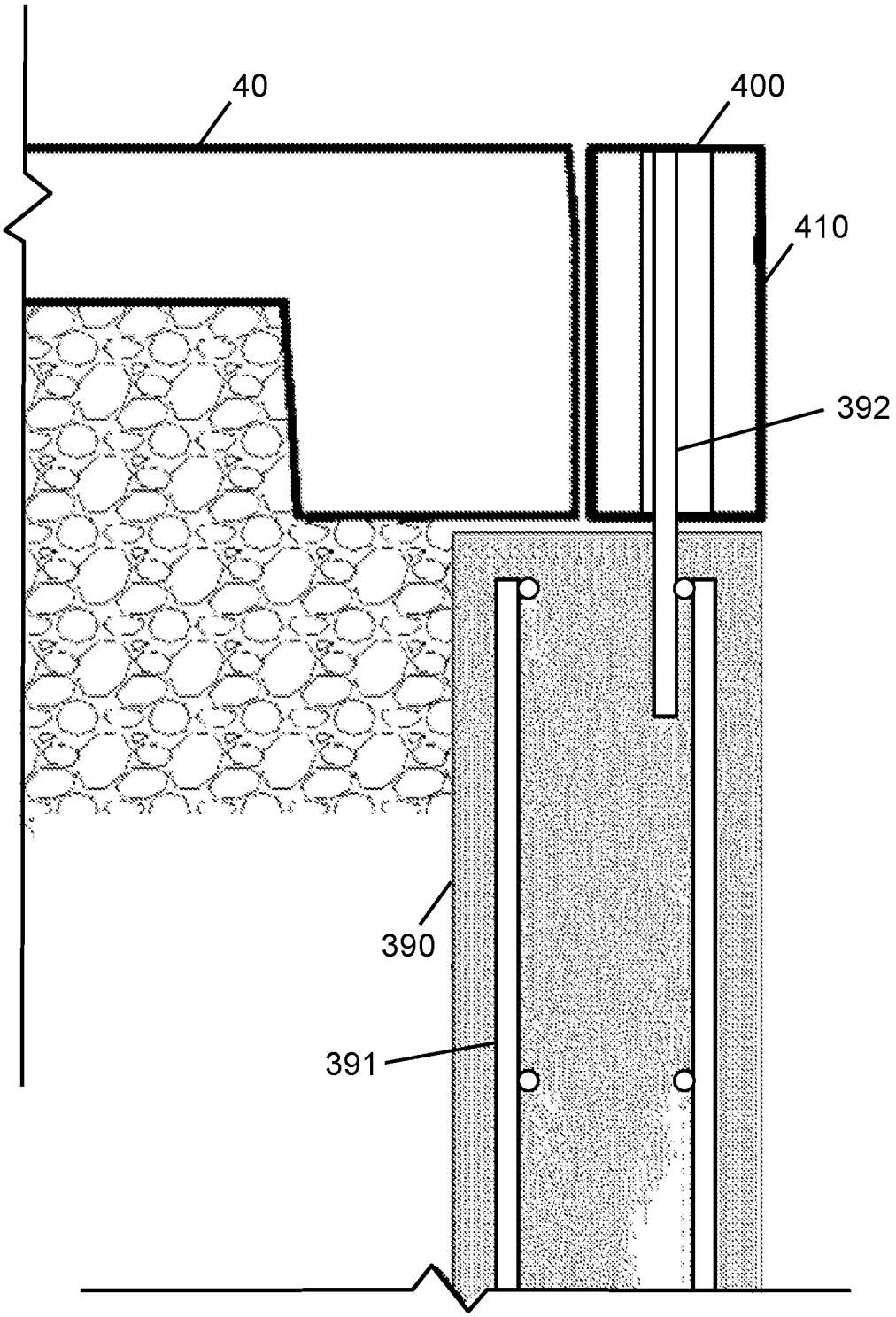
FIG. 27 shows an infill panel at elevator doors, according to an embodiment of the present invention.

FIG. 27 shows infill panels at elevator doors. A precast concrete floor panel 40 and an infill precast concrete wall 410 are shown above a cast-in-place concrete wall 390. Dowels 392 pass through the infill wall 410 and into the cast-in-place wall 390, which is strengthened by rebar 391. Grout 400 is added around the dowels. The space beneath the precast floor slab 400 around the elevator wall 390 contains a type of fill.

Figure 31:
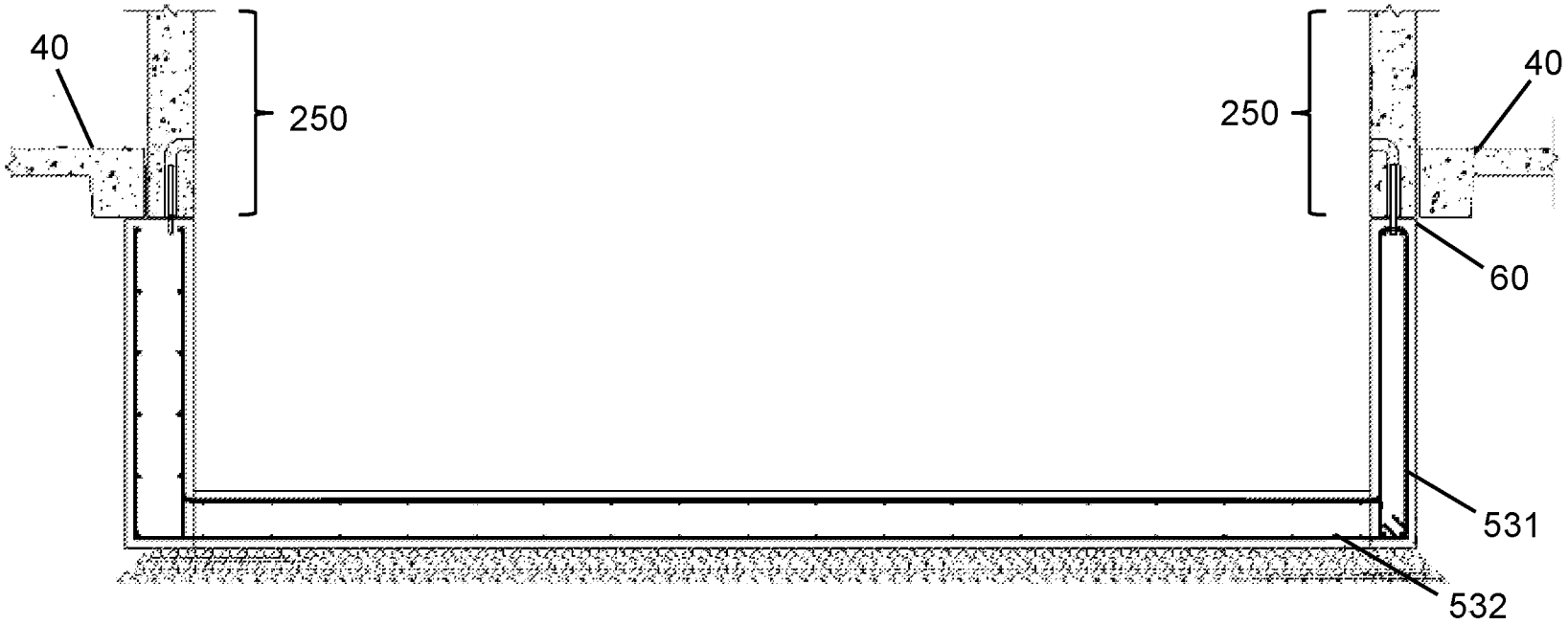
FIG. 31 shows an elevator pit, according to an embodiment of the present invention.

FIG. 31 shows an elevator pit between two modules 250. The floors 40 of the modules 250 are supported on the walls of the elevator pit. These walls are supported on elastomeric bearing pads 60 that are on the top of the walls of the elevator pit. The floor of the elevator pit has rebar 532. The walls of the elevator pit have rebar 531.

FIG. 39 shows a module adjacent to an elevator panel, which is a precast elevator wall 280. Metal embeds 37 in the precast elevator wall 280 are used to attach a bracket 46 for supporting the roof 45.

Figure 40:
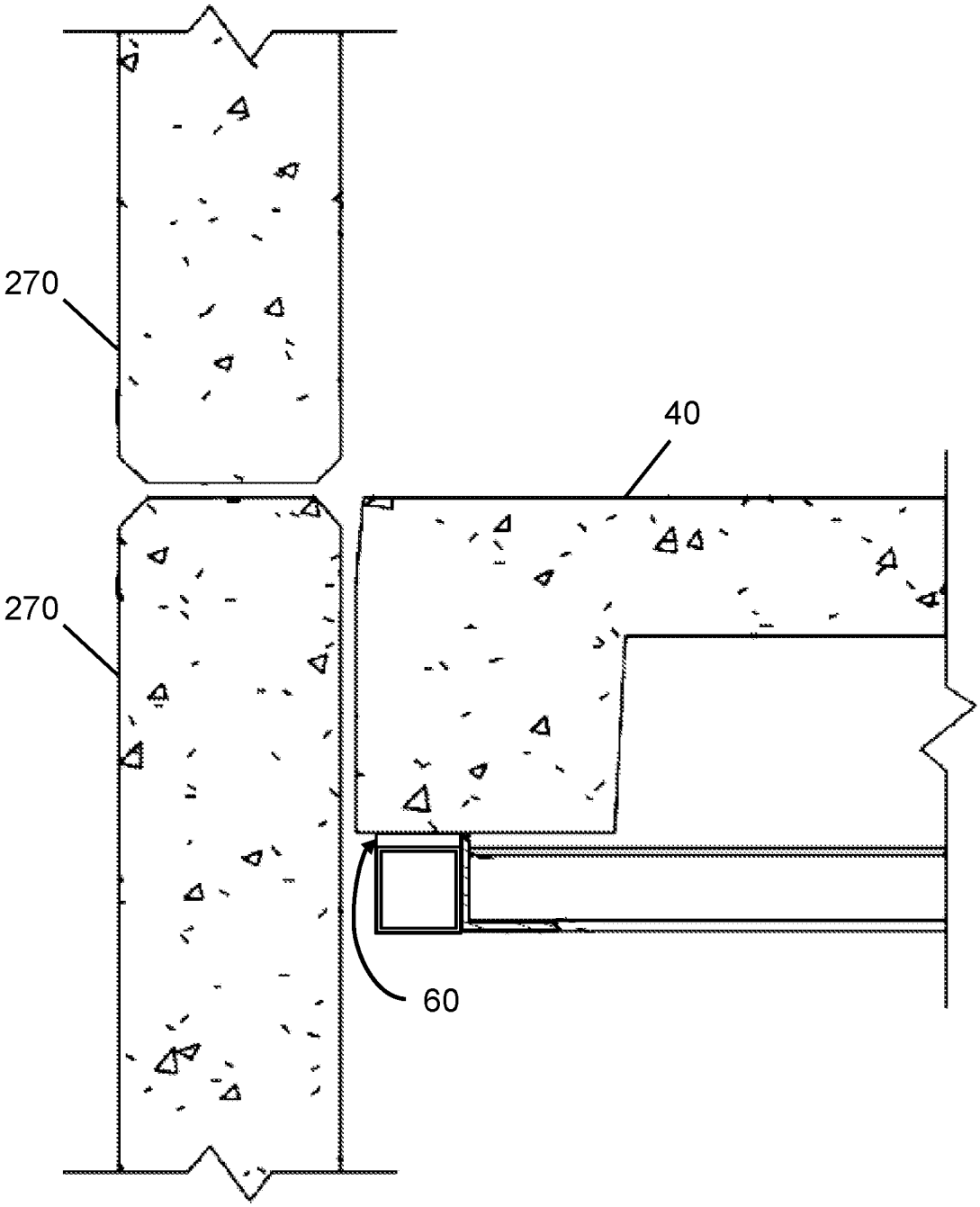
FIG. 40 shows an elevator wall at mid-span, according to an embodiment of the present invention.

FIG. 40 shows an elevator wall at mid-span. Elevator walls 270 are precast. The floor 40 of the module is supported by an elastomeric bearing pad 60. The precast wall panels 270 of the elevator core are solid concrete, unlike module exterior walls, but stacked the same from floor to floor. Where the precast module floor at its thickened end meets the elevator wall panel the floor end will sit on an elastomeric bearing pad 60 over the horizontal supporting column beneath.

Figure 42:
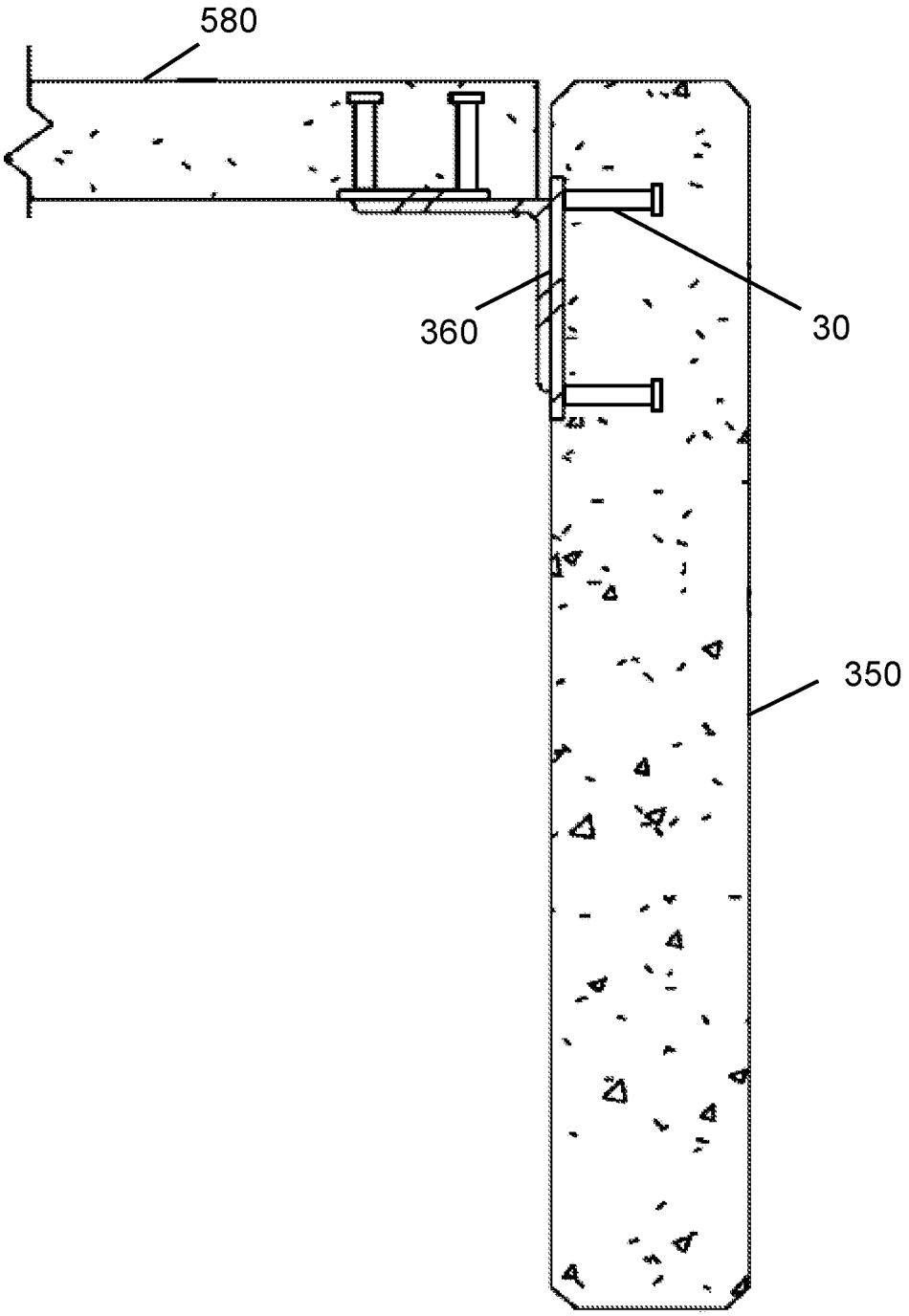
FIG. 42 shows an elevator header panel, according to an embodiment of the present invention.

FIG. 42 shows an elevator header panel. The precast header panel 350 is connected to the floor slab 580 with a continuous steel angle 360. The steel angel 360 is connected to embeds 30 in the header panel 350 and the floor slab 580. The floor and vertical header are joined with a 6" length× 4"×⅜" continuous steel right angle 360 in the inner corner connected to a plate with two metal rods embedded 30 into each of the floor and header slabs of concrete.

Figure 43:
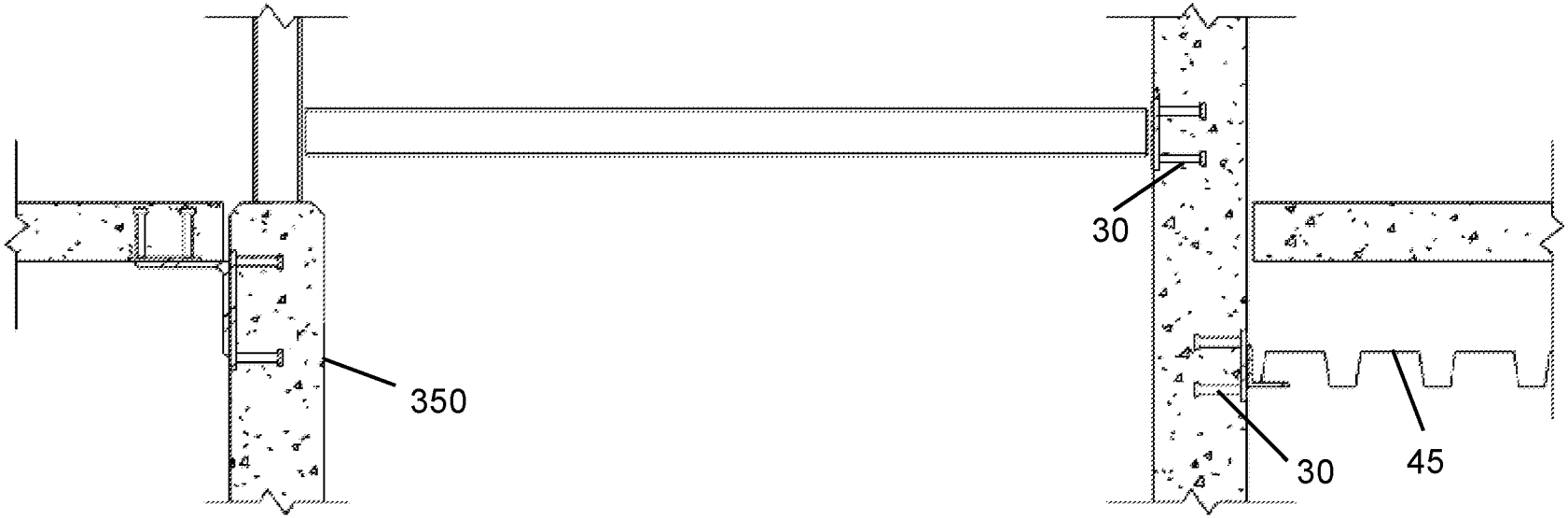
FIG. 43 shows a beam inside the elevator, according to an embodiment of the present invention.

FIG. 43 shows a beam inside the elevator shaft. The beam spans the gap between a column and an elevator shaft wall. FIG. 43 shows a wider view of FIG. 42, showing its placement with respect to the elevator core. The precast header panel 350 supports and is in line with a vertical beam on one side of the elevator core while a horizontal beam spans the entire core to the far core wall and attaches to the far wall with an embedded metal plate and two rods 30 into the concrete slab. The far elevator wall supports a module ceiling 45 with another embedded metal plate 30 with two rods.

L. Column Connections

Columns connections are shown in FIGS. 18, 19, 21, 25, 29 and 30

Figure 18:
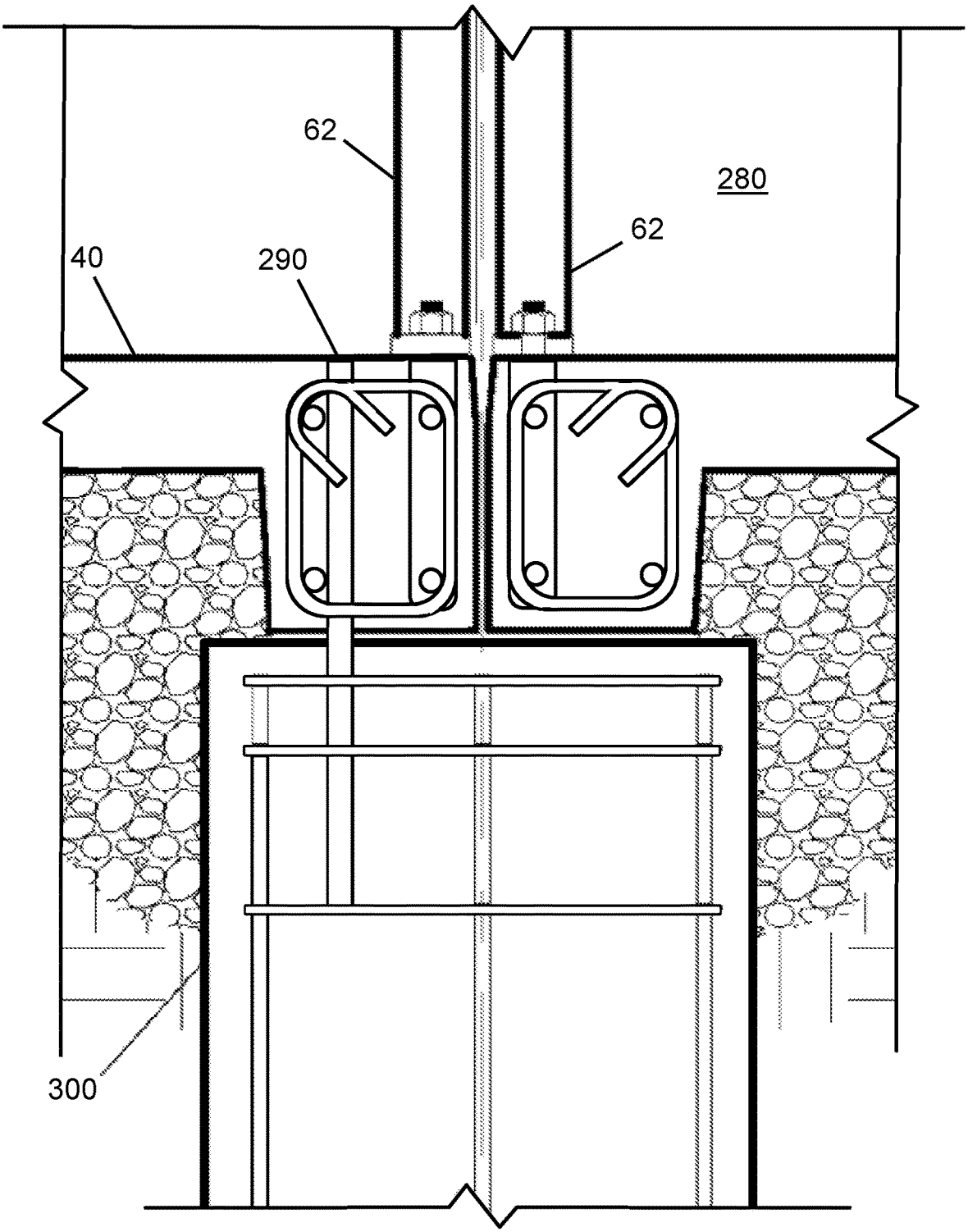
FIG. 18 shows a modules on a pilaster, according to an embodiment of the present invention.

FIG. 18 is a view of two columns 62. The columns are connected to the upper surface of the thickened portions of the floor panels 40 of two adjacent modules. The edges of the bases of the columns are flush with or close to the edges of the floors 40. The thickened edges of the floor panels 40 of two adjacent modules are mounted on a pilaster 300. A precast elevator wall 280 is shown above the floors 40 of the modules. A sleeve 290, complete with a steel rod and adhesive, passes through the thickened portion of the precast floor panel 40 and into the pilaster 300. The precast floors 40 are connected to the pilaster 300 using 1⅛" ID sleeves that penetrate through the thickened precast floor edge of the floor panel, and have a 1" diameter steel rod and adhesive.

Figure 19:
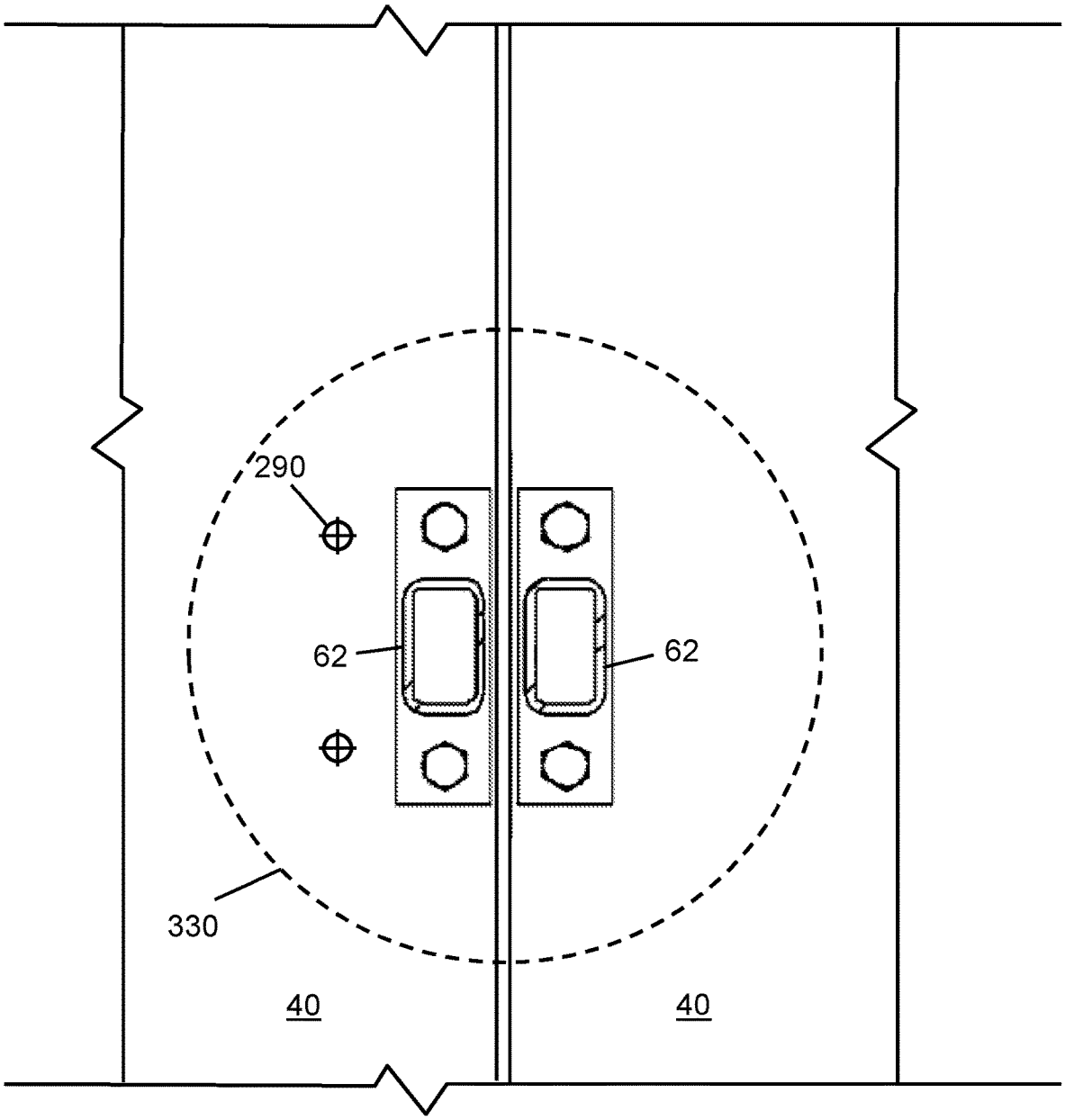
FIG. 19 shows a plan view of FIG. 18, according to an embodiment of the present invention.

FIG. 19 is a plan view of the two columns 62 that are mounted on the floor panels 40 of two adjacent modules. The edges of the bases of the columns are flush with or close to the edges of the floors 40. The sleeves 290, each complete with a steel rod and adhesive, and which pass through the thickened portion of the precast floor panel 40 and into the pilaster 300, are shown. The line 330 of the pier (i.e. pilaster 300) is also shown.

Figure 21:
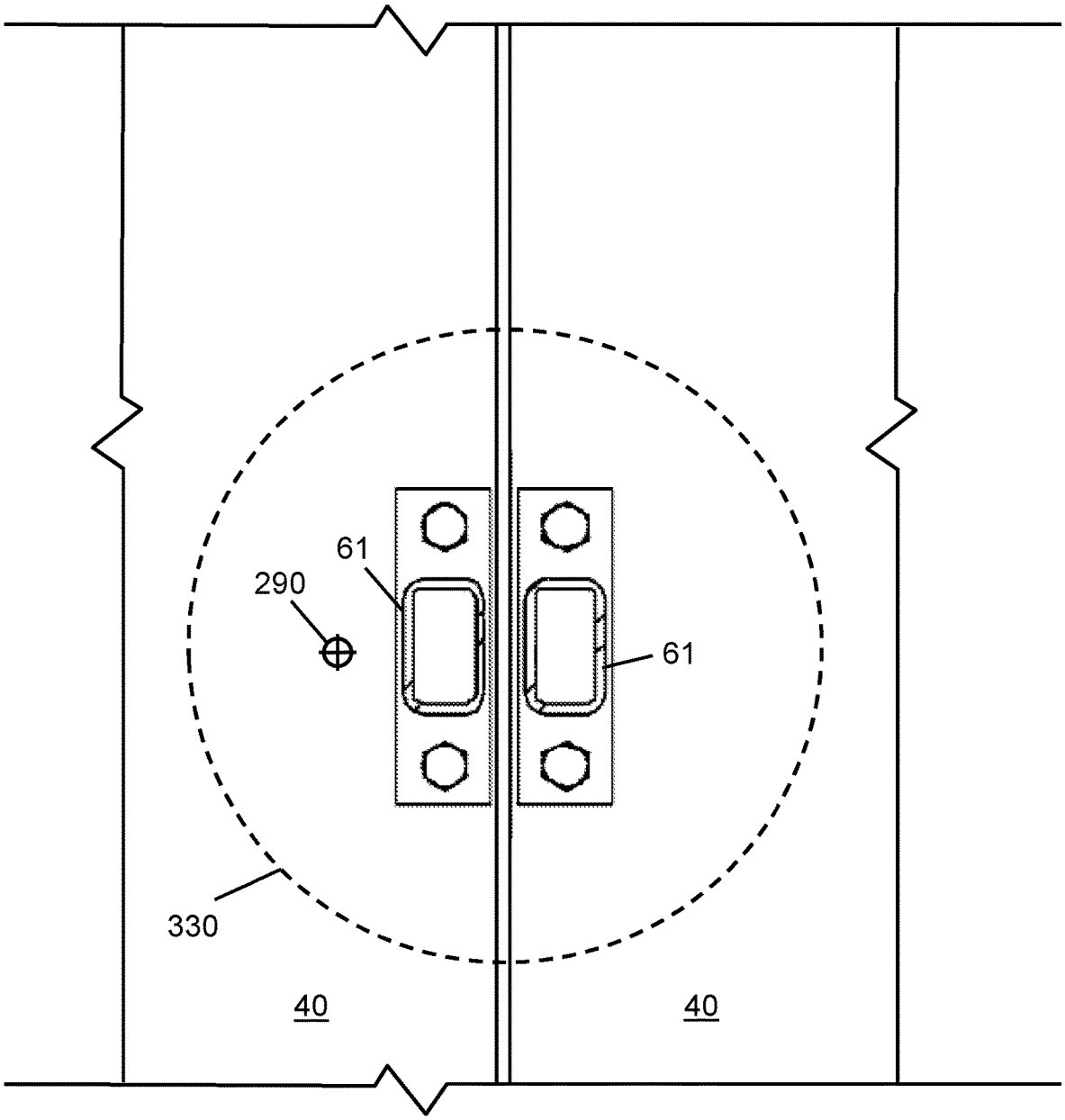
FIG. 21 shows columns at module interiors, according to an embodiment of the present invention.

FIG. 21 is a view of the columns 61 at the module interiors. The two columns are mounted on the floor panels 40 of two adjacent modules. The edges of the base plates of the columns are flush with or close to the edges of the floors 40. A sleeve 290, complete with a steel rod and adhesive, passes through the precast floor panel 40 and into the pier 330.

Figure 25:
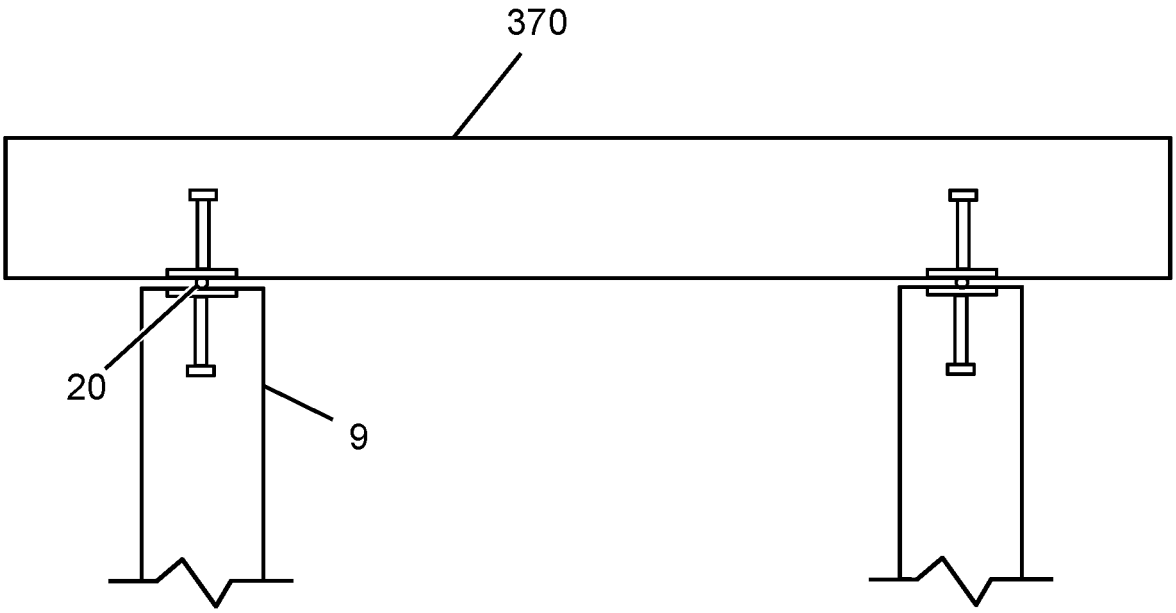
FIG. 25 shows a porte cochere column cap connection, according to an embodiment of the present invention.

FIG. 25 shows a porte cochere column cap connection. The precast column cap 370 is connected to the tops of precast wall panels 9 via rolled rod 20 to fit the gap, complete with foam backer rod and sealant.

Figure 29:
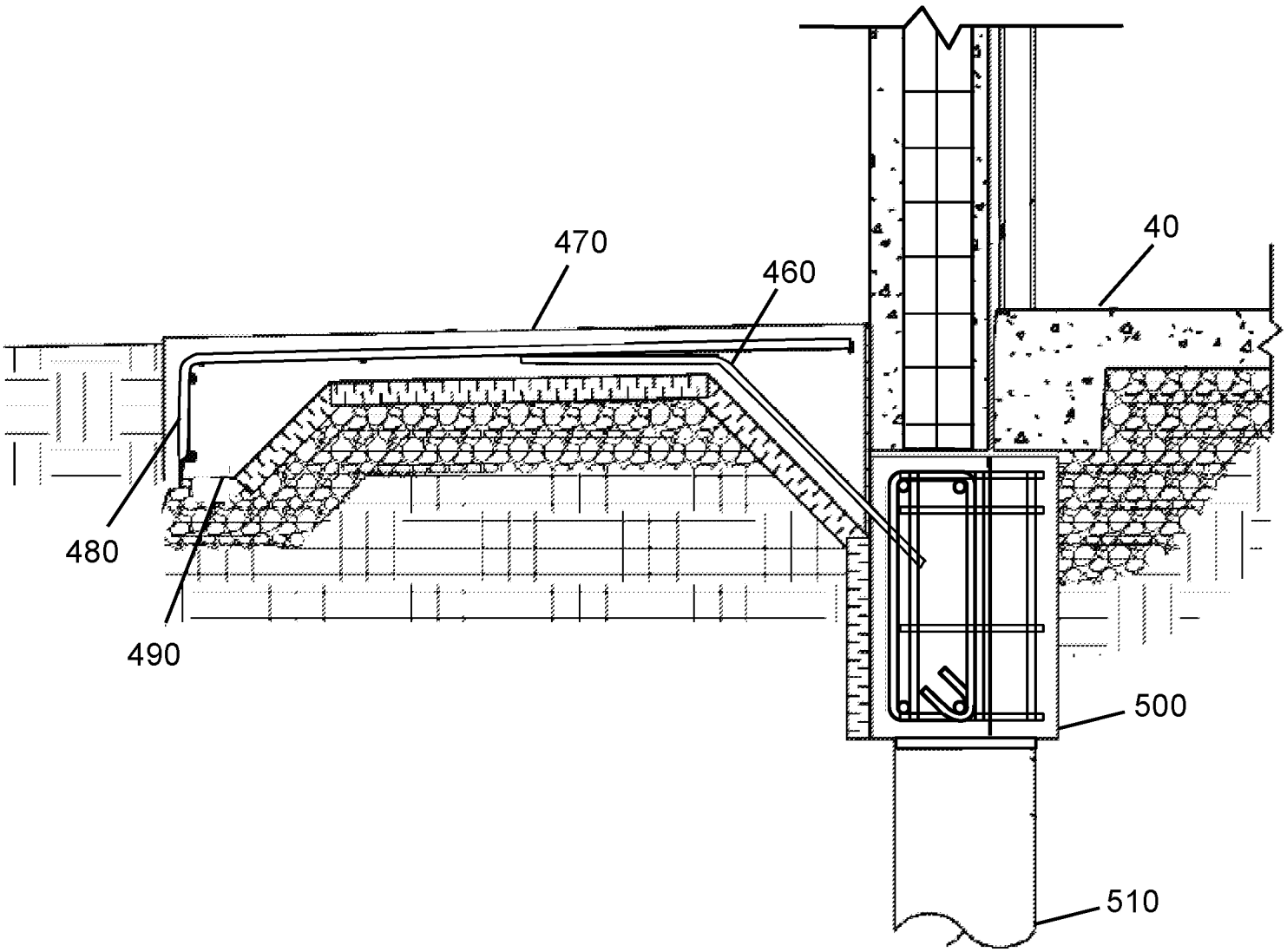
FIG. 29 shows a connection at pilaster, according to an embodiment of the present invention.

FIG. 29 shows the connection at a pilaster. Floor and exterior wall of module are shown above a pile 510 complete with pile cap. All exterior concrete slopes away from the module on a minimum 2% grade 470 and contain 10M dowels 460 at 48" (1.2 m) spacing drilled 6" into the module foundation wall 500 (pier) with adhesive. At the foundation the pile 510 is capped before transitioning into a superior pier 500. At the remote end of the concrete slab its edge 490 typically thickens as it does within the floors of the building project, with the horizontal rebar bent down 480 following the thickening edge to reinforce it.

Figure 30:
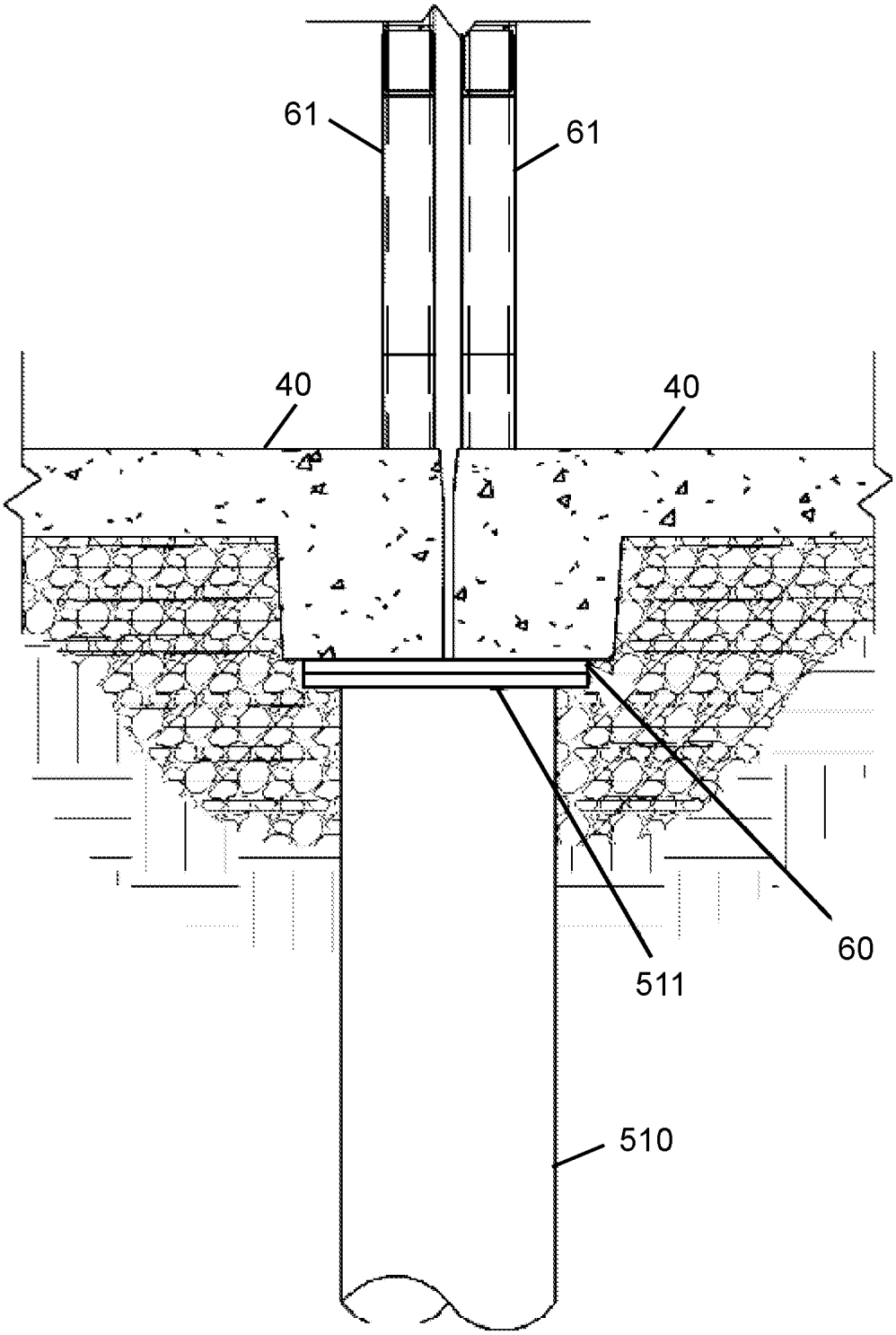
FIG. 30 shows an interior pile, according to an embodiment of the present invention.

FIG. 30 shows an interior pile 510 where the floors 40 of two modules meet. Both modules share the supporting pile and their columns 61 are vertically in line with it. Between each module's concrete slab and the pile is an elastomeric bearing pad 60 a pile cap 511 underneath. The thickened portions of the floors of two adjacent modules are supported on the elastomeric bearing pad 60. The remainder of the volume underneath the slabs and surrounding the pile contains fill.

M. Roof Connections

Roof connections are shown in FIGS. 3, 5, 22, 23, and 46, for example. The ceiling of a unit is mounted below a roof on the module so that each self-contained unit is weatherproofed during transportation and construction and sealed vertically from neighbouring unit water-damage when occupied. The roof is welded to the top perimeter of the frame.

FIG. 3 shows roofs 45 supported from brackets 46 at the top part of the columns 61. FIG. 5 shows a roof 45, which is corrugated, supported from the top part of the wall panel 17 of the lower module 250.

Figure 22:
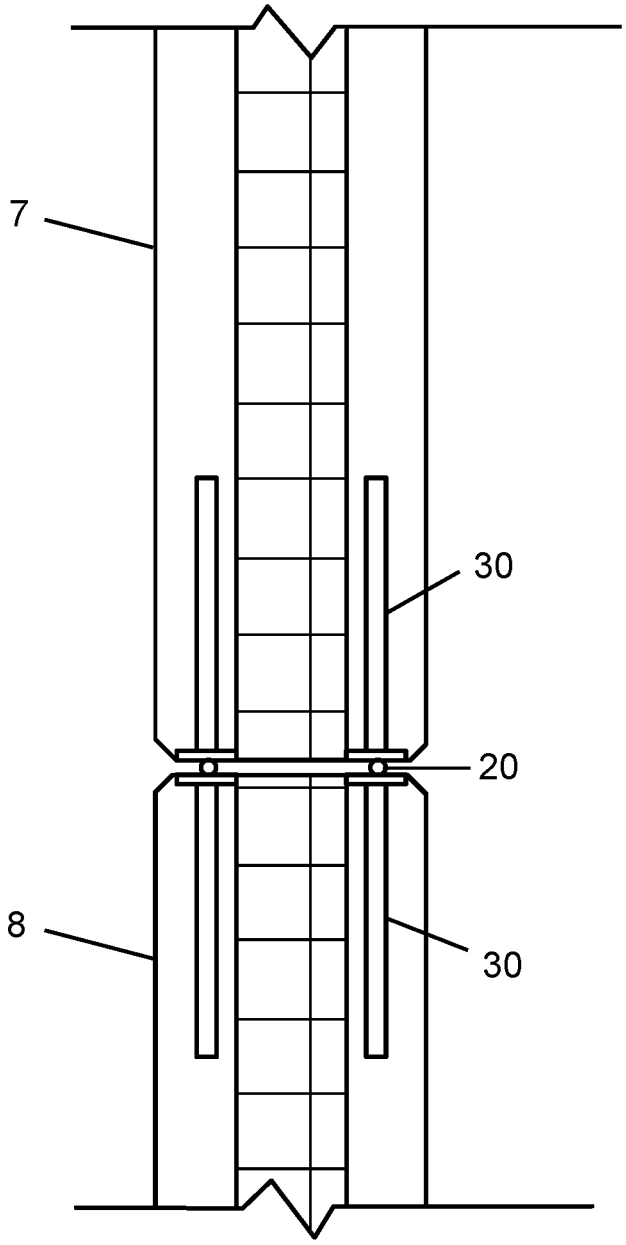
FIG. 22 shows a parapet extension splice, according to an embodiment of the present invention.

FIG. 22 shows a parapet extension splice. Two exterior walls 7, 8 are shown one above the other. Embeds 30 are present in the outer layers of the walls 7, 8. Between the bottom of the upper wall 7 and the top of the lower wall 8, a rolled rod 20 to fit the gap is present, complete with foam backer rod and sealant.

Figure 23:
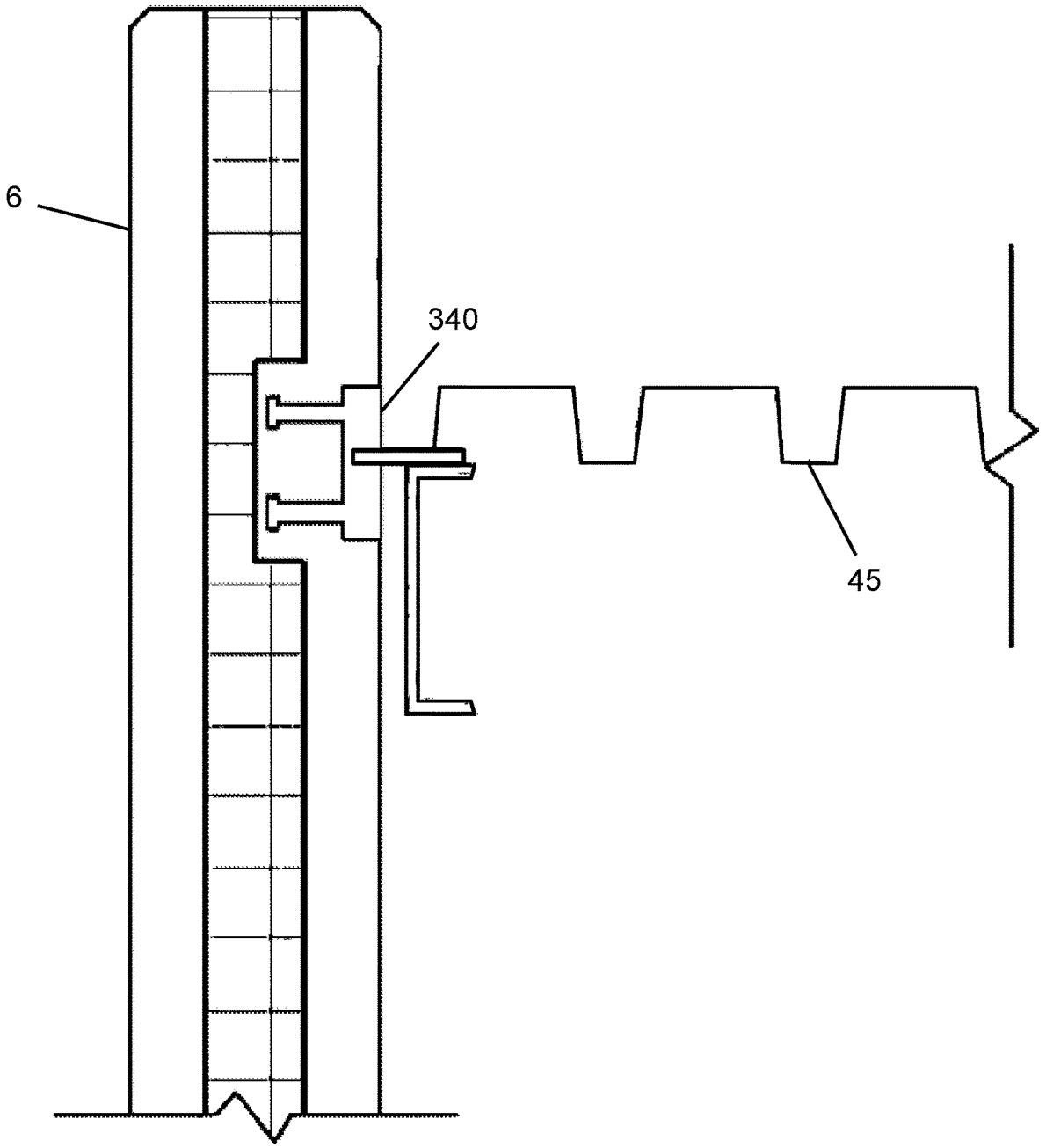
FIG. 23 shows a roof deck parallel to span, according to an embodiment of the present invention.

FIG. 23 shows a roof deck parallel to span. The roof deck 45 is part of a module. The roof deck is connected to a precast wall panel 6. PSA embeds 340 are present in the wall 6.

Figure 46:
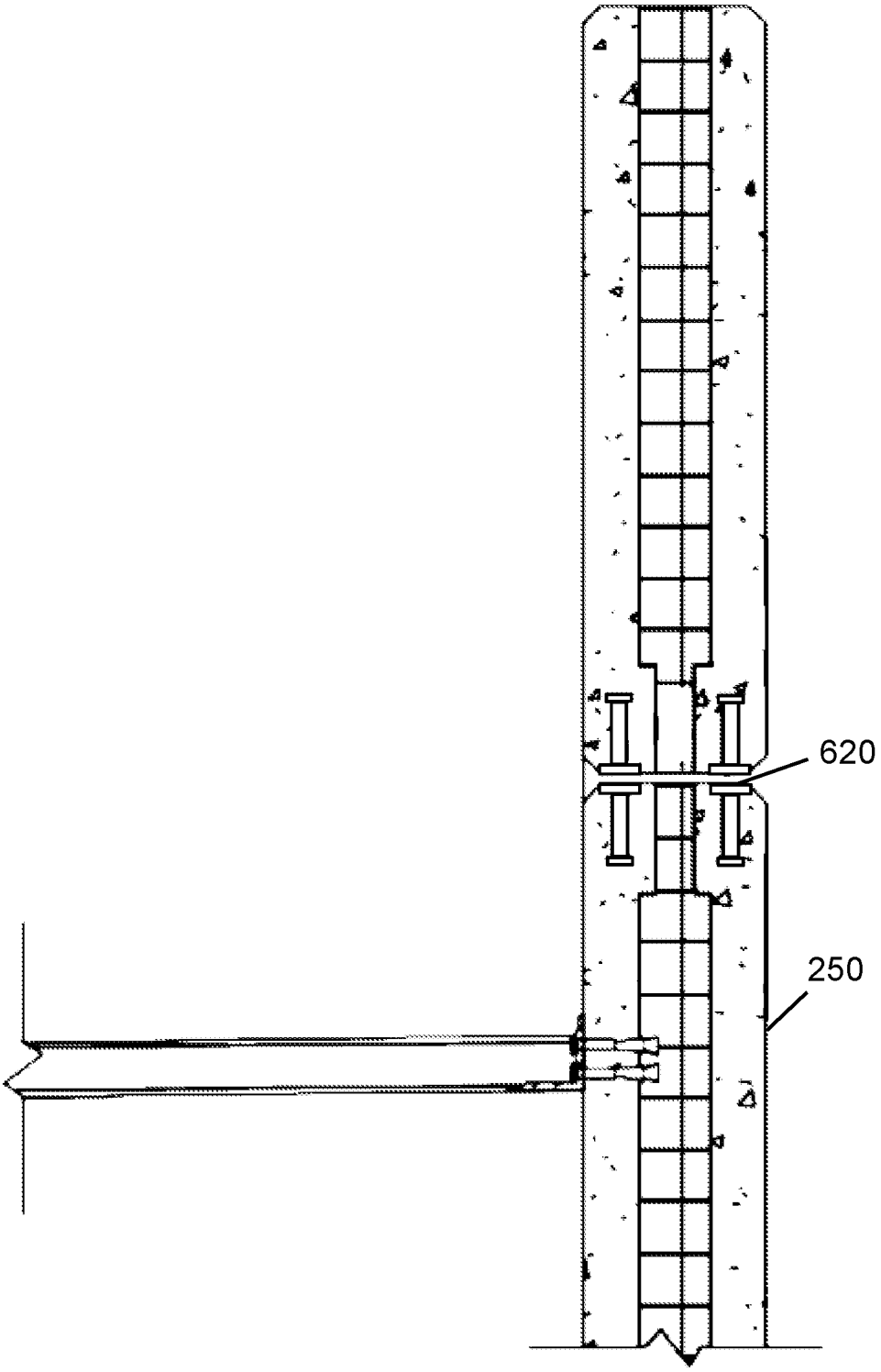
FIG. 46 shows a roof at high parapet, according to an embodiment of the present invention.

FIG. 46 displays the roof connection at its high parapet. The roof is connected to module 250. Connections 620 between the precast panels are at a 48" (1.2 m) spacing. The precast modular wall extends beyond the roof floor with an additional modular wall attached atop it to create a visitor safety barrier. The precast panel to panel connection forming that extended wall is at 48" (1.2 m) spacing and has opposing embedded metal rods on either side of the gap in both the inner and outer concrete slab pieces of the precast wall sandwich which make the connection. The module beam forming the building roof connects to its modular wall with paired metal rods from a steel plate angle attached to the beam and embedding into the module wall.

N. Variations

In general, unless otherwise indicated, singular elements may be in the plural and vice versa with no loss of generality. Examples of other embeds that may be used in the modules are shown in FIGS. 49, 51, 52, 54 and 56.

Throughout the description, specific details have been set forth in order to provide a more thorough understanding of the invention. However, the invention may be practiced without these particulars. In other instances, well known elements have not been shown or described in detail and repetitions of steps and features have been omitted to avoid unnecessarily obscuring the invention. Accordingly, the specification is to be regarded in an illustrative, rather than a restrictive, sense.

It will be clear to one having skill in the art that further variations to the specific details disclosed herein can be made, resulting in other embodiments that are within the scope of the invention disclosed. All parameters, dimensions, materials, and configurations described herein are examples only and actual values or ones of such depend on the specific embodiment. Accordingly, the scope of the invention is to be construed in accordance with the substance defined by the appended claims.

O. Numbered Embodiments

1. A building module comprising:
   a precast concrete floor with opposing edges thickened below the floor;
   a frame comprising hollow structural section bars attached to a top surface of the precast concrete floor over the thickened edges; and
   a roof attached to the frame.
2. The building module of embodiment 1, wherein the frame comprises columns that are bolted to the precast concrete floor and multiple horizontal members that define a top perimeter of the frame.
3. The building module of embodiment 1, comprising studding extending between the precast concrete floor and a horizontal member of the frame that defines a top edge of the frame.
4. The building module of embodiment 1, wherein the roof is welded to the frame.
5. The building module of embodiment 1, comprising a building exterior wall panel attached to the frame.
6. The building module of embodiment 5, wherein the exterior wall panel is located on and overhanging an end of the precast concrete floor, the end of the precast concrete floor being perpendicular to the thickened edges.
7. The building module of embodiment 5, wherein the exterior wall panel has a lower portion of an interior side thereof abutting an outer side of the thickened edge.
8. The building module of embodiment 5, wherein the exterior wall panel has an outer precast concrete layer, a middle insulating layer and an inner precast concrete layer.
9. The building module of embodiment 8, wherein a top surface of the inner precast concrete layer is lower than a top surface of the outer precast concrete layer.
10. The building module of embodiment 1, mounted on a plurality of elastomeric bearing pads underneath the thickened edges.
11. The building module of embodiment 1 in combination with another building module located below the building module, wherein a pin and void locating feature aligns the building module with the other building module.
12. The building module of embodiment 1, wherein the thickened edges terminate at a distance from an end of the precast concrete floor.
13. The building module of embodiment 1 in combination with another building module, wherein:
    a portion of the precast concrete floor extends beyond similar ends of the thickened edges to a connection with a portion of a precast concrete floor of the other building module; and
    the portion of the precast concrete floor of the other building module extends beyond similar ends of the thickened edges of the precast concrete floor of the other building module to the connection.
14. The building module of embodiment 1, wherein hollow structural section bars are steel.
15. A building comprising a building module that comprises:
    a precast concrete floor with opposing edges thickened below the floor;
    a frame comprising hollow structural section bars attached to a top surface of the precast concrete floor over the thickened edges; and
    a roof attached to the frame.
16. The building of embodiment 15 comprising another building module and a corridor, wherein:
    a portion of the precast concrete floor extends beyond similar ends of the thickened edges to a connection with a portion of a precast concrete floor of the other building module;
    the portion of the precast concrete floor of the other building module extends beyond similar ends of the thickened edges of the precast concrete floor of the other building module to the connection:

a floor of the corridor is formed by:

the portion of the precast concrete floor that extends beyond the end of the thickened edges of the building module; and the portion of the precast concrete floor of the other building module that extends beyond the thickened edges of the precast concrete floor of the other building module.

17. The building of embodiment 16, wherein the connection comprises a steel plate that is connected to embedded plates that are cast into said extended portions of said precast concrete floors.

18. The building of embodiment 15, wherein the thickened edges terminate at a distance from an end of the precast concrete floor.

19. The building of embodiment 18 comprising a balcony formed by a portion of the precast concrete floor that does not have thickened edges.

The invention claimed is:

1. A building module comprising:

a precast concrete floor with opposing edges thickened below the floor;

a frame comprising hollow structural section bars attached to a top surface of the precast concrete floor over the thickened edges; and a roof attached to the frame;

wherein:

the building module is in combination with another building module;

a portion of the precast concrete floor extends beyond similarly-facing ends of the thickened edges to a connection with a portion of a precast concrete floor of the other building module; and the portion of the precast concrete floor of the other building module extends beyond similarly-facing ends of thickened edges of the precast concrete floor of the other building module to the connection.

2. The building module of claim 1, wherein the frame comprises columns that are bolted to the precast concrete floor and multiple horizontal members that define a top perimeter of the frame.

3. The building module of claim 1, comprising studding extending between the precast concrete floor and a horizontal member of the frame that defines a top edge of the frame.

4. The building module of claim 1, wherein the roof is welded to the frame.

5. The building module of claim 1, comprising a building exterior wall panel attached to the frame.

6. The building module of claim 5, wherein the building exterior wall panel is located on and overhanging an end of the precast concrete floor opposite the connection, the end of the precast concrete floor being perpendicular to the thickened edges.

7. The building module of claim 5, wherein the building exterior wall panel has a lower portion of an interior side thereof abutting an outer side of the thickened edge.

8. The building module of claim 5, wherein the building exterior wall panel has an outer precast concrete layer, a middle insulating layer and an inner precast concrete layer.

9. The building module of claim 8, wherein a top surface of the inner precast concrete layer is lower than a top surface of the outer precast concrete layer.

10. The building module of claim 1, mounted on a plurality of elastomeric bearing pads underneath the thickened edges.

11. The building module of claim 1 in combination with a further building module located below the building module, wherein a pin and void locating feature aligns the building module with the further building module.

12. The building module of claim 1, wherein the thickened edges terminate at a distance from an end of the precast concrete floor.

13. The building module of claim 1, wherein the hollow structural section bars are made of steel.

14. A building comprising a building module that comprises:

a precast concrete floor with opposing edges thickened below the floor;

a frame comprising hollow structural section bars attached to a top surface of the precast concrete floor over the thickened edges;

a roof attached to the frame; and another building module;

wherein:

a portion of the precast concrete floor extends beyond similarly-facing ends of the thickened edges to a connection with a portion of a precast concrete floor of the other building module; and the portion of the precast concrete floor of the other building module extends beyond similarly-facing ends of thickened edges of the precast concrete floor of the other building module to the connection.

15. The building of claim 14 comprising a corridor, wherein a floor of the corridor is formed by:

said portion of the precast concrete floor of the building module; and said portion of the precast concrete floor of the other building module.

16. The building of claim 15, wherein the connection comprises a steel plate that is connected to embedded plates that are cast into said portions of said precast concrete floors.

17. The building of claim 14, wherein the thickened edges terminate at a distance from an end of the precast concrete floor.

18. The building of claim 17 comprising a balcony formed by another portion of the precast concrete floor that does not have thickened edges.

* * * * *